US007864005B2

(12) United States Patent
Gouhl et al.

(10) Patent No.: US 7,864,005 B2
(45) Date of Patent: Jan. 4, 2011

(54) ARC-FAULT CIRCUIT INTERRUPTER DEVICE

(75) Inventors: Erik J. Gouhl, Fayetteville, GA (US); Gregory G. Moreinis, Forest Hills, NY (US); Gunter A. Gallas, Woodbury, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/729,091

(22) Filed: Mar. 22, 2010

(65) Prior Publication Data

US 2010/0201466 A1 Aug. 12, 2010

Related U.S. Application Data

(63) Continuation of application No. 11/495,972, filed on Jul. 28, 2006, now Pat. No. 7,683,745.

(51) Int. Cl.
*H01H 75/00* (2006.01)
*H01H 77/00* (2006.01)
*H01H 83/00* (2006.01)

(52) U.S. Cl. ..... 335/18; 335/6; 335/13; 335/17; 335/21; 335/34; 335/52; 335/71; 335/72; 335/77; 335/88; 335/116; 335/150; 335/166; 335/172; 335/199; 335/202; 361/42

(58) Field of Classification Search ..... 335/6, 335/13, 17–18, 21–27, 34, 52, 71, 72, 77, 335/88, 116, 150, 166, 172, 199, 202; 361/42
See application file for complete search history.

(56) References Cited

U.S. PATENT DOCUMENTS

| | | | |
|---|---|---|---|
| 3,932,790 | A | 1/1976 | Muchnick |
| 4,002,951 | A | 1/1977 | Halbeck |
| 4,123,634 | A | 10/1978 | Hults |
| 4,518,945 | A | 5/1985 | Doyle et al. |
| 4,595,894 | A | 6/1986 | Doyle et al. |
| 4,618,907 | A | 10/1986 | Leopold |
| 4,630,015 | A | 12/1986 | Gernhardt et al. |
| 4,688,134 | A | 8/1987 | Freeman et al. |
| 4,802,052 | A | 1/1989 | Brant et al. |
| 4,829,289 | A | 5/1989 | Kallman et al. |
| 4,843,200 | A | 6/1989 | Parlatore et al. |
| 5,207,317 | A | 5/1993 | Bryde et al. |
| 5,223,810 | A | 6/1993 | Van Haaren |
| 5,363,269 | A | 11/1994 | McDonald |
| 5,371,646 | A | 12/1994 | Biegelmeier |
| 5,380,972 | A | 1/1995 | Lunak et al. |
| 5,382,768 | A | 1/1995 | Kurek et al. |

(Continued)

FOREIGN PATENT DOCUMENTS

| | | |
|---|---|---|
| WO | WO/00/11696 | 3/2000 |

OTHER PUBLICATIONS

Installation and Operating Instructions for Impressions 3-Key Incandescent Touch Dimmers, Pass & Seymour, May 1992.

(Continued)

*Primary Examiner*—Anh T Mai
*Assistant Examiner*—Mohamad A Musleh
(74) *Attorney, Agent, or Firm*—King & Spalding LLP

(57) ABSTRACT

A ground fault circuit interrupter device is described.

20 Claims, 34 Drawing Sheets

U.S. PATENT DOCUMENTS

| | | | |
|---|---|---|---|
| 5,384,441 | A | 1/1995 | Balaban et al. |
| 5,477,412 | A | 12/1995 | Neiger et al. |
| 5,500,498 | A | 3/1996 | Kurek et al. |
| 5,510,760 | A | 4/1996 | Marcou et al. |
| 5,515,218 | A | 5/1996 | DeHaven |
| 5,570,778 | A | 11/1996 | Gernhardt et al. |
| 5,594,398 | A | 1/1997 | Marcou et al. |
| 5,595,289 | A | 1/1997 | Kurek et al. |
| 5,630,502 | A | 5/1997 | Kurek et al. |
| 5,642,052 | A | 6/1997 | Earle |
| 5,647,479 | A | 7/1997 | Gernhardt et al. |
| 5,694,280 | A | 12/1997 | Zhou |
| 5,715,125 | A | 2/1998 | Neiger et al. |
| 5,726,900 | A | 3/1998 | Walter et al. |
| 5,731,559 | A | 3/1998 | Daccord |
| 5,825,599 | A | 10/1998 | Rosenbaum |
| 5,826,710 | A | 10/1998 | Kurek et al. |
| 5,836,443 | A | 11/1998 | Gernhardt et al. |
| 5,875,087 | A | 2/1999 | Spencer et al. |
| 5,933,063 | A | 8/1999 | Keung et al. |
| D413,862 | S | 9/1999 | Huang et al. |
| 5,956,218 | A | 9/1999 | Berthold |
| 5,982,593 | A | 11/1999 | Kimblin et al. |
| 6,040,967 | A | 3/2000 | DiSalvo |
| 6,052,265 | A | 4/2000 | Zaretsky et al. |
| 6,199,264 | B1 | 3/2001 | Marcou et al. |
| 6,226,161 | B1 | 5/2001 | Neiger et al. |
| 6,246,558 | B1 | 6/2001 | DiSalvo et al. |
| 6,282,070 | B1 | 8/2001 | Ziegler et al. |
| 6,288,882 | B1 | 9/2001 | DiSalvo et al. |
| 6,339,201 | B1 | 1/2002 | Balaban et al. |
| 6,381,112 | B1 | 4/2002 | DiSalvo |
| 6,433,555 | B1 | 8/2002 | Leopold et al. |
| 6,437,953 | B2 | 8/2002 | DiSalvo et al. |
| 6,515,564 | B2 | 2/2003 | Leopold et al. |
| 6,525,541 | B1 | 2/2003 | Leopold |
| 6,646,838 | B2 | 11/2003 | Ziegler et al. |
| 6,657,834 | B2 | 12/2003 | DiSalvo |
| 6,693,779 | B2 | 2/2004 | DiSalvo |
| 6,717,782 | B2 | 4/2004 | DiSalvo et al. |
| 6,813,126 | B2 | 11/2004 | DiSalvo et al. |
| 6,828,886 | B2 | 12/2004 | Germain et al. |
| 6,829,124 | B2 | 12/2004 | Leopold |
| 6,864,766 | B2 | 3/2005 | DiSalvo et al. |
| 6,944,001 | B2 | 9/2005 | Ziegler et al. |
| 6,949,995 | B2 | 9/2005 | Leopold |
| 6,958,895 | B1 | 10/2005 | Radosavljevic et al. |
| 6,975,192 | B2 | 12/2005 | DiSalvo |
| 6,975,492 | B2 | 12/2005 | DiSalvo |
| 6,998,945 | B2 | 2/2006 | Huang et al. |
| D521,932 | S | 5/2006 | Fort et al. |
| 7,049,911 | B2 | 5/2006 | Germain et al. |
| 7,173,799 | B1 | 2/2007 | Weeks et al. |
| 7,498,910 | B2 | 3/2009 | Gallas et al. |
| 7,538,647 | B2 | 5/2009 | Leopold |
| 2002/0071228 | A1 | 6/2002 | Campolo et al. |
| 2002/0154488 | A1 | 10/2002 | Leopold |
| 2004/0184207 | A1 | 9/2004 | DiSalvo et al. |
| 2004/0218316 | A1 | 11/2004 | Germain et al. |
| 2004/0223272 | A1 | 11/2004 | Germain et al. |
| 2005/0002138 | A1 | 1/2005 | Germain et al. |
| 2005/0063110 | A1 | 3/2005 | DiSalvo et al. |
| 2006/0007611 | A1 | 1/2006 | Ziegler et al. |
| 2008/0024252 | A1 | 1/2008 | Gallas et al. |
| 2008/0211607 | A1 | 9/2008 | Gallas et al. |

OTHER PUBLICATIONS

Impressions, Electrical Wiring Devices and Accessories, particularly CFCIs, Pass & Seymour, Apr. 1991.

Catalog for Leviton Wiring Devices for Construction and maintenance, Leviton Manufacturing Co., Inc., 2000.

Lurton Residential Lighting Controls Catalog, pp. 70-73, Lutron Electronics Co., Inc., 2001.

Installation and Operating Instructions for Impressions 3-Key Incandescent Touch Dimmers, Pass & Seymour, May 1992.

U.S. Appl. No. 11/495,327, Leopold.

U.S. Appl. No. 11/495,222, Gallas et al.

U.S. Appl. No. 11/494,966, Moreinis et al.

U.S. Appl. No. 11/495,091, Gallas et al.

ARC-FAULT CIRCUIT INTERRUPTER DEVICE

CROSS REFERENCE TO RELATED APPLICATIONS

The present application is a continuation of and claims priority to U.S. patent application Ser. No. 11/495,972, filed on Jul. 28, 2006, now U.S. Pat. No. 7,683,745 and titled "Ground Fault Circuit Interrupter Device," the entire disclosure of which is hereby incorporated herein by reference.

BACKGROUND

The present disclosure relates in general to ground fault circuit interrupter devices such as, for example, ground fault circuit interrupter receptacles.

DETAILED DESCRIPTION

Figure 2:
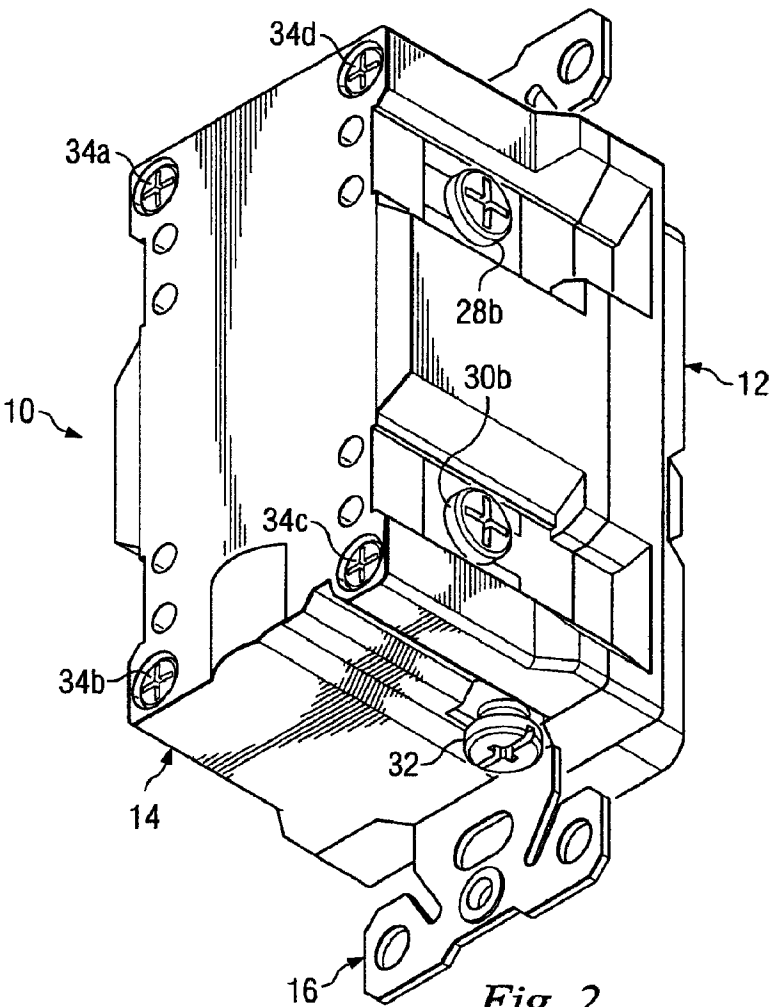
FIG. 2 is another perspective view of the device of FIG. 1.
Figure 1:
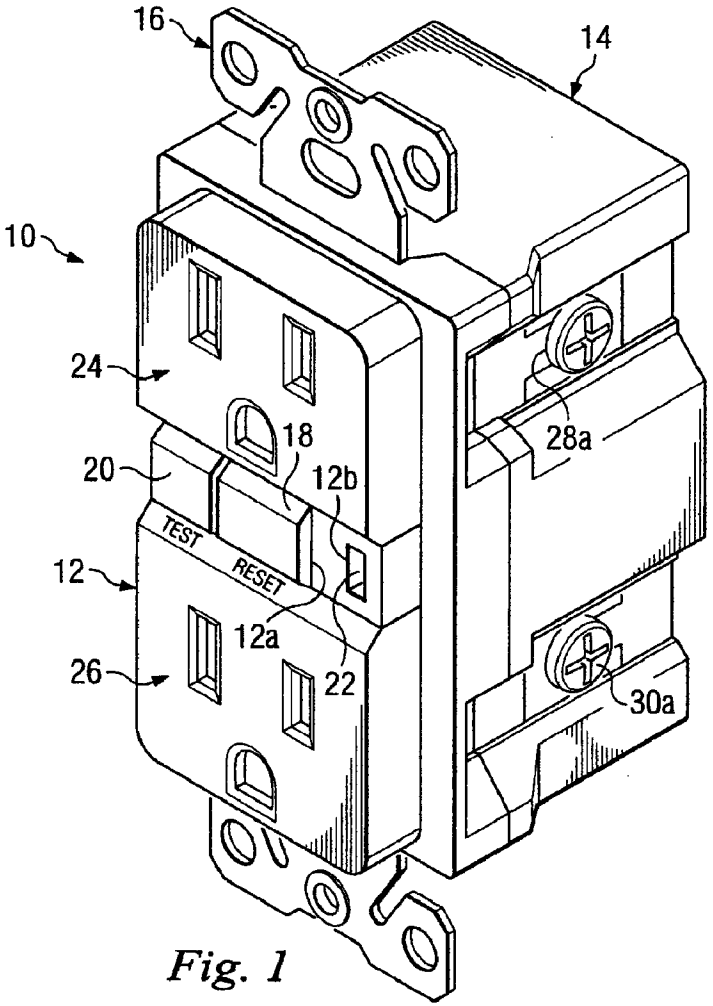
FIG. 1 is a perspective view of an exemplary embodiment of a ground fault circuit interrupter device.

In an exemplary embodiment, as illustrated in FIGS. 1 and 2, a ground fault circuit interrupter (GFCI) device is generally referred to by the reference numeral 10 and includes a top housing 12 and a bottom housing 14 coupled thereto. A mounting strap 16 extends between the top housing 12 and the bottom housing 14. An opening 12*a* is formed in the top housing 12, and a reset button 18 and a test button 20 extend within the opening 12*a*. An opening 12*b* is formed in the top housing 12, and an end of a light pipe 22 is visible through the opening 12*b*. The top housing 12 further includes sets of receptacle outlets 24 and 26, each of which is adapted to receive a two-prong or three-prong electrical plug.

Load terminal screws 28*a* and 28*b* are disposed on opposing sides of the bottom housing 14, and line terminal screws 30*a* and 30*b* are also disposed on opposing sides of the bottom housing 14. Each of the terminal screws 28*a* and 30*a* is a hot terminal screw, and each of the terminal screws 28*b* and 30*b* is a neutral terminal screw. A ground screw 32 is coupled to the mounting strap 16. Fasteners 34*a*, 34*b*, 34*c* and 34*d* couple the bottom housing 14 to the top housing 12 and clamp the mounting strap 16 therebetween.

Figure 3:
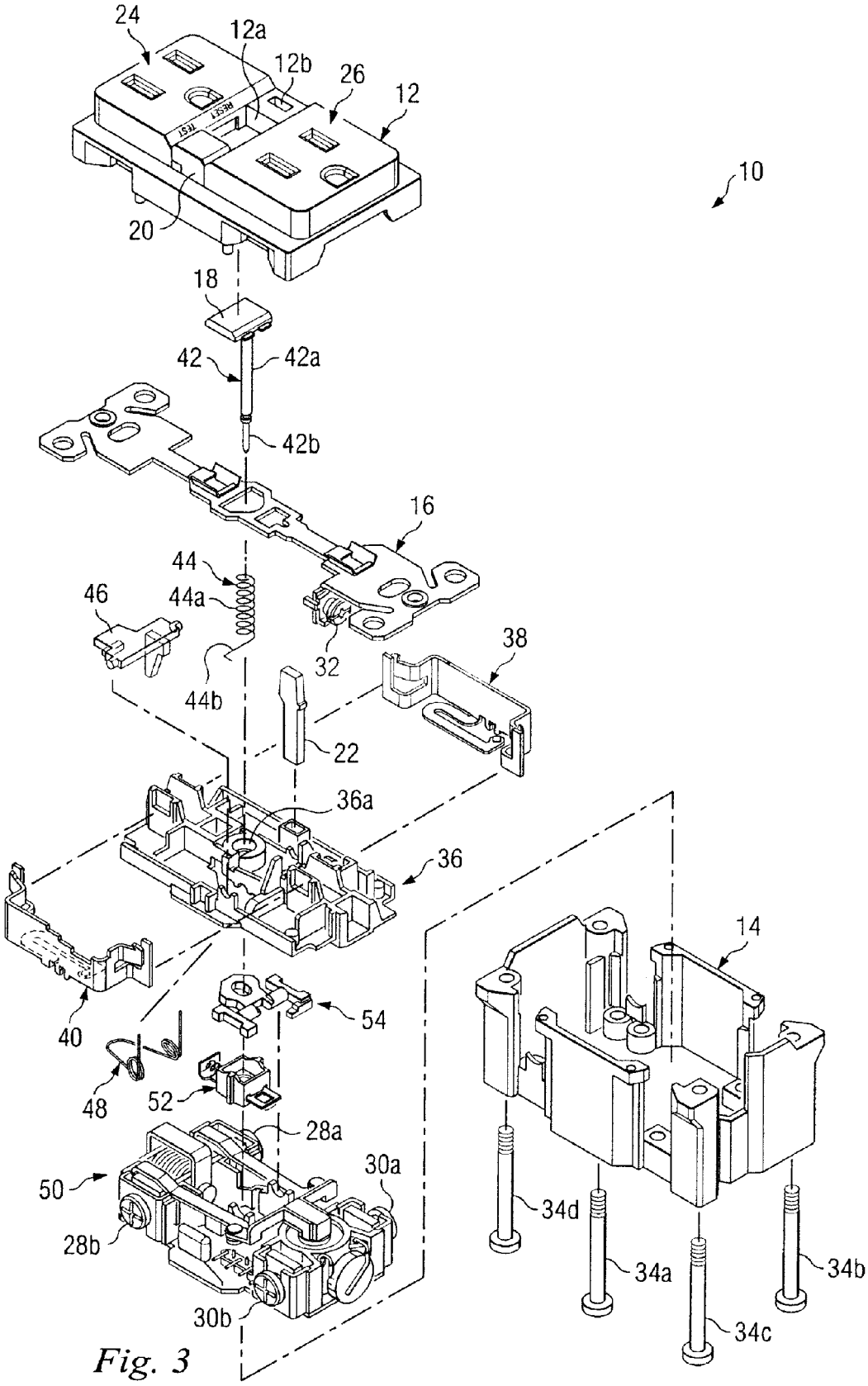
FIG. 3 is an exploded view of the device of FIG. 1.

In an exemplary embodiment, as illustrated in FIG. 3, a middle housing 36 is coupled to the bottom housing 14, and receptacle contacts 38 and 40 are received in the middle housing 36. A counterbore 36*a* extends through the middle housing 36, and a reset shaft 42 extends through the counterbore 36*a*. The reset shaft 42 is coupled to the reset button 18 and further extends through a spring 44, which includes a helical portion 44*a* and an L-shaped leg 44*b* extending therefrom. The light pipe 22 is received by the middle housing 36, and includes a stepped end portion 22*a* and a protrusion 22*b*.

An actuator 46 is received by the middle housing 36, and a torsion spring 48 is coupled to the middle housing 36. A printed circuit board (PCB) assembly 50 is received by the bottom housing 14, and a latch assembly 52 is received by the PCB assembly 50. A cam 54 is also received by the PCB assembly 50.

Figure 4A:
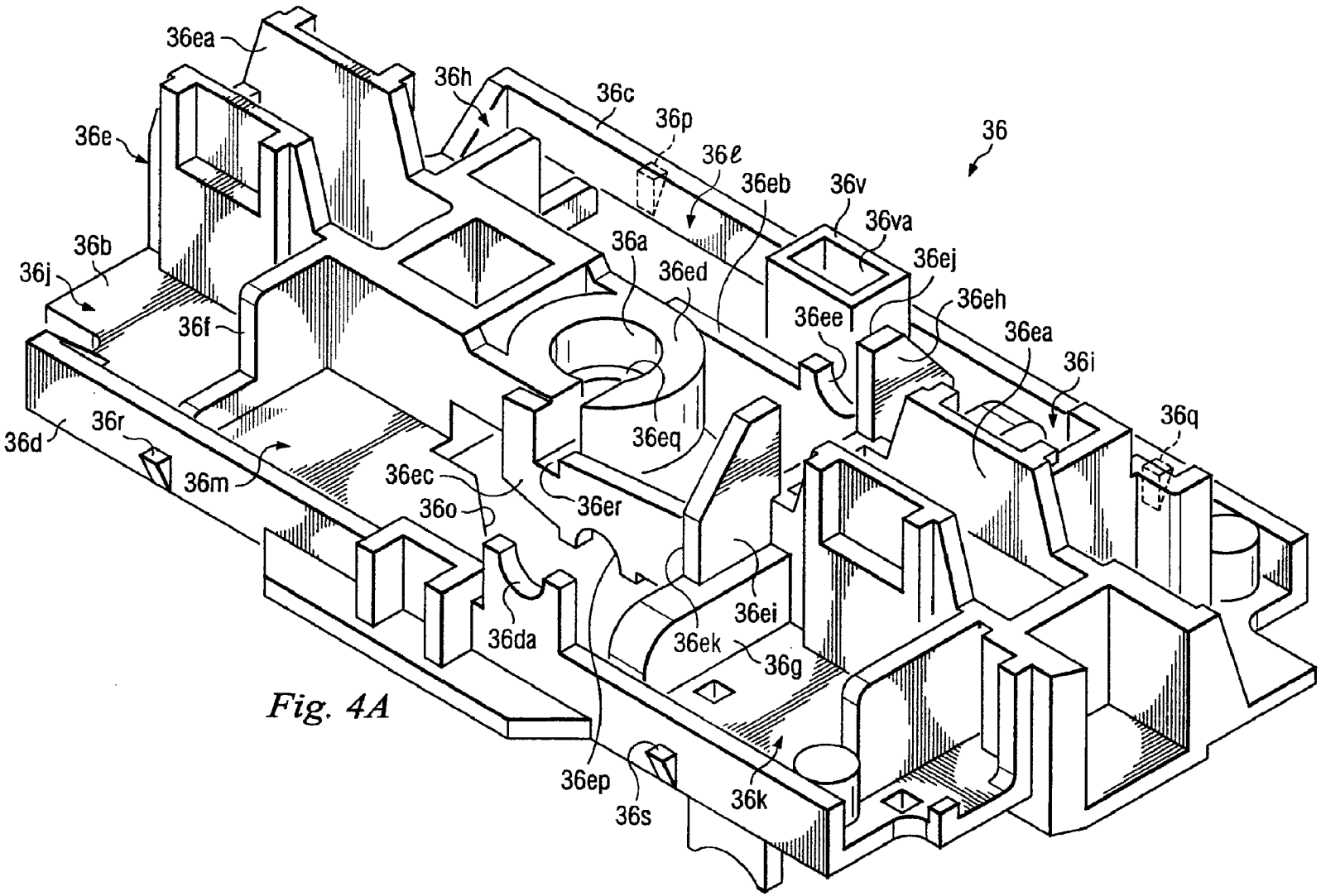
FIG. 4A is a perspective view of a middle housing depicted in FIG. 3.
Figure 4B:
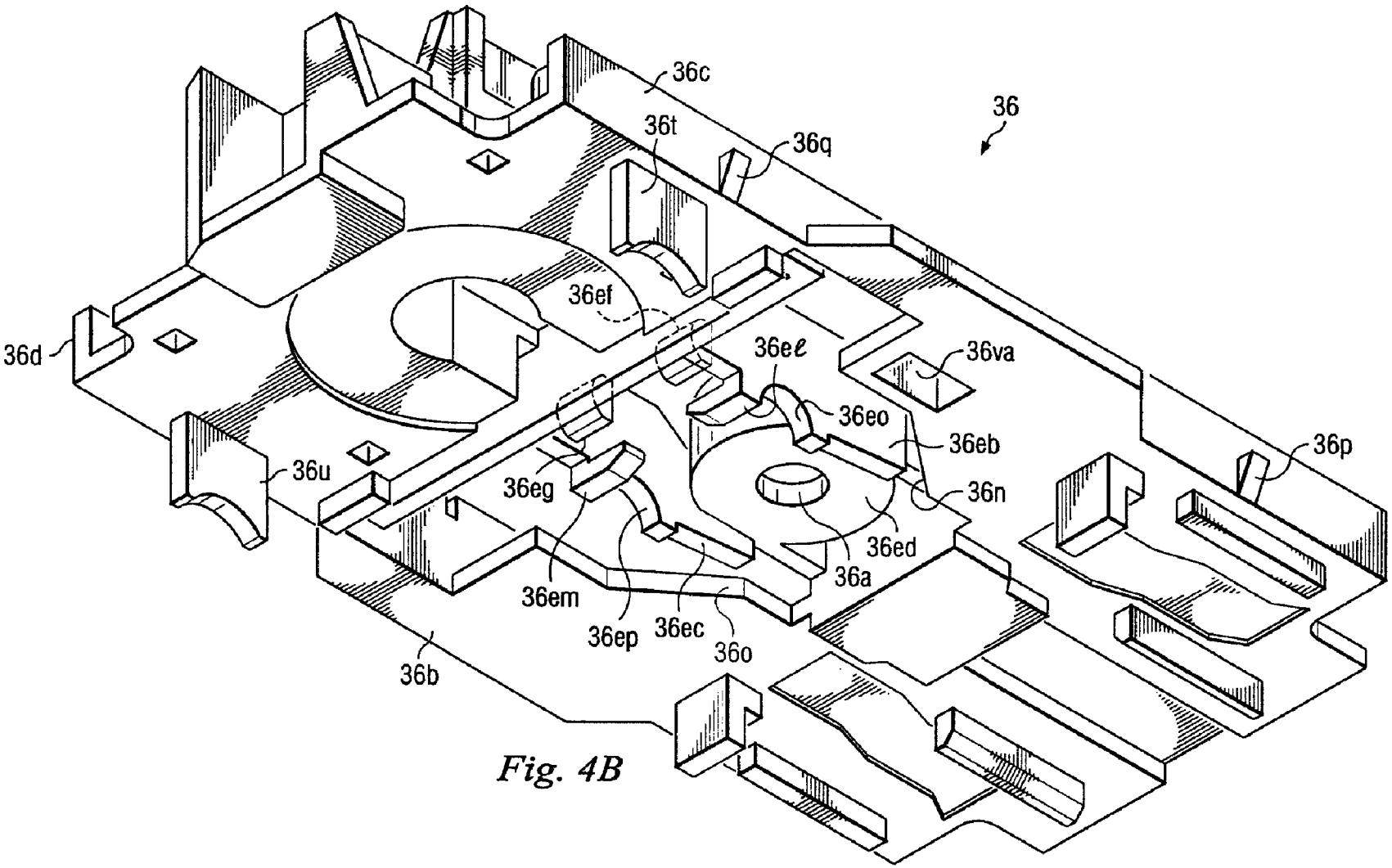
FIG. 4B is another perspective view of the middle housing of FIG. 4A.
Figure 5:
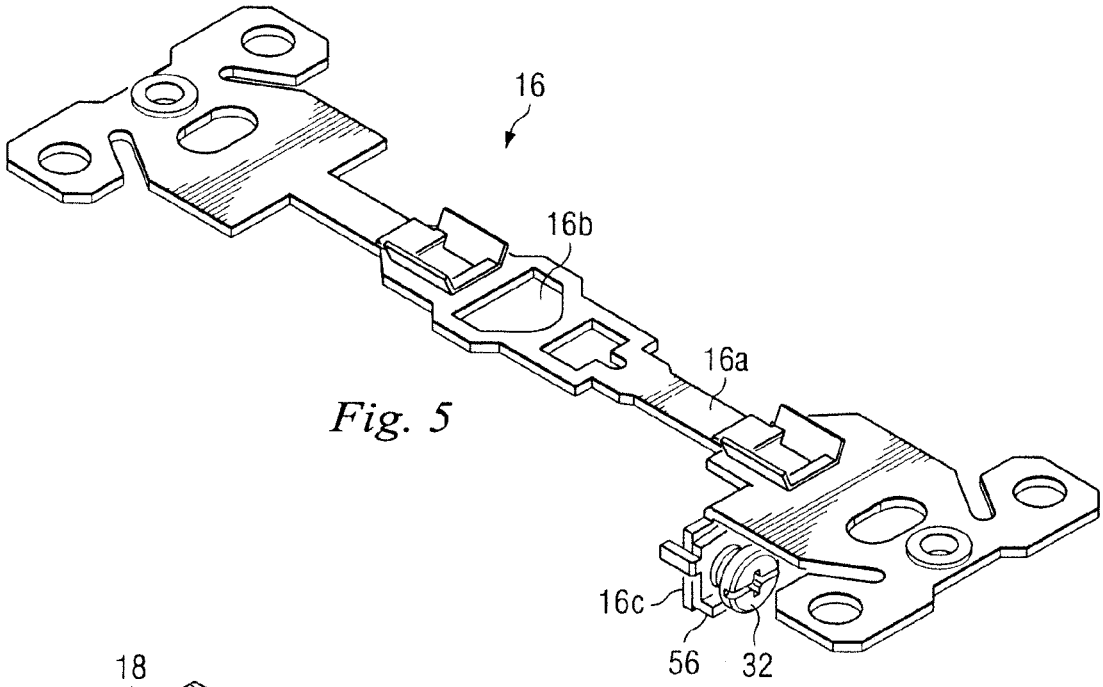
FIG. 5 is a perspective view of a mounting strap depicted in FIG. 3.

In an exemplary embodiment, as illustrated in FIGS. 4 and 5, the middle housing 36 includes a tray portion 36*b* from which walls 36*c* and 36*d*, and a longitudinally-extending center portion 36*e*, extend. Generally planar portions 36*f* and 36*g* extend from the tray portion 36*b* and through the center portion 36*e*, and are generally perpendicular to the center portion 36*e*.

A region 36*h* is defined by the tray portion 36*b*, the wall 36*c*, the center portion 36*e* and the planar portion 36*f*. A region 36*i* is defined by the tray portion 36*b*, the wall 36*c*, the center portion 36*e* and the planar portion 36*g*. A region 36*j* is defined by the tray portion 36*b*, the wall 36*d*, the center portion 36*e* and the planar portion 36*f*. A region 36*k* is defined by the tray portion 36*b*, the wall 36*d*, the center portion 36*e* and the planar portion 36*g*. A region 36*l* is defined by the wall 36*c*, the center portion 36*e* and the planar portions 36*f* and 36*g*. A region 36*m* is defined by the wall 36*d*, the center portion 36*e* and the planar portions 36*f* and 36*g*. Openings 36*n* and 36*o* are formed in the tray portion 36*b* in the regions 36*l* and 36*m*, respectively, and are substantially symmetric about the center portion 36*e*.

Snap-fit protrusions 36*p* and 36*q* extend from the outside surface of the wall 36*c*, and snap-fit protrusions 36*r* and 36*s* extend from the outside surface of the wall 36*d*. Protrusions 36*t* and 36*u* extend from the tray portion 36 in a direction opposing the direction of extension of the walls 36*c* and 36*d*. A protrusion 36*v* defining a passage 36*va* extends upward from the tray portion 36*b* and is proximate the wall 36*c*.

The center portion 36*e* is substantially symmetric about its longitudinal axis, defines a channel 36*ea*, and includes a pair of walls 36*eb* and 36*ec* spaced in a parallel relation. A cylindrical protrusion 36*ed*, through which the counterbore 36*a* extends, at least partially extends between the walls 36*eb* and 36*ec*. An arcuate notch 36*ee* is formed in the wall 36*eb*. Protrusions 36*ef* and 36*eg* extend from the walls 36*eb* and 36*ec*, respectively, and towards each other. Protrusions 36*eh* and 36*ei* extend from the planar portion 36*g* and the corresponding ends of the walls 36*eb* and 36*ec*, respectively. Surfaces 36*ej* and 36*ek* are defined by the protrusions 36*eb* and 36*ei*, respectively. Tabs 36*e*1 and 36*em* extend from the walls 36*eb* and 36*ec*, respectively, and towards each other. Coaxial arcuate notches 36*eo* and 36*ep* are formed in the walls 36*eb* and 36*ec*, respectively. The notches 36*eo* and 36*ee* are formed in opposing edges of the wall 36*eb*. An internal shoulder 36 eq is defined by the counterbore 36*a*, and a channel 36*er* is formed in the cylindrical protrusion 36*ed* and the wall 36*ec*. An arcuate notch 36*da* is formed in the wall 36*d* and is coaxial with the arcuate notch 36*ee*. In an exemplary embodiment, the middle housing 36 is a unitary part composed of molded plastic.

In an exemplary embodiment, as illustrated in FIG. 5, the mounting strap 16 includes a center portion 16*a* and an opening 16*b* therethrough. The ground screw 32 is captively threadably engaged with a tab 16*c* of the mounting strap 16, and extends through a terminal plate 56 so that the terminal plate 56 is disposed between the tab 16*c* and the head of the ground screw 32.

Figure 6:
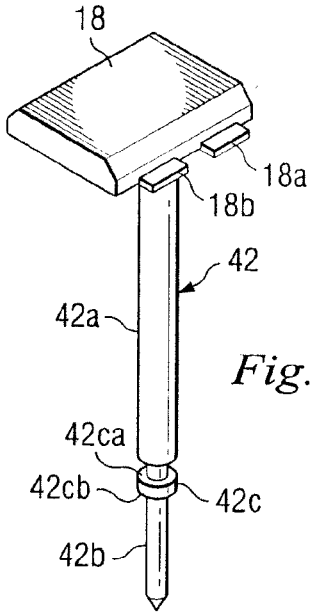
FIG. 6 is a perspective view of a reset button and shaft depicted in FIG. 3.

In an exemplary embodiment, as illustrated in FIG. 6, the shaft 42 includes an enlarged-diameter portion 42*a* extending from the reset button 18, and a reduced-diameter portion 42*b* extending from the enlarged-diameter portion 42*a*. A flange 42*c* defining surfaces 42*ca* and 42*cb* radially extends from the reduced-diameter portion 42*b*, and is axially spaced from the enlarged-diameter portion 42*a*. The reset button 18 includes tabs 18*a* and 18*b*, and tabs opposing tabs 18*a* and 18*b*, which are not shown.

Figure 7:
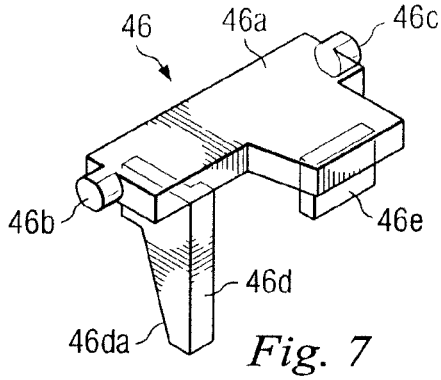
FIG. 7 is a perspective view of an actuator depicted in FIG. 3.
Figure 8:
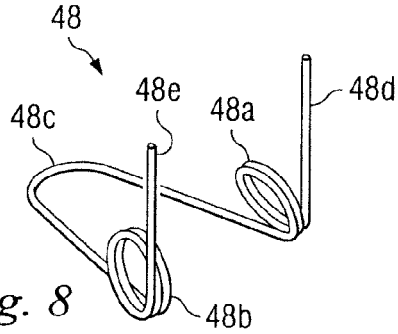
FIG. 8 is a perspective view of a torsion spring depicted in FIG. 3.

In an exemplary embodiment, as illustrated in FIG. 7, the actuator 46 includes a generally planar portion 46*a* having generally coplanar tabs 46*b* and 46*c* extending therefrom. A protrusion 46*d* extends downward from the portion 46*a* and defines a slanted surface 46*da*. A protrusion 46*e* also extends downward from the portion 46*a*.

In an exemplary embodiment, as illustrated in FIG. 7, the torsion spring 48 includes coil portions 48*a* and 48*b* and a U-shaped portion 48*c* extending therebetween. Legs 48*d* and 48*e* extend from the coil portions 48*a* and 48*b*, respectively.

Figure 9:
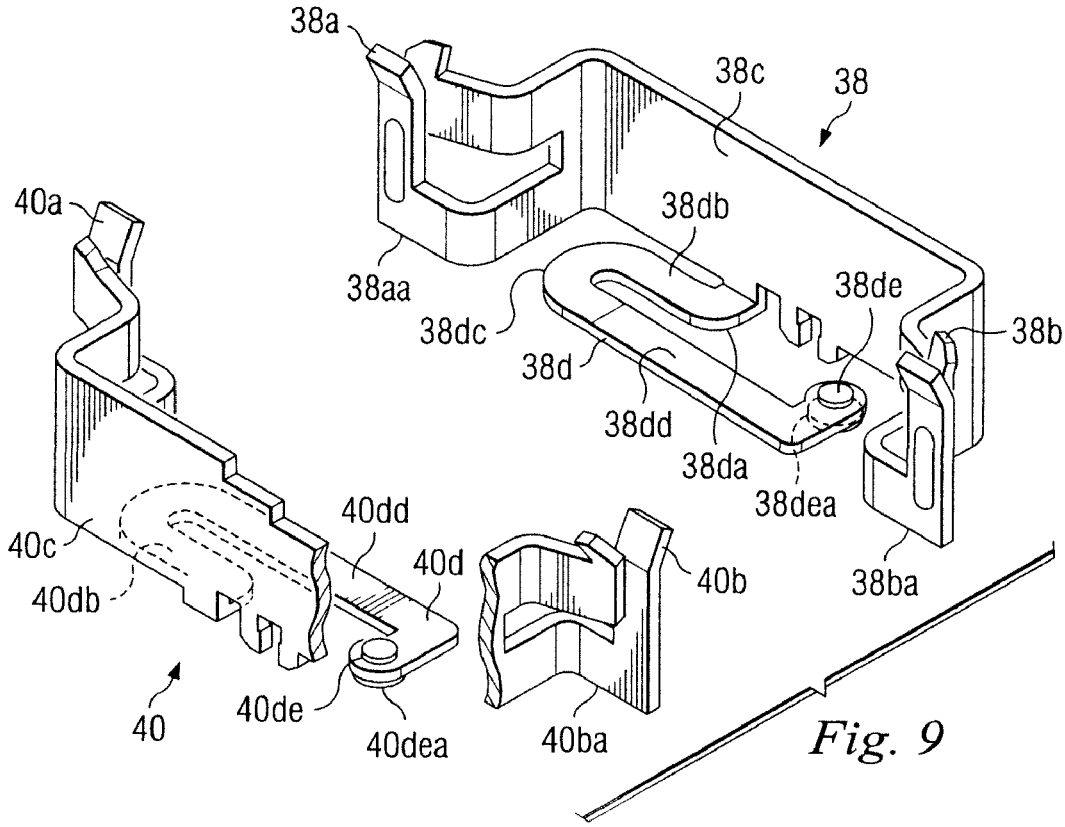
FIG. 9 is a perspective view of a set of receptacle contacts depicted in FIG. 3.
Figure 10:
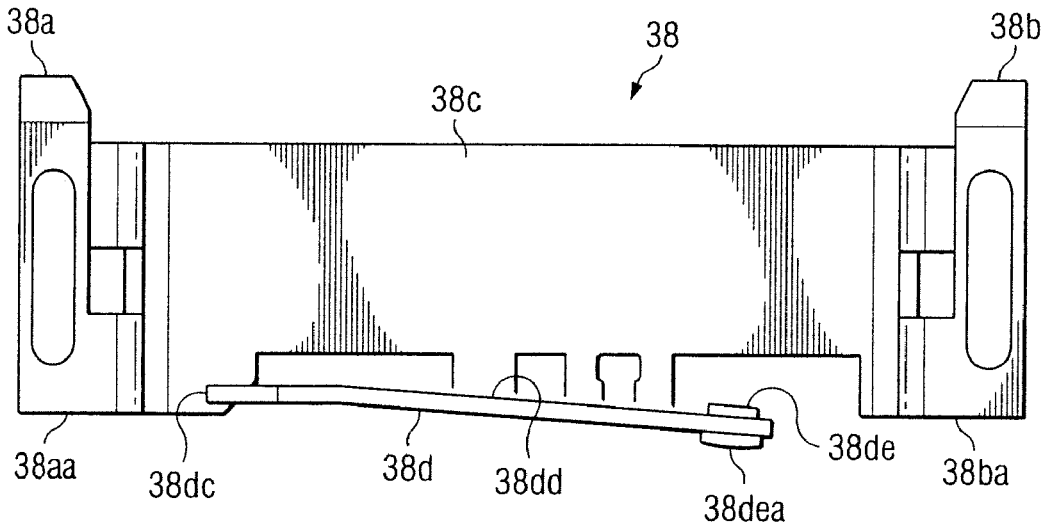
FIG. 10 is an elevational view of one of the receptacle contacts of FIG. 9.

In an exemplary embodiment, as illustrated in FIGS. 9 and 10, the receptacle contact 38 includes pairs of contacts 38*a* and 38*b* and a wall 38*c* extending therebetween. Each of the pairs of contacts 38*a* and 38*b* is a hot receptacle contact and is adapted to receive one prong of a two-prong or three-prong electrical plug. Substantially coplanar surfaces 38*aa* and 38*ba* are defined by the pairs of contacts 38*a* and 38*b*, respectively.

A cantilever arm 38*d*, which is adapted to move under conditions to be described, extends from the wall 38*c* and includes a 90-degree-turn portion 38*da*. A longitudinally-extending portion 38*db* extends from the turn portion 38*da* and towards the pair of contacts 38*a* in a direction that is generally parallel to the direction of extension of the wall 38*c*.

A U-shaped portion 38*dc* extends from the portion 38*db* and makes a 180-degree turn. The portions 38*da*, 38*db* and 38*dc* are substantially coplanar, and are either coplanar with, or slightly offset in a parallel relation from, the surfaces 38*aa* and 38*ba*, and are further substantially perpendicular to the wall 38*c*. A slanted, or angularly-extending, portion 38*dd* angularly extends from the U-shaped portion 38*dc* and towards the pair of contacts 38*b*. The longitudinally-extending portion 38*b* is generally parallel with the longitudinal directional component of the direction of extension of the slanted portion 38*dd* from the U-shaped portion 38*dc*. The majority of the longitudinal length of the arm 38*d* is generally defined by the length of the longitudinal directional component of the direction of extension of the slanted portion 38*dd* from the U-shaped portion 38*dc*. A contact 38*de* defining a contact surface 38*dea* is coupled to the distal end portion of the slanted portion 38*dd* so that the contact surface 38*dea* is offset from, and below, the surfaces 38*aa* and 38*ba*.

The receptacle contact 40 is the symmetric equivalent to the receptacle contact 38, about the center portion 36*e* of the middle housing 36, and therefore the receptacle contact 40 will not be described in detail. Reference numerals used to refer to features of the receptacle contact 40 will correspond to the reference numerals for the receptacle contact 38, except that the numeric prefix for the reference numerals used to describe the receptacle contact 38, that is, 38, will be replaced with the numeric prefix of the receptacle contact 40, that is, 40. Each of the pairs of contacts 40*a* and 40*b* is a neutral receptacle contact and is adapted to receive one prong of a two-prong or three-prong electrical plug.

Figure 11:
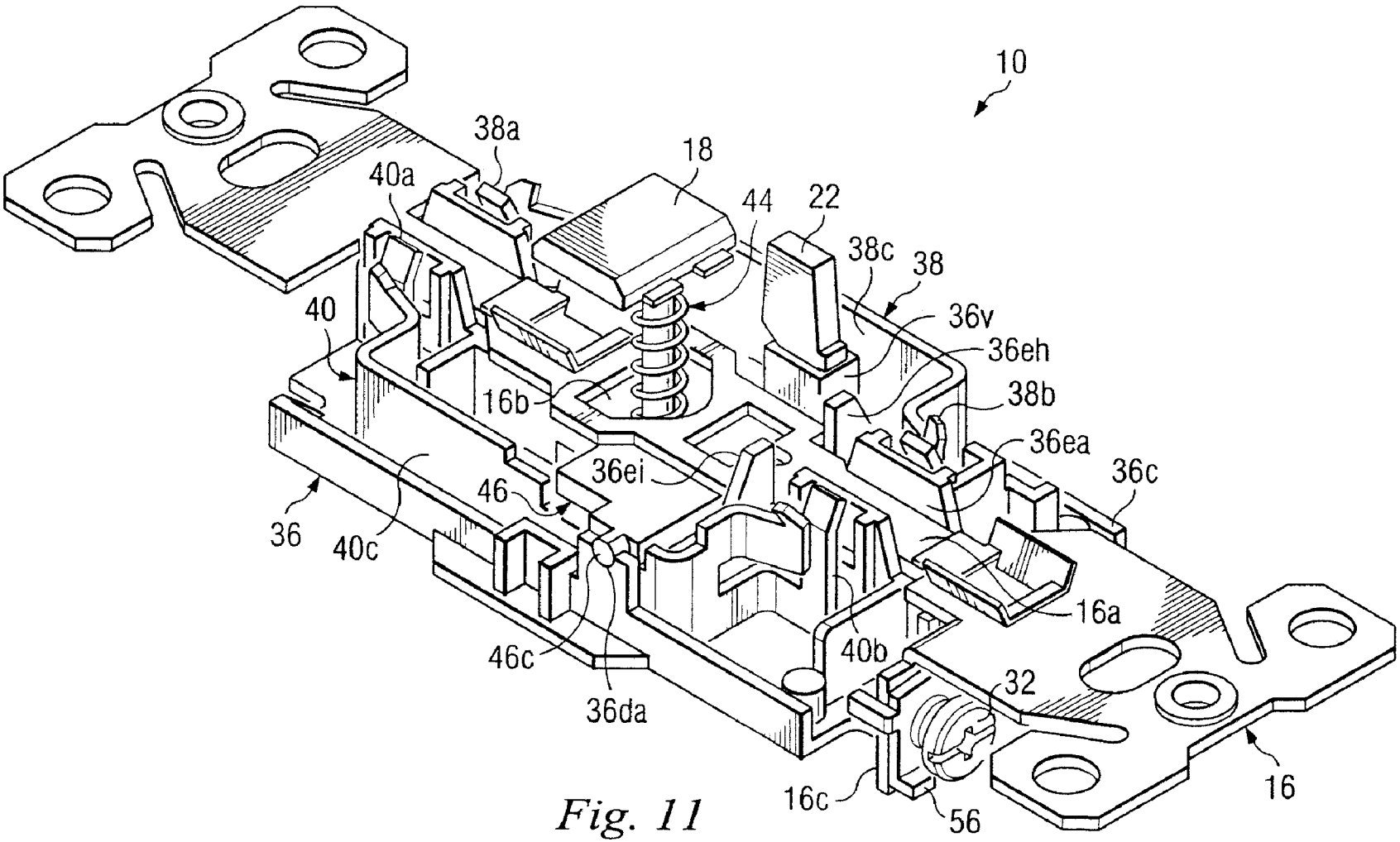
FIG. 11 is a perspective view of the mounting strap of FIG. 5, the middle housing of FIGS. 4A and 4B, the actuator of FIG. 7, and the receptacle contacts of FIG. 9 in an assembled condition.

In an exemplary embodiment, when the mounting strap 16, the middle housing 36, the spring 44, the actuator 46 and the receptacle contacts 38 and 40 are in an assembled condition as illustrated in FIG. 11, the receptacle contact 38 is received by the middle housing 36 so that the pair of contacts 38*a* is disposed in the region 36*h*, the wall 38*c* is disposed within the region 36*l* and extends between the wall 36*c* and the protrusion 36*v*, and the pair of contacts 38*b* is disposed in the region 36*i*. The surfaces 38*aa* and 38*ba* of the pairs of contacts 38*a* and 38*b*, respectively, are proximate or contact the tray portion 36*b*. Moreover, the slanted portion 38*dd* at least partially extends within the opening 36*n*, and the contact 38*d* at least partially extends within the opening 36*n*. As a result, the receptacle contact 38 is captured within the middle housing 36, at least with respect to movement of the receptacle contact 38 in a plane of motion that is parallel to the tray portion 36*b* of the middle housing 36.

Similarly, the receptacle contact 40 is received by the middle housing 36 so that the pair of contacts 40*a* is disposed in the region 36*j*, the wall 40*c* is disposed within the region 36*m*, and the pair of contacts 40*b* is disposed in the region 36*i*. The surfaces 40*aa* and 40*ba* of the pairs of contacts 40*a* and 40*b*, respectively, are proximate or contact the tray portion 40*a*. Moreover, the slanted portion 40*dd* at least partially extends within the opening 36*o*, and the contact 40*d* at least partially extends within the opening 36*o*. As a result, the receptacle contact 40 is captured within the middle housing 36, at least with respect to movement of the receptacle contact 40 in a plane of motion that is parallel to the tray portion 36*b* of the middle housing 36.

As a result of the above-described receipt of the receptacle contacts 38 and 40 by the middle housing 36, the receptacle contacts 38 and 40 are substantially electrically isolated from each other.

The spring 44 is received by the middle housing 36, extending within the counterbore 36*a* so that an end of the helical portion 44*a* contacts the internal shoulder 36 eq and the leg 44*b* extends through the channel 36*er* and into the region 36*m*. The light pipe 22 is received by the middle housing 36, extending within the passage 36*va* of the protrusion 36*v*. The stepped end portion 22*a* and the protrusion 22*b* of the light pipe 22 engage an end of the protrusion 36*v*.

As noted above, the actuator 46 is received by the middle housing 36. More particularly, the tab 46*b* of the actuator 46 extends within and is supported by the notch 36*ee* in the wall 36*eb* of the center portion 36*e* of the middle housing 36, and the tab 46*c* extends within and is supported by the notch 36*da* in the wall 36*d* of the middle housing 36. The protrusion 46*d* of the actuator 46 extends downward between the walls 36*eb* and 36*ec* of the middle housing 36, and between the opposing legs of the U-shaped portion 48*c* of the torsion spring 48. The protrusion 46*e* extends downward into the region 36*m*, and contacts the leg 44*b* of the spring 44, under conditions to be described.

The mounting strap 16 is received by the middle housing 36 so that the center portion 16*a* extends within the channel 36*ea* and is supported by the center portion 36*e* of the middle housing 36. The opening 16*b* in the mounting strap 16 is substantially aligned with the bore 36*a* that extends through the cylindrical protrusion 36*ed* of the center portion 36*e*. A portion of the planar portion 46*a* of the actuator 46 is positioned between the mounting strap 16 and the center portion 36*e* of the middle housing 36.

Figure 12:
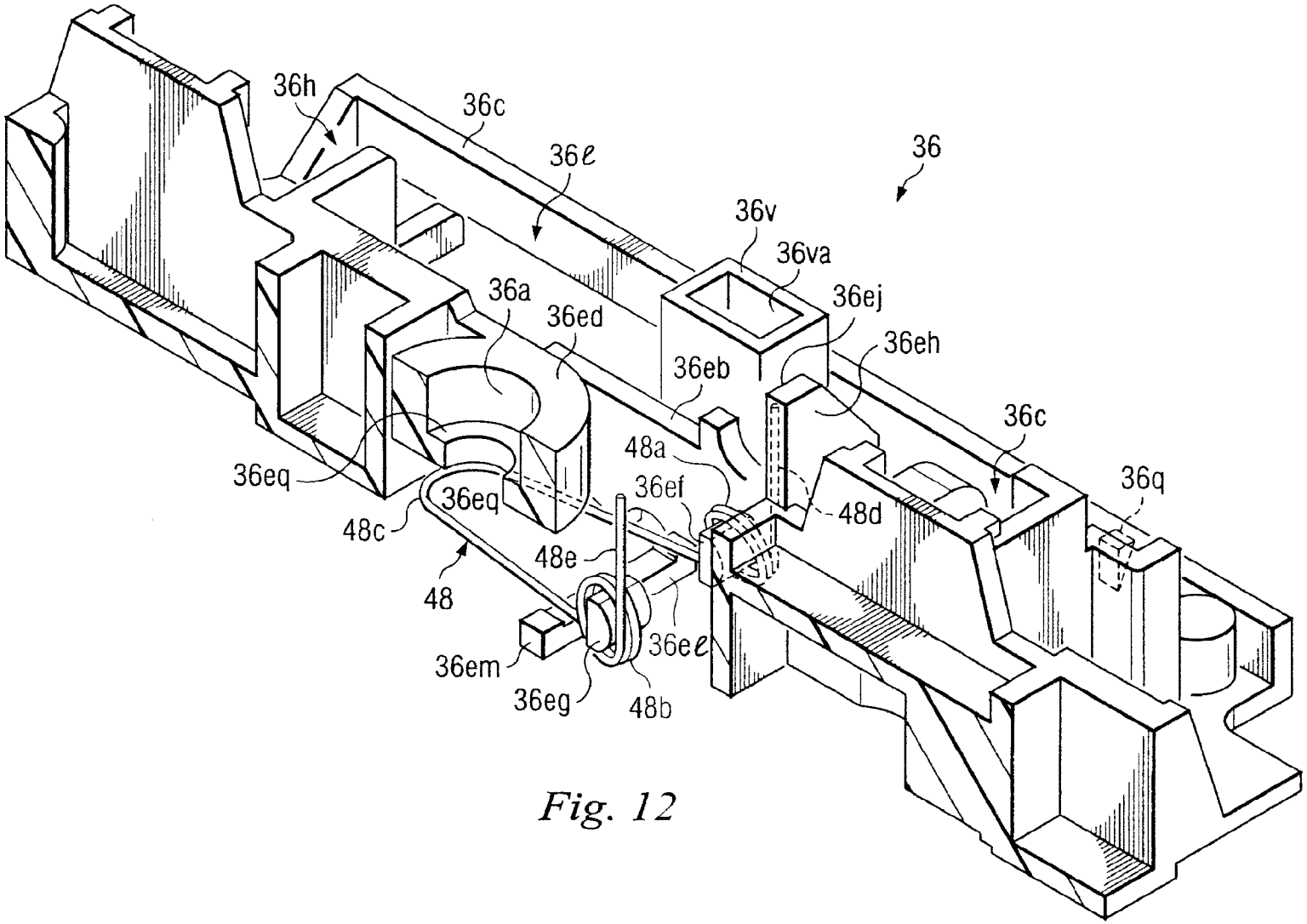
FIG. 12 is a partial perspective/partial sectional view of the middle housing of FIGS. 4A and 4B and the torsion spring of FIG. 8 in an assembled condition.

In an exemplary embodiment, as illustrated in FIG. 12 and as noted above, torsion spring 48 is coupled to the middle housing 36. More particularly, the torsion spring 48 is disposed between the walls 36*eb* and 36*ec* so that the protrusions 36*ef* and 36*eg* extend into the coil portions 48*a* and 48*b*, respectively, and so that the legs 48*d* and 48*e* contact the surfaces 36*ej* and 36*ek*, respectively. The U-shaped portion 48*c* extends downward between the walls 36*eb* and 36*ec* and the opposing legs of the U-shaped portion 48*c* contact the tabs 36*e*1 and 36*em*, respectively. As a result of the contact between the legs 48*d* and 48*e*, and the surfaces 36*ej* and 36*ek*, respectively, and between the U-shaped portion 48*c* and the tabs 36*e*1 and 36*em*, the torsion spring 48 applies reaction or biasing forces against the surfaces 36*ej* and 36*ek*, and the tabs 36*e*1 and 36*em*. Moreover, as a result of the extension of the protrusions 36*ef* and 36*eg* into the coil portions 48*a* and 38*b*, respectively, the opposing legs of the U-shaped portion 48*c* are compressed and the coil portions 48*a* and 48*b* apply biasing or reaction forces against the walls 36*eb* and 36*ec*, respectively. As a result of the above-described biasing or reaction forces applied by the torsion spring 48, the torsion spring 48 is coupled to the middle housing 36.

Figure 13A:
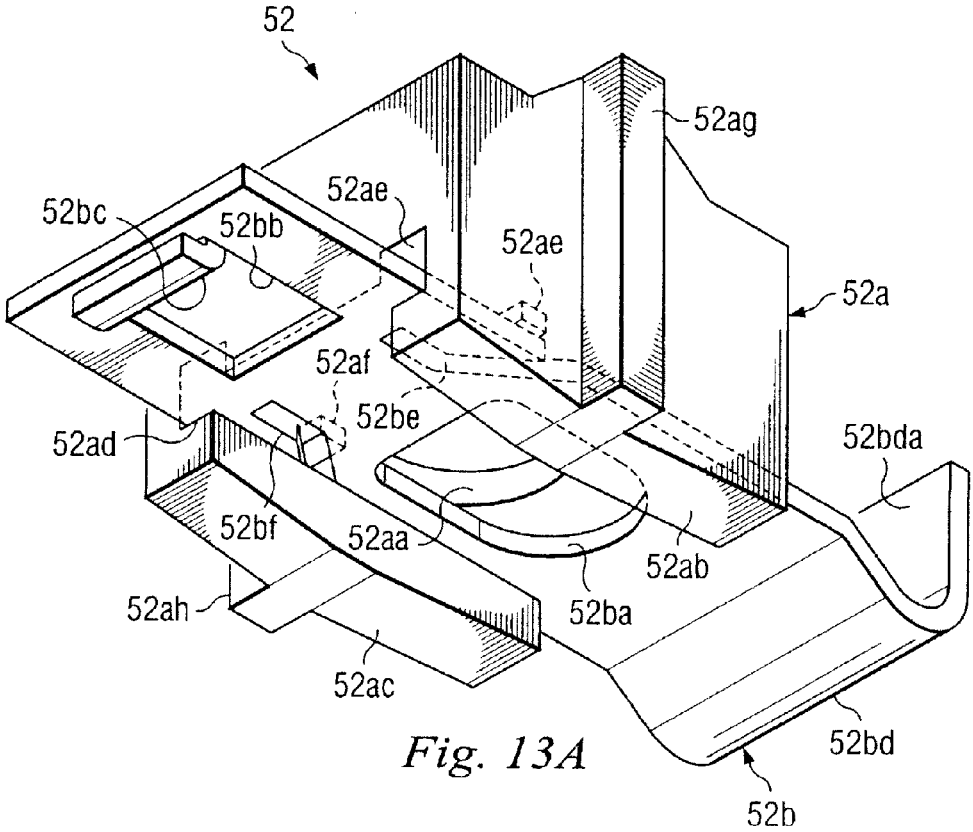
FIG. 13A is a perspective view of a latch assembly depicted in FIG. 3.
Figure 13B:
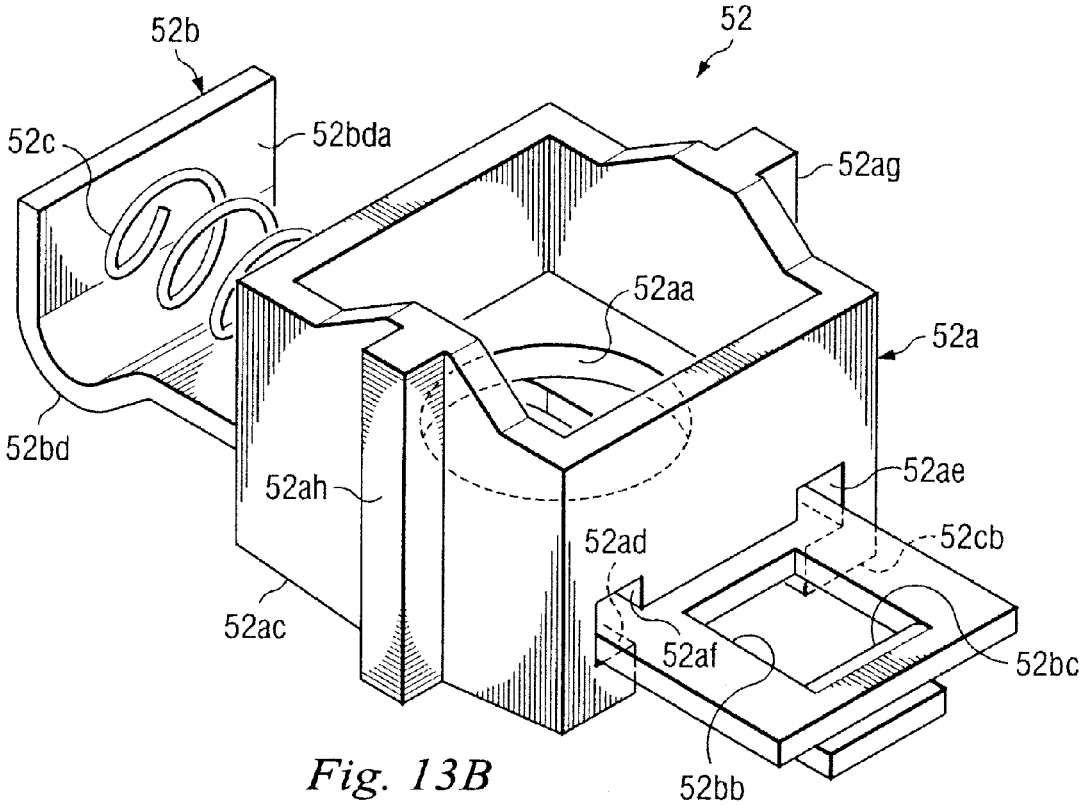
FIG. 13B is another perspective view of the latch assembly of FIG. 13A.

In an exemplary embodiment, as illustrated in FIGS. 13A and 13B, the latch assembly 52 includes a latch block 52*a* having an opening 52*ac* formed therethrough, and opposing generally L-shaped tabs 52*ab* and 52*ac* extending therefrom. A channel 52*ad* is defined by the tabs 52*ab* and 52*ac*. Parallel-spaced channels 52*ae* and 52*af* are formed in the latch block 52*a* and are adjacent the channel 52*ad*. The latch block 52*a* further includes opposing, vertically-extending protrusions 52*ag* and 52*ah*.

A generally planar latch 52*b* is coupled to the latch block 52*a*, extending through the channel 52*ad*, and includes a center opening 52*ba* formed therethrough, an opening 52*bb* formed therethrough, a curved surface 52*bc* partially defining the opening 52*bb*, and a curved distal end portion 52*bd* defining a surface 52*bda*. The latch 52*b* further includes parallel-spaced protrusions 52*be* and 52*bf*, which extend within the channels 52*ae* and 52*af*, respectively, of the latch block 52*a*.

A spring 52*c* is coupled to, and disposed between, the surface 52*af* of the latch block 52*a* and the surface 52*bda* of the latch 52*b*. Due to the compression of the spring 52*c*, the spring 52*c* applies biasing or reaction forces against the latch block 52*a* and the surface 52*bda*, causing the protrusions 52*be* and 52*bf* of the latch 52*b* to engage respective surfaces of the latch block 52*a* defined by the channels 52*ae* and 52*af*, respectively. As a result, the latch 52*b* is coupled to the latch block 52*a*. The latch 52*b* is adapted to slide within the channel 52*ad*, relative to the latch block 52*a*, under conditions to be described.

Figure 14:
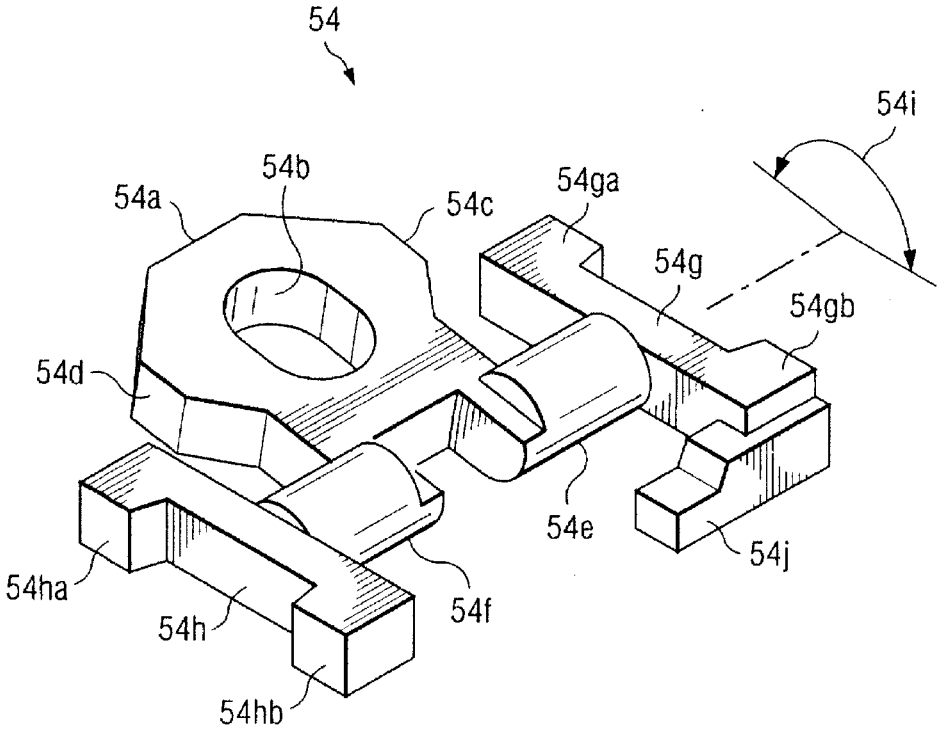
FIG. 14 is a perspective view of a cam depicted in FIG. 3.

In an exemplary embodiment, as illustrated in FIG. 14, the cam 54 includes a center portion 54*a* having an opening 54*b* formed therethrough and opposing knobs 54*c* and 54*d*. Opposing pins 54*e* and 54*f* extend from the center portion 54*a*, and parallel-spaced legs 54*g* and 54*h* are coupled to the pins 54*e* and 54*f*, respectively. The respective longitudinal center axes of the pins 54*e* and 54*f* are axially aligned. The leg 54*g* includes opposing end knobs 54*ga* and 54*gb*, and the leg 54*h* includes opposing end knobs 54*ha* and 54*hb*. An angle 54*i* is defined between the legs 54*g* and 54*h* and the center portion 54*a*. A stepped protrusion 54*j* extends from the end knob 54*gb* of the leg 54*g*.

Figure 15A:
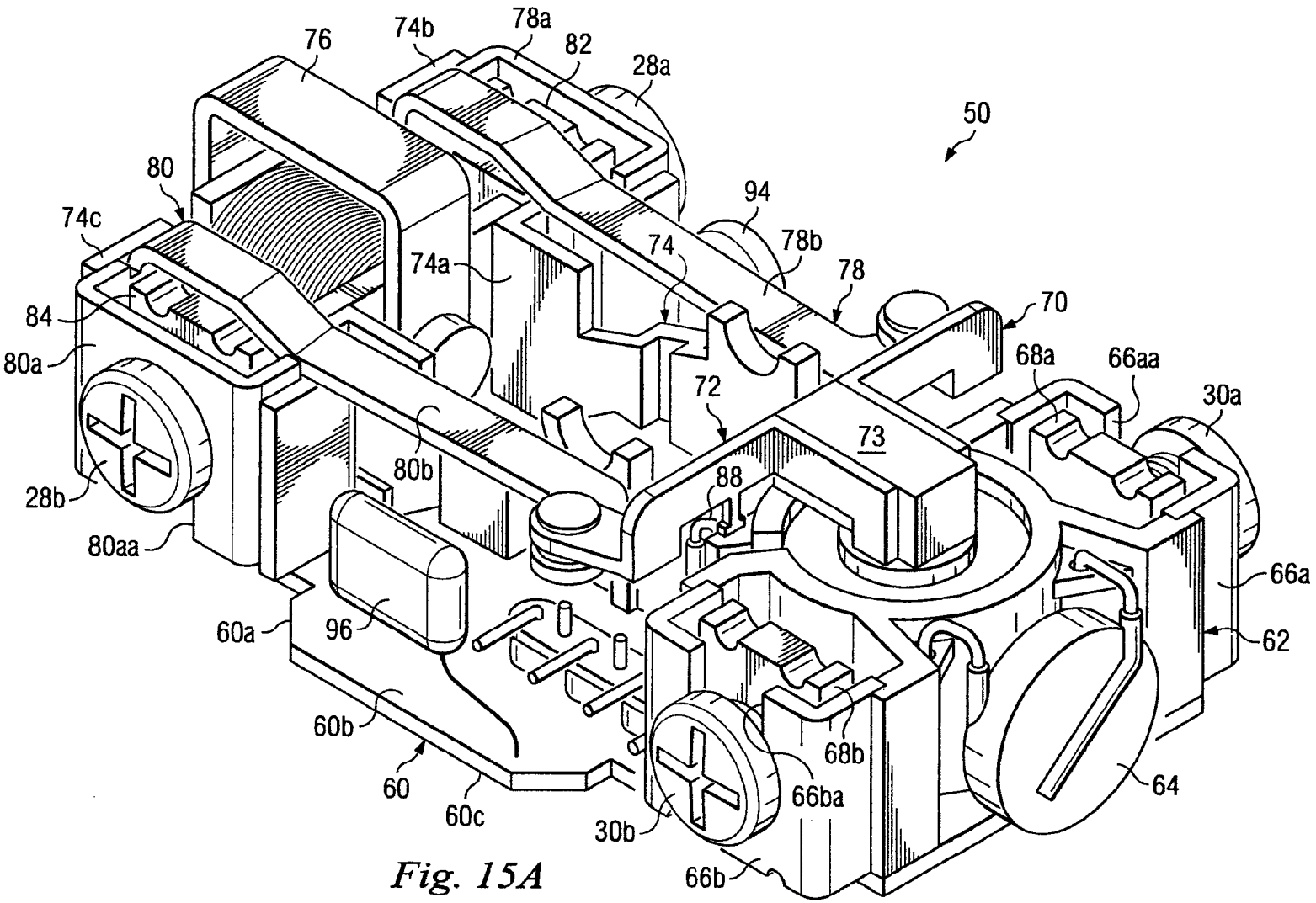
FIG. 15A is a perspective view a PCB assembly depicted in FIG. 3.
Figure 15B:
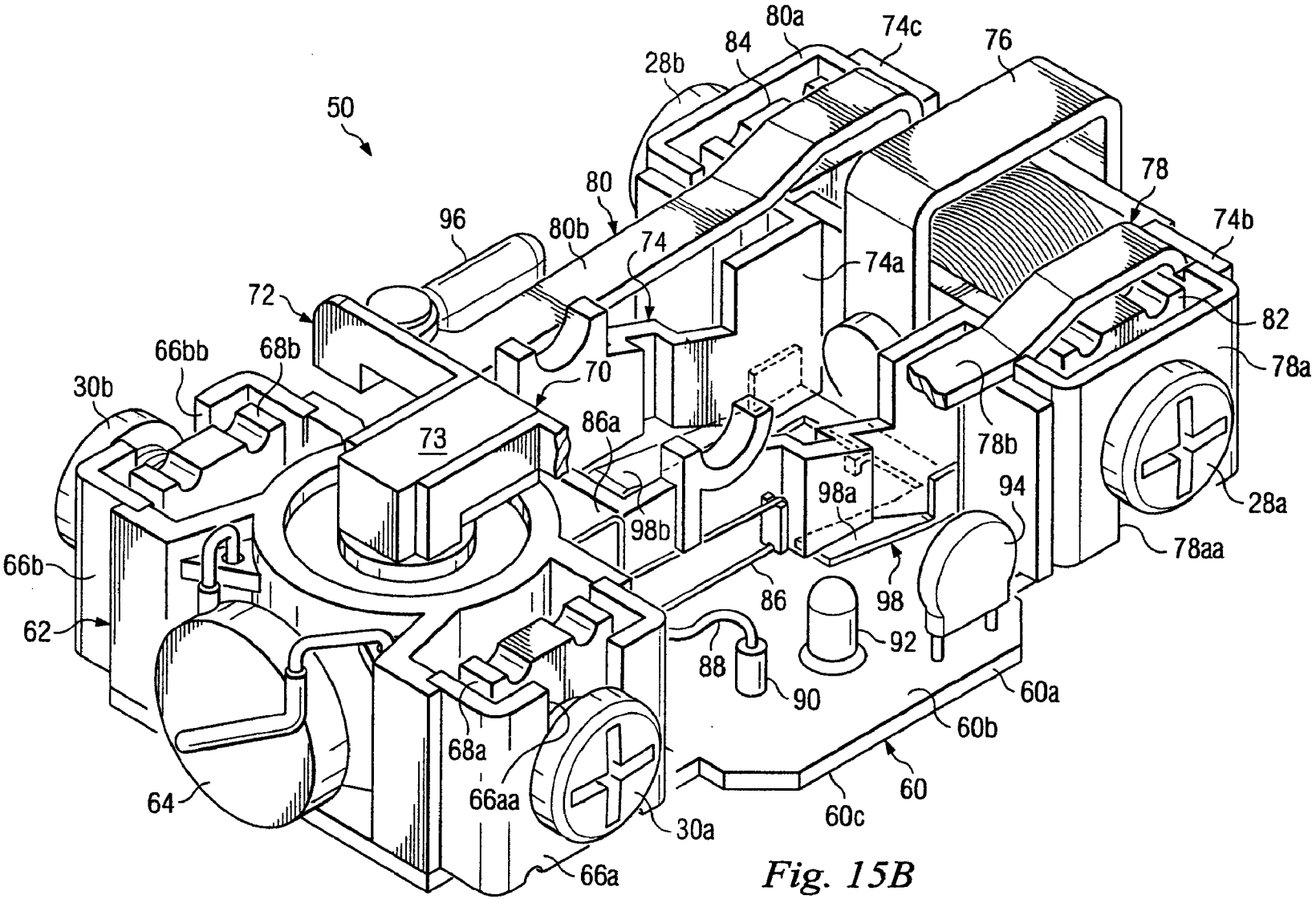
FIG. 15B is another perspective view of the PCB assembly of FIG. 15A.

In an exemplary embodiment, as illustrated in FIGS. 15A and 15B, the PCB assembly 50 includes a printed circuit board 60 defining a perimeter 60*a* and surfaces 60*b* and 60*c* spaced in a parallel relation, and to which a transformer assembly 62 is coupled and is adjacent the surface 60*b*. A capacitor 64 engages the transformer assembly 62 and is coupled to the circuit board 60. Input line terminals 66*a* and 66*b* defining notches 66*aa* and 66*ba*, respectively, are coupled to the circuit board 60. The screws 30*a* and 30*b* extend through the notches 66*aa* and 66*ba*, respectively, and are captively threadably engaged with terminal plates 68*a* and 68*b*, respectively, which are disposed between the transformer assembly 62 and the input line terminals 66*a* and 66*b*, respectively.

Stationary contacts 70 and 72 are coupled to the circuit board 60 and engage the transformer assembly 62. An upside-down-L-shaped isolating member 73 is disposed between the stationary contacts 70 and 72 and engages the transformer assembly 62. A frame 74 is coupled to the circuit board 60 and includes a center portion 74*a* and opposing wing portions 74*b* and 74*c* extending from the center portion 74*a*. A solenoid assembly 76 is coupled to the circuit board 60 and is at least partially disposed between the wing portions 74*b* and 74*c* of the frame 74. A load-terminal portion 78*a* of a movable contact 78 is received by the wing portion 74*b* and defines a notch 78*aa*, through which the screw 28*a* extends. An arm 78*b* of the movable contact 78 extends from the load-terminal portion 78*a* and towards the stationary contact 70, and is adapted to engage the stationary contact 70 under conditions to be described. A load-terminal portion 80*a* of a movable contact 80 is received by the wing portion 74*c* and defines a notch 80*aa*, through which the screw 28*b* extends. An arm 80*b* of the movable contact 80 extends from the load-terminal portion 80*a* and towards the stationary contact 72, and is adapted to engage the stationary contact 72 under conditions to be described. The screws 28*a* and 28*b* are captively threadably engaged with terminal plates 82 and 84, respectively, which are received by the wing portions 74*b* and 74*c*, respectively.

Figure 16:
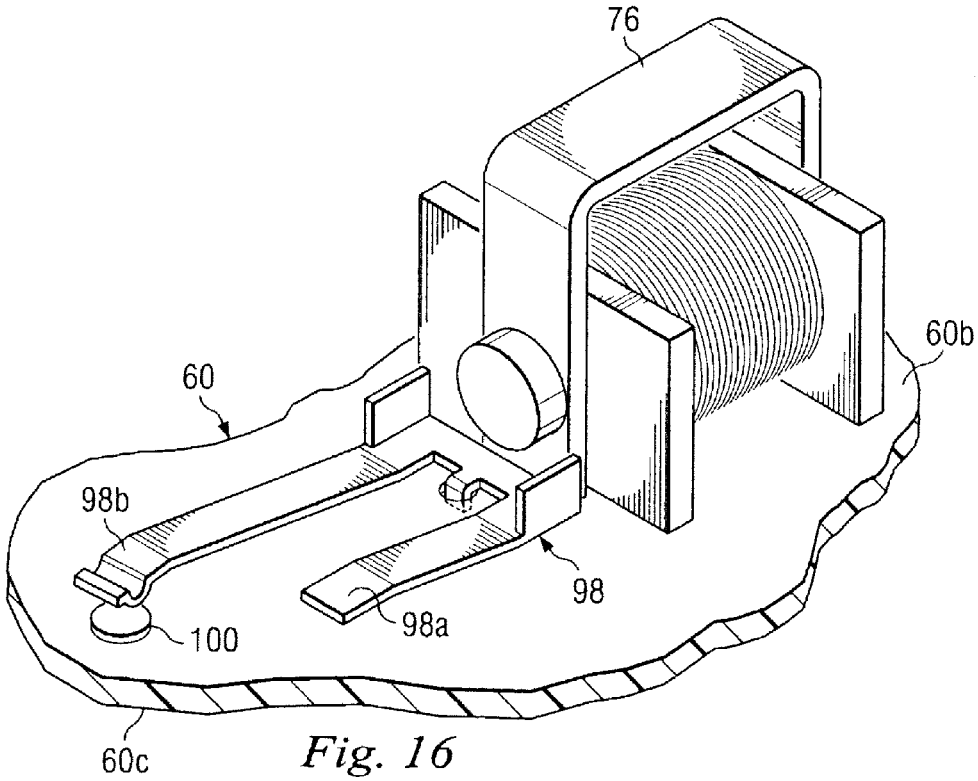
FIG. 16 is a perspective view of a spring bracket, which is part of the PCB assembly of FIGS. 15A and 15B.

In an exemplary embodiment, as illustrated in FIG. 16, a wire spring 86 is coupled to the center portion 74*a* of the frame 74 and is further coupled to the circuit board 60. A distal end portion 86*a* of the spring 86 is adapted to engage, and be electrically coupled to, the stationary contact 70 under conditions to be described; thus, a switch is formed by the spring 86 and the stationary contact 70. A cable 88 is electrically coupled to, and extends between, the stationary contact 72 and a diode 90, which, in turn, is coupled to the circuit board 60. A light source such as, for example, a light-emitting-diode (LED) 92, is coupled to the circuit board 60 and is at least proximate the surface 60*b*. A capacitor 94 is coupled to the circuit board 60 in the vicinity of the LED 92. A capacitor 96 is also coupled to the circuit board 60. Although not shown in FIGS. 15-17, a variety of other electronic devices and components are coupled to the surface 60*c* of the circuit board 60.

A spring bracket 98 is coupled to the circuit board 60, and is at least partially disposed between the solenoid assembly 76 and the surface 60*b* of the circuit board 60. An angularly-extending spring arm 98*a* of the spring bracket 98 extends generally upward from the surface 60*b* of the circuit board 60, and generally from the solenoid assembly 76 and towards the transformer assembly 62. An angularly-extending spring arm 98*b* of the spring bracket 98 also extends generally upward from the surface 60*b* of the circuit board 60, and generally from the solenoid assembly 76 and towards the transformer assembly 62. The spring arms 98*a* and 98*b* are spaced in a generally parallel relation and have substantially similar angles of extension, relative to the circuit board 60. A contact 100 is coupled to the circuit board 60, is disposed in the vicinity of the distal end of the spring arm 98*b*, and is adapted to engage the spring arm 98*b* under conditions to be described.

Figure 17:
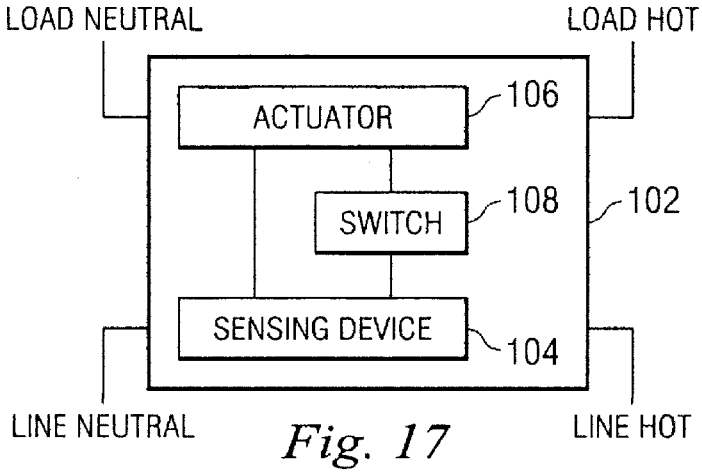
FIG. 17 is a simplified diagrammatic view of an exemplary embodiment of a ground fault circuit interrupter circuit.

In an exemplary embodiment, as illustrated in FIG. 17 with continuing reference to FIGS. 15A, 15B and 16, the PCB assembly 50 includes a GFCI circuit 102, which, in turn, includes a sensing device 104. An actuator 106 is electrically coupled to the sensing device 104, and a switch 108 is electrically coupled to the actuator 106 and the sensing device 104. The GFCI circuit 102 is adapted to be electrically coupled to Line Hot and Line Neutral wiring, and to Load Hot and Load Neutral wiring.

Figure 18:
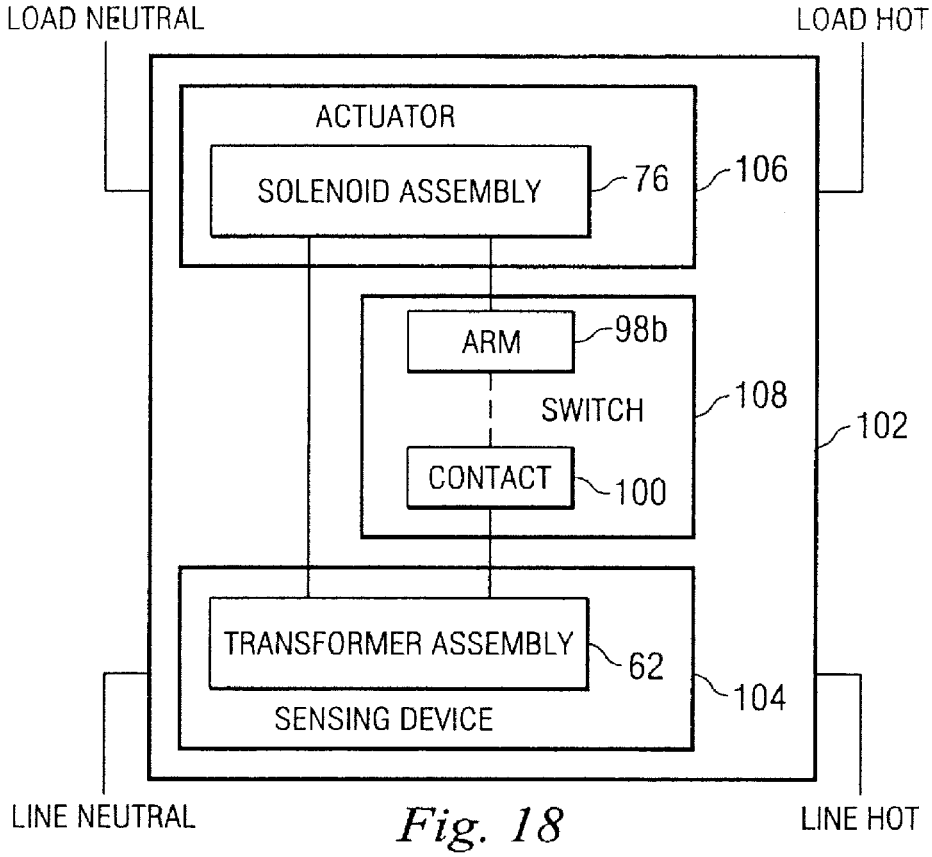
FIG. 18 is a simplified diagrammatic view of another exemplary embodiment of a ground fault circuit interrupter circuit.

In an exemplary embodiment, as illustrated in FIG. 18, the GFCI circuit 102 includes several of the above-described parts of the PCB assembly 50. More particularly, the sensing device 104 comprises the transformer assembly 62, the actuator 106 comprises the solenoid assembly 76, and the switch 108 comprises the arm 98*b* and the contact 100. As a result, in the GFCI circuit 102, the transformer assembly 62 is electrically coupled to the solenoid assembly 76, the arm 98*b* is electrically coupled to the solenoid assembly 76 and the contact 100 is electrically coupled to the transformer assembly 62.

The GFCI circuit 102 further includes the input line terminals 66*a* and 66*b*, the stationary contacts 70 and 72, the movable contacts 78 and 80 including the load-terminal portions 78*a* and 80*a*, respectively, the spring 86, the cable 88, the diode 90, the LED 92 and the capacitors 64, 94 and 96. The remainder of the GFCI circuit 102 includes conventional GFCI circuitry, devices and/or components, and therefore the remainder of the GFCI circuit 102 will not be described in detail. In several exemplary embodiments, the conventional GFCI circuitry, devices and/or components are coupled to the circuit board 60, including being mounted on the surfaces 60*b* and/or 60*c* of the circuit board 60, and/or within the circuit board 60.

In the GFCI circuit 102, the input terminals 66*a* and 66*b* are electrically coupled to the stationary contacts 70 and 72, respectively, which, in turn, are operably coupled to the transformer assembly 62. Moreover, the stationary contacts 70 and 72 are adapted to be electrically coupled to the movable contacts 78 and 80, respectively, under conditions to be described. The spring 86 is adapted to be electrically coupled to the stationary contact 70 under conditions to be described. The diode 90 is electrically coupled to the LED 92.

Figure 19:
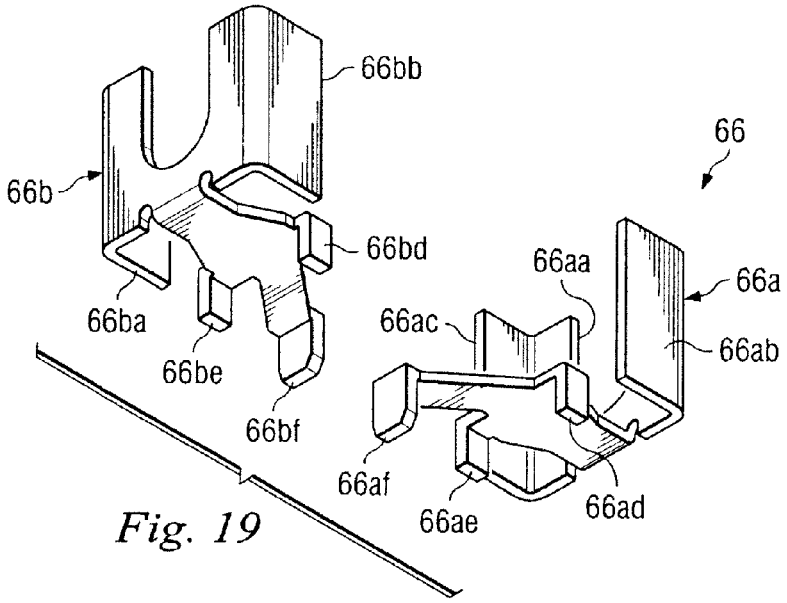
FIG. 19 is a perspective view of a pair of input line terminals depicted in FIGS. 15A and 15B.

In an exemplary embodiment, as illustrated in FIG. 19, the input line terminal 66*a* further includes parallel-spaced walls 66*ab* and 66*ac* and tabs 66*ad*, 66*ae* and 66*af*. The input line terminal 66*b* further includes parallel-spaced walls 66*bb* and 66*bc* and tabs 66*bd*, 66*be* and 66*bf*. The input line terminals 66*a* and 66*b* are symmetric equivalents of each, about an imaginary plane that is generally perpendicular to the walls 66*ab*, 66*ac*, 66*bb* and 66*bc* and that is disposed midway between the input line terminals 66*a* and 66*b*.

Figure 20:
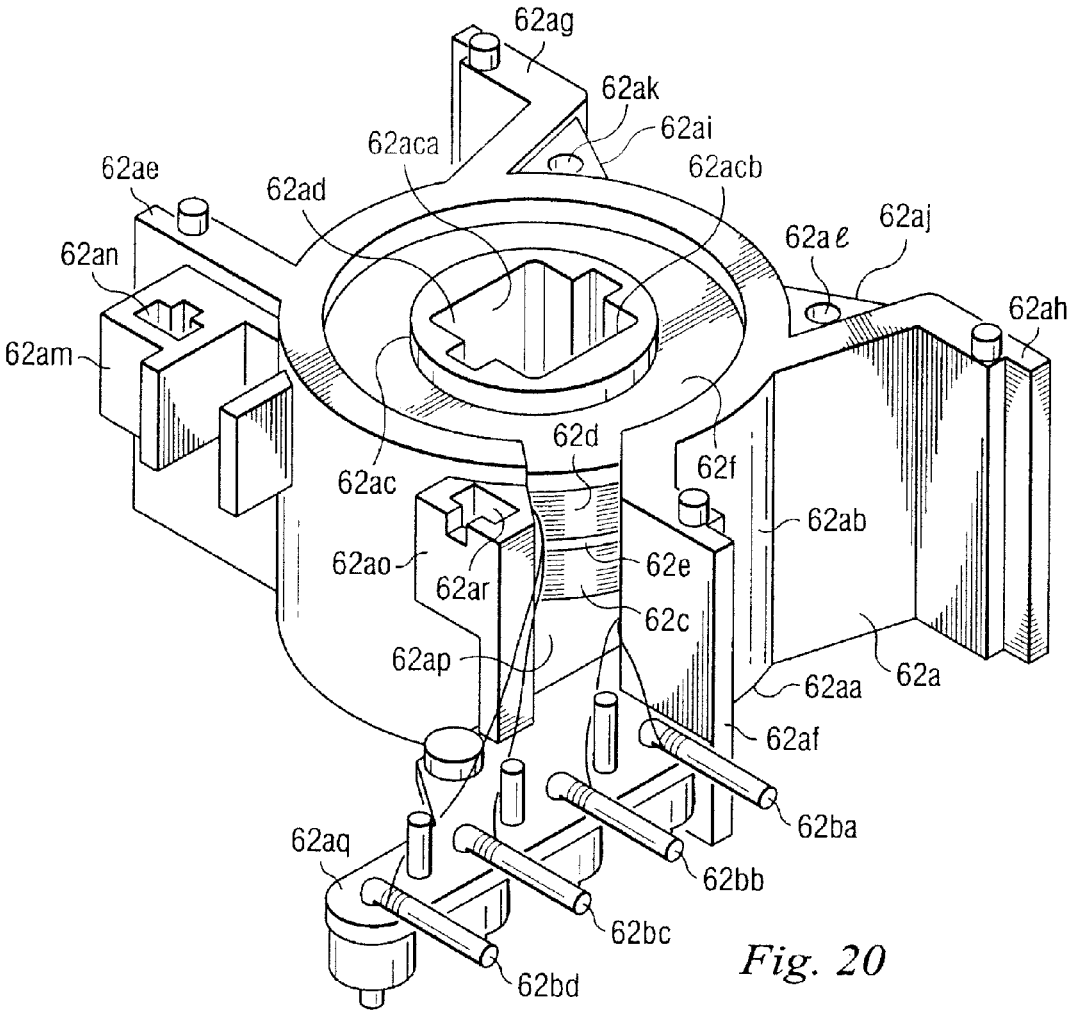
FIG. 20 is a perspective view of a transformer assembly depicted in FIGS. 15A and 15B.

In an exemplary embodiment, as illustrated in FIG. 20, the transformer assembly 62 includes a boat 62*a* including a disk-shaped base 62*aa* having a partially circumferentially-extending wall 62*ab* extending upward therefrom. A cylindrical protrusion 62*ac* extends upward from the base 62*aa* and is surrounded by the wall 62*ab*. A through-opening 62*ad* extends through the cylindrical protrusion 62*ac* and the base 62*aa*, defining parallel-spaced inside surfaces 62*aca* and 62*acb* of the cylindrical protrusion 62*ac*. Opposing support arms 62*ae* and 62*af*, and opposing support arms 62*ag* and 62*ah*, extend outwardly from the wall 62*ab*. Gussets 62*ai* and 62*aj* extend between the outside surface of the wall 62*ab* and the support arms 62*ag* and 62*ah*, respectively, and bores 62*ak* and 62*a*1 are formed through the gussets 62*ai* and 62*aj*, respectively.

A protrusion 62 am extends from the arm 62*ae* and the wall 62*ab*, and an opening 62*an* is formed in the protrusion 62*am*. A protrusion 62*ao* extends from the outside surface of the wall 62*ab*, and a partially circumferentially-extending gap 62*ap* is defined between the protrusion 62*ao* and the support arm 62*af*. A platform 62*aq* extends from the protrusion 62*ao* and the support arm 62*af*, and across the gap 62*ap*. An opening 62*ar* is formed in the protrusion 62*ao*. Contact pins 62*ba*, 62*bb*, 62*bc* and 62*bd* are coupled to the platform 62*aq* of the boat 62*a*.

A transformer coil 62*c* is received by the boat 62*a*, circumferentially extending about the cylindrical protrusion 62*ac* and radially extending between the cylindrical protrusion 62*ac* and the inside surface of the wall 62*ab*. The transformer coil 62*c* is electrically coupled to the pins 62*ba* and 62*bb*, which are a part of the circuit 102. Similarly, a transformer coil 62*d* is received by the boat 62*a* and disposed above the transformer coil 62*c*, circumferentially extending about the cylindrical protrusion 62*ac* and radially extending between the cylindrical protrusion 62*ac* and the inside surface of the wall 62*ab*. The transformer coil 62*d* is electrically coupled to the pins 62*bc* and 62*bd*, which are a part of the circuit 102. An insulating washer 62*e* is disposed between the transformer coils 62*c* and 62*d*, and an insulating washer 62*f* is disposed on top of the transformer coil 62*d*.

Figure 21:
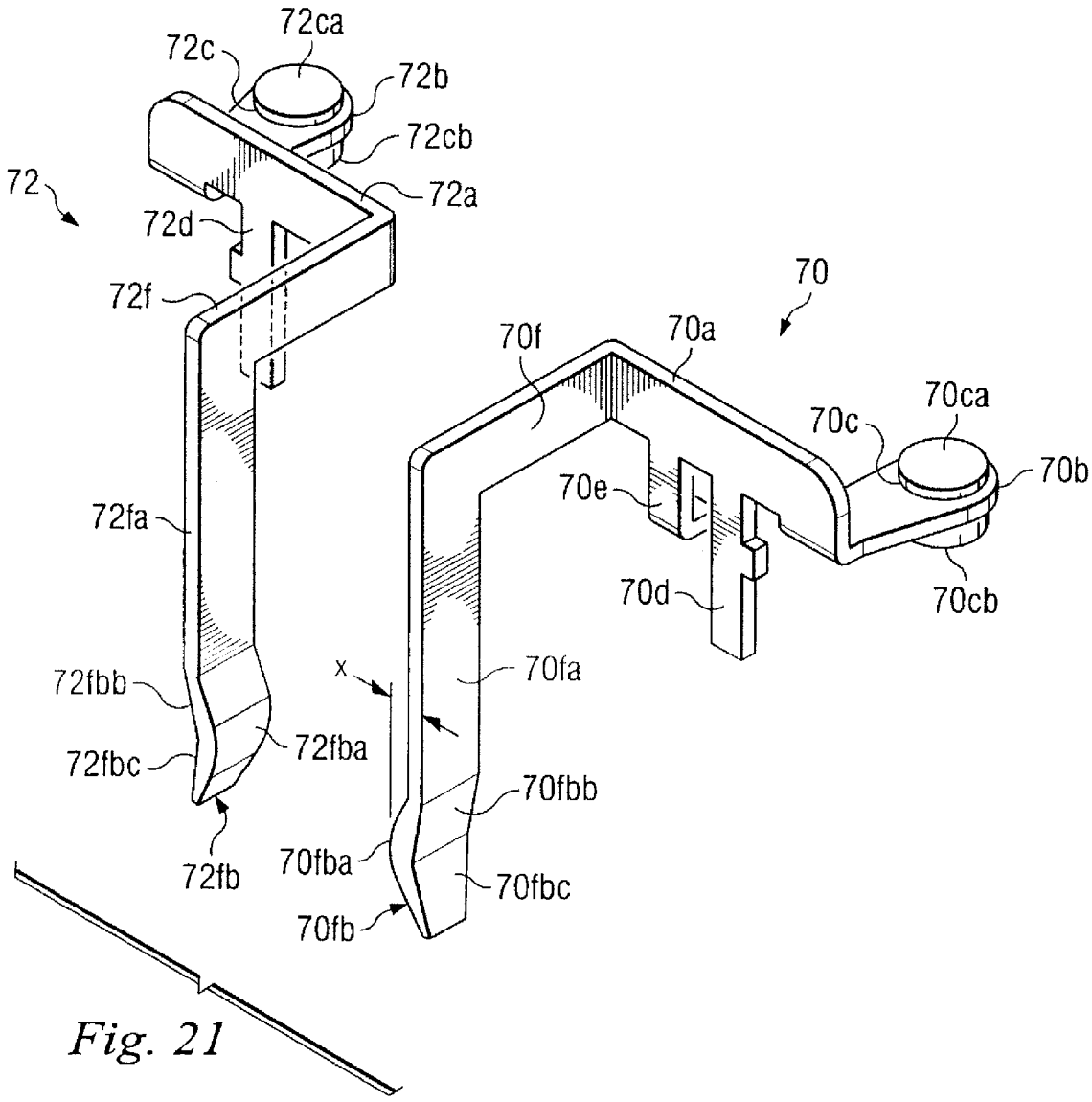
FIG. 21 is a perspective view of a pair of stationary contacts depicted in FIGS. 15A and 15B.

In an exemplary embodiment, as illustrated in FIG. 21, the stationary contact 70 includes a horizontally-extending portion 70*a* and a tab 70*b* extending from an end of the portion 70*a*. A contact 70*c* defining contact surfaces 70*ca* and 70*cb* is coupled to the distal end of the tab 70*b*. A protrusion 70*d* extends downward from the portion 70*a*, and an L-shaped tab 70*e* also extends downward from the portion 70*a*. An upside-down L-shaped contact arm 70*f* extends from the portion 70*a* and includes a vertically-extending portion 70*fa*. A kinked portion 70*fb* extends from the portion 70*fa*, and includes a generally curved portion 70*fba* and angularly-extending portions 70*fbb* and 70*fbc*, which meet at a vertex location that generally corresponds to the middle of the curve of the curved portion 70*fba*. At least a portion of the curved portion 70*fba* is offset from the vertically-extending portion 70*fa* by a distance x. The curved portion 70*fba* and the angularly-extending portion 70*fbc* taper towards each other, generally forming a stab at the distal end of the contact arm 70*f*.

In several exemplary embodiments, instead of, or in addition to the portions 70*fba*, 70*fbb* and 70*fbc*, the kinked portion 70*fb* of the contact arm 70 may include one or more other portions having a wide variety of shapes and sizes, with at least a portion of at least one of the one or more portions being offset from at least a portion of the vertically-extending portion 70*fa*, in the offset direction of the curved portion 70*fba*, and/or in a direction opposing the offset direction of the curved portion 70*fba*. In an exemplary embodiment, in addition to, or instead of the curved portion 70*fba*, the kinked portion 70*fb* may include, for example, a pair of angularly-extending portions that form a peak, one or more twisted and/or cork-screw portions, one or more dimples, one or more bulges, and/or any combination thereof.

The stationary contact 72 is the symmetric equivalent to the stationary contact 70, about an imaginary plane that is parallel to the contact arm 70*f* and disposed midway between the stationary contacts 70 and 72, and therefore the stationary contact 72 will not be described in detail, except that the stationary contact 72 does not include a feature equivalent to the tab 70*e* of the stationary contact 70. Reference numerals used to refer to features of the stationary contact 72 will correspond to the reference numerals for the stationary contact 70, except that the numeric prefix for the reference numerals used to describe the stationary contact 70, that is, 70, will be replaced with the numeric prefix of the stationary contact 72, that is, 72.

In several exemplary embodiments, instead of, or in addition to the portions 72*fba*, 72*fbb* and 72*fbc*, the kinked portion 72*fb* of the contact arm 72 may include one or more other portions having a wide variety of shapes and sizes, with at least a portion of at least one of the one or more portions being offset from at least a portion of the vertically-extending portion 72*fa*, in the offset direction of the curved portion 72*fba*, and/or in a direction opposing the offset direction of the curved portion 72*fba*. In an exemplary embodiment, in addition to, or instead of the curved portion 72*fba*, the kinked portion 72*fb* may include, for example, a pair of angularly-extending portions that form a peak, one or more twisted and/or cork-screw portions, one or more dimples, one or more bulges, and/or any combination thereof.

Figure 22:
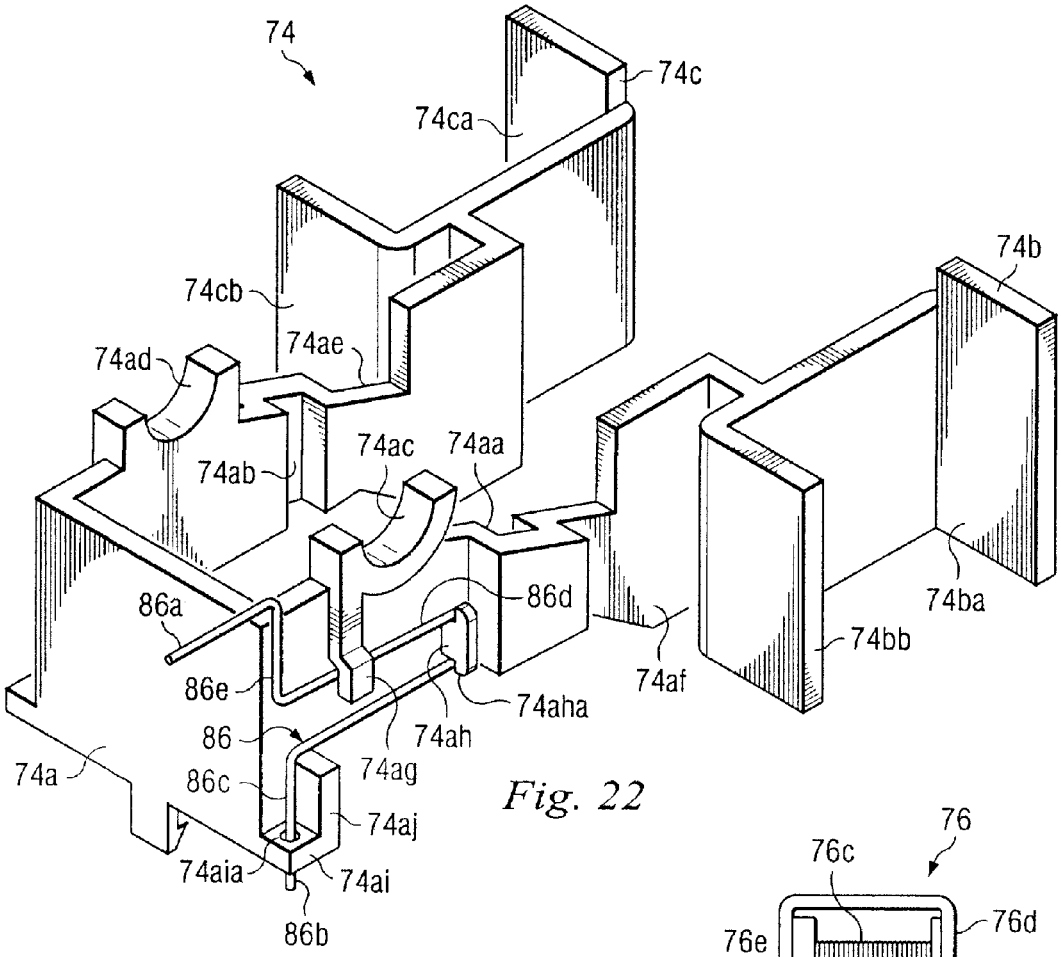
FIG. 22 is a perspective view of a frame depicted in FIGS. 15A and 15B.

In an exemplary embodiment, as illustrated in FIG. 22, the center portion 74*a* of the frame 74 defines spaced channels 74*aa* and 74*ab*, and includes generally coaxial notches 74*ac* and 74*ad*. The center portion 74*a* further includes parallel-spaced walls 74*ae* and 74*af*. A hook-shaped protrusion 74*ag*, a tab 74*ah* having an enlarged end portion 74*aha*, and a tab 74*ai* extend from the wall 74*af*. A bore 74*aia* extends through the tab 74*ai*. A tab 74*aj* extends upward from the tab 74*ai* and along the wall 74*af*. The wing portion 74*b* includes parallel-spaced walls 74*ba* and 74*bb*, and the wing portion 74*c* includes parallel-spaced walls 74*ca* and 74*cb*. The frame 74 is coupled to the circuit board 60 in a conventional manner such as, for example, by using one more conventional snap-fit protrusions extending from the center portion 74*a*, the wing portion 74*b* and/or the wing portion 74*c*.

As noted above, the spring 86 is coupled to the center portion 74*a* of the frame 74 and is further coupled to the circuit board 60. More particularly, an end portion 86*b* of the spring 86 is soldered to the circuit board 60, which is not shown in FIG. 22, and a vertically-extending portion 86*c* of the spring 86 extends upward through the bore 74*aia* and along the tab 74*aj*. A generally backwards C-shaped portion 86*d* of the spring 86 extends around the protrusion 74*ah* and between the hook-shaped protrusion 74*ag* and the wall 74*af* of the frame 74. An upside-down L-shaped portion 86*e*, which includes the distal end portion 86*a*, extends upwardly and then towards the stationary contact 70. Under conditions to be described, the distal end portion 86*a* of the spring 86 is adapted to contact, and be electrically coupled to, the tab 70*e* of the stationary contact 70, thus closing the switch formed by the spring 86 and the stationary contact 70. The hook-shaped protrusion 74*ag* and the enlarged end portion 74*aha* of the protrusion 74*ah* trap the spring 86 against the wall 74*af*. Moreover, the tab 74*aj* and the hook-shaped protrusion 74*ag* urge the opposing legs of the backwards C-shaped portion 86*d* towards each other, thereby causing the opposing legs of the backwards C-shaped portion 86*d* to apply biasing or reaction forces against the tab 74*aj* and the hook-shaped protrusion 74*ag*, respectively. As a result, the spring 86 is further trapped against the wall 74*af*.

Figure 23:
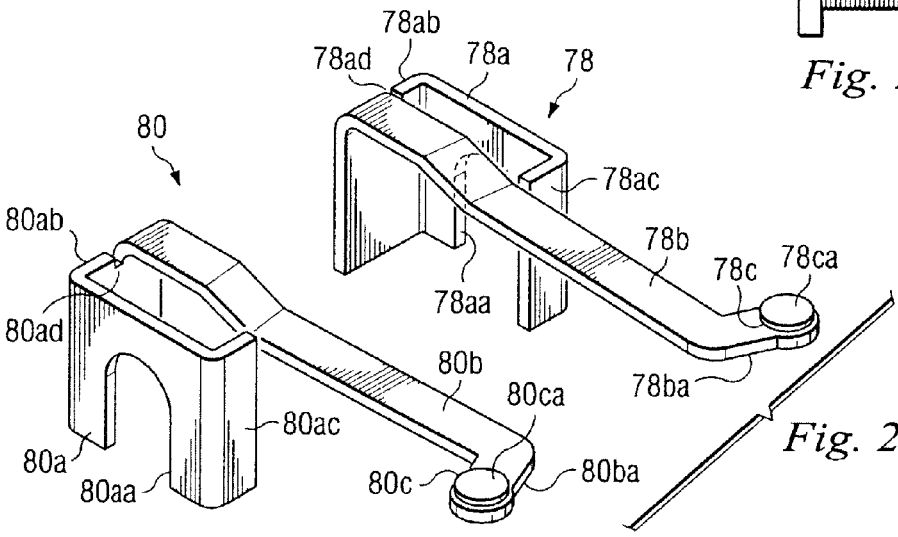
FIG. 23 is a perspective view of a pair of movable contacts depicted in FIGS. 15A and 15B.

In an exemplary embodiment, as illustrated in FIG. 23, the load-terminal portion 78*a* of the movable contact 78 includes parallel-spaced walls 78*ab* and 78*ac*, and a notch 78*ad* formed in the wall 78*ab*. The arm 78*b* extends from the wall 78*ab* and includes a dog-leg-shaped distal end portion 78*ba* to which a contact 78*c* defining a contact surface 78*ca* is coupled.

The movable contact 80 is the symmetric equivalent to the movable contact 78, about an imaginary plane that is perpendicular to the walls 78*aa* and 78*ab* and disposed midway between the movable contacts 78 and 80. The load-terminal portion 80*a* of the movable contact 80 includes parallel-spaced walls 80*ab* and 80*ac*, and a notch 80*ad* formed in the wall 80*ab*. The arm 80*b* extends from the wall 80*ab* and includes a dog-leg-shaped distal end portion 80*ba* to which a contact 80*c* defining a contact surface 80*ca* is coupled.

Figure 24:
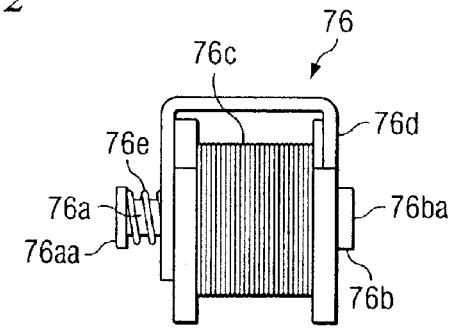
FIG. 24 is a side elevational view of a solenoid assembly depicted in FIGS. 15A and 15B.

In an exemplary embodiment, as illustrated in FIG. 24, the solenoid assembly 76 includes a rod 76*a* and a plunger 76*b* coupled to an end portion of the rod 76*a*. The plunger 76*b* includes an enlarged-diameter end portion 76*ba*. A coil 76*c* at least partially surrounds the rod 76*a*. An end surface 76*d* is defined by the solenoid assembly 76. The rod 76*a* extends through a spring 76*e*, which applies a biasing or reaction force against an enlarged-diameter portion 76*aa* of the rod 76*a*, thereby causing the enlarged-diameter end portion 76*ba* of the plunger 76*b* to be normally biased against the end surface 76*d* of the solenoid assembly. The solenoid assembly 76 is adapted to be energized, thereby causing the enlarged-diameter end portion 76*ba* of the plunger 76*b* to move away from the end surface 76*d* and the spring 76*e* to be compressed, under conditions to be described. The solenoid assembly 76 is coupled to the circuit board 60 in a conventional manner such as, for example, by using one or more conventional snap-fit protrusions. Moreover, the coil 76*c* of the solenoid assembly is electrically coupled to the circuit 102, and is further coupled to the circuit board 60, in a conventional manner such as, for example, by using leads that extend into the circuit board 60 and are soldered thereto.

Figure 25:
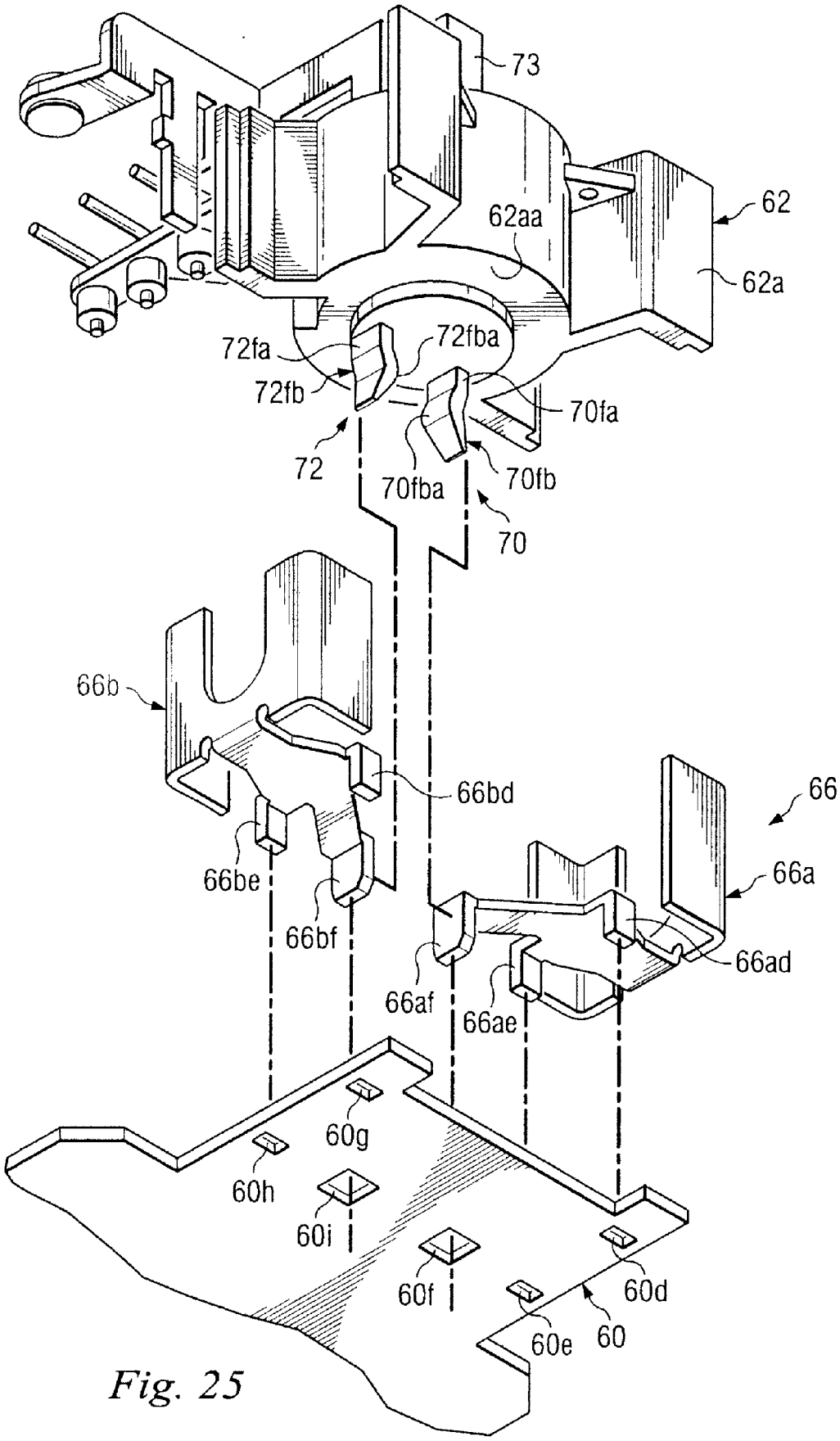
FIG. 25 is a partially exploded/partially unexploded view of the transformer assembly of FIG. 20, the stationary contacts of FIG. 21, and the circuit board depicted in FIGS. 15A and 15B.
Figure 26:
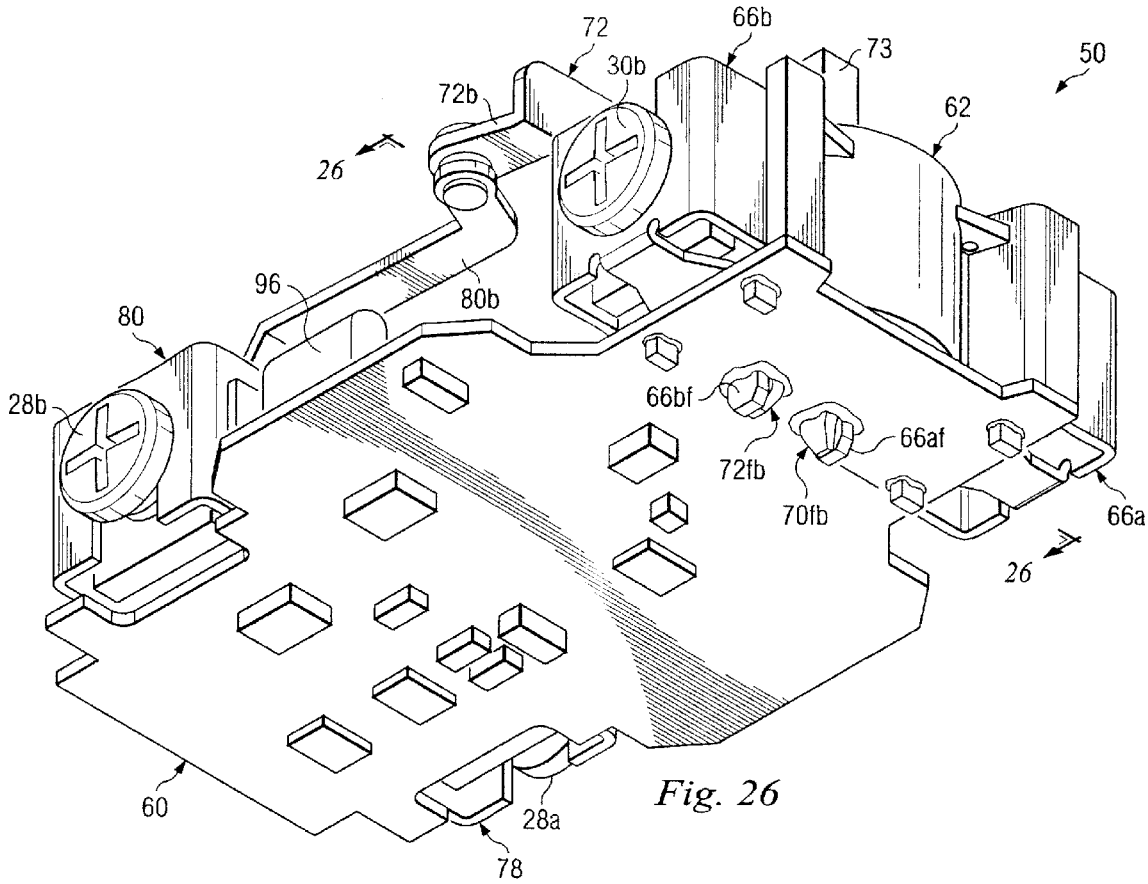
FIG. 26 is an unexploded perspective view of the transformer assembly of FIG. 20, the stationary contacts of FIG. 21, and the circuit board depicted in FIGS. 15A and 15B.
Figure 27:
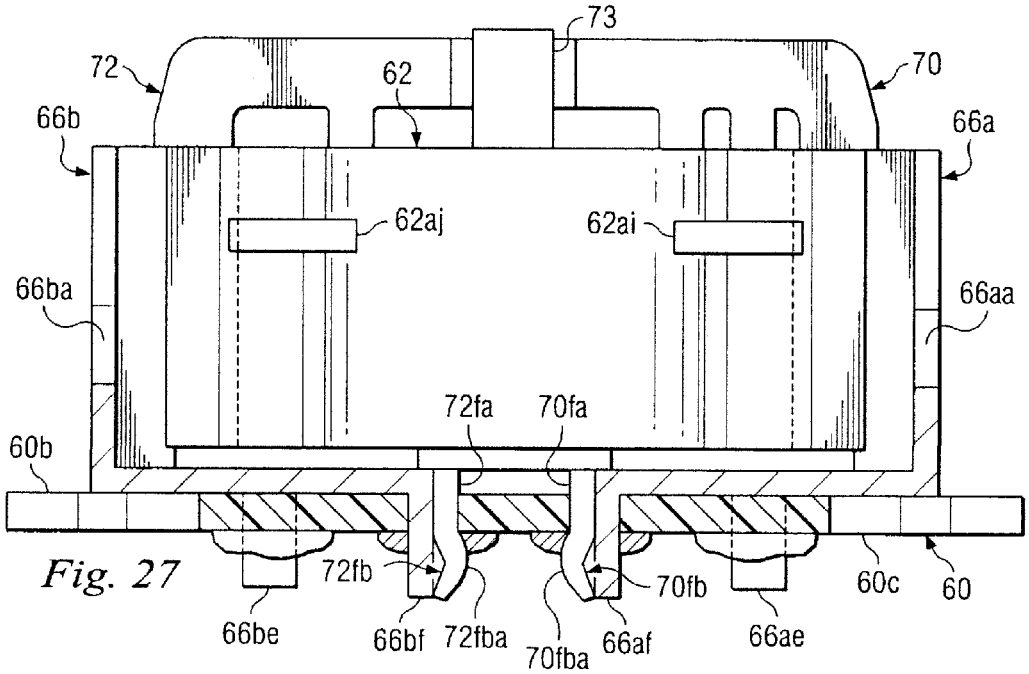
FIG. 27 is a partial sectional/partial elevational view of the PCB assembly of FIG. 26 taken along line 27-27.

To couple the transformer assembly 62 to the circuit board 60, in an exemplary embodiment and as illustrated in FIGS. 25, 26 and 27, the tabs 66*ad*, 66*ae* and 66*af* of the input line terminal 66*a* are inserted into openings 60*d*, 60*e* and 60*f*, respectively, of the circuit board 60, and the tabs 66*bd*, 66*be* and 60*bf* are inserted into openings 60*g*, 60*h* and 60*i*, respectively, of the circuit board 60.

Before, during or after the insertion of the tabs 66*ad*, 66*ae*, 66*af*, 66*bd*, 66*be* and 66*bf* into the openings 60*d*, 60*e*, 60*f*, 60*g*, 60*h* and 60*i*, respectively, the stationary contacts 70 and 72 are coupled to the transformer assembly 62 by extending the contact arms 70*f* and 72*f* through the opening 62*ad*, extending the tabs 70*d* and 72*d* into the openings 62*an* and 62*ar*, respectively, and extending the isolating member 73 into the opening 62*ad* so that the isolating member 73 is disposed between the contact arms 70*f* and 72*f*. The portion 70*fa* of the contact arm 70*f* is disposed between the surface 62*aca* and the isolating member 73, and the portion 72*fa* of the contact arm 72*f* is disposed between the surface 62*acb* and the isolating member 73.

Before, during or after the insertion of the tabs 66*ad*, 66*ae*, 66*af*, 66*bd*, 66*be* and 66*bf* into the openings 60*d*, 60*e*, 60*f*, 60*g*, 60*h* and 60*i*, respectively, one or both of the circuit board 60 and the transformer assembly 62, having the contact arms 70*f* and 72*f* extending through the opening 62*ad* as described above, are moved so that the contact arms 70*f* and 72*f* of the stationary contacts 70 and 72, respectively, are inserted into the openings 60*f* and 60*i*, respectively.

As the contact arms 70*f* and 72*f* are inserted into the openings 60*f* and 60*i*, respectively, the curved portions 70*fba* and 72*fba* of the kinked portions 70*fb* and 72*fb*, respectively, contact edges of the circuit board 60 defined by the openings 60*f* and 60*i*, respectively, and the kinked portions 70*fb* and 721*b* are forced through the openings 60*f* and 60*i*, respectively, and between the circuit board 60 and the tabs 66*af* and 66*bf*, respectively. As the kinked portions 70*fb* and 72*fb* are forced through the openings 60*f* and 60*i*, respectively, the contact between the curved portions 70*fba* and 72*fba* and the circuit board 60 causes at least the kinked portions 70*fb* and 72*fb* to flex and deflect away from each other. Once the kinked portions 70*fb* and 72*fb* pass through the openings 60*f* and 60*i*, respectively, the kinked portions 70*fb* and 72*fb* flex back and return to their normal positions, relative to one another. The base 62*aa* is adjacent the surface 60*b* of the circuit board 60, the vertically-extending portions 70*fa* and 72*fa* extend within the openings 60*f* and 60*i*, respectively, and the kinked portions 70*fb* and 72*fb* engage the surface 60*c* of the circuit board 60, with at least respective portions of the curved portions 70*fba* and 72*fba* engaging the surface 60*c*, with the surface 60*c* including at least respective edges of the surface 60*c* that are defined by the openings 60*f* and 60*i*. As a result, the transformer assembly 62, and the stationary contacts 70 and 72, are coupled to the circuit board 60. In an exemplary embodiment, the kinked portions 70*fb* and 72*fb* may at least partially extend within the openings 60*f* and 60*i*, respectively. In an exemplary embodiment, the kinked portions 70*fb* and 72*fb* may at least partially extend within the openings 60*f* and 60*i*, respectively, and may not engage the surface 60*c* of the circuit board 60, including any edges of the surface 60*c* defined by the openings 60*f* and 60*i*, and the transformer assembly 62 may be coupled to the circuit board 60 by the interference fit between the kinked portions 70*fb* and 72*fb*, the vertically-extending surfaces of the circuit board 60 defined by the openings 60*f* and 60*i*, respectively, and the tabs 66*af* and 66*bf*, respectively.

In an exemplary embodiment, after the transformer assembly 62 is coupled to the circuit board 60, the contact arms 70*f* and 72*f* are soldered to the tabs 66*af* and 66*bf*, respectively, and to the circuit board 60, thereby electrically coupling the contact arms 70*f* and 72*f* to the tabs 66*af* and 66*bf*, and to the circuit board 60. The above-described coupling of the transformer assembly 62 to the circuit board 60 holds the transformer assembly 62 in place, relative to the circuit board 60, thereby facilitating the subsequent soldering of the contact arms 70*f* and 72*f* to the tabs 66*af* and 66*bf*, respectively, and the circuit board 60. The engagement of the kinked portions 70*fb* and 72*fb* with the surface 60*c* of the circuit board 60 facilitates in preventing the transformer assembly 62 from floating upward and away from the surface 60*b* of the circuit board 60, and thus holds the transformer assembly 62 in place to facilitate the soldering of the contact arms 70*f* and 72*f* to the tabs 66*af* and 66*bf*, and to the circuit board 60. As a result, the risk of having to resolder the contact arms 70*f* and 72*f* is appreciably reduced, thus reducing rework time and/or yielding reduced manufacturing costs.

The tabs 66*ad*, 66*ae*, 66*af*, 66*bd*, 66*be* and 66*bf* are also soldered to the circuit board 60. Before, during or after the coupling of the transformer assembly 62 to the circuit board 60, the leads of the capacitor 64 are inserted through the bores 62*ak* and 62*a*1 of the transformer assembly 62 and into the circuit board 60, and are soldered thereto. Moreover, the cable 88, which extends from the diode 90, is electrically coupled to the protrusion 72*d* of the stationary contact 72.

In an exemplary embodiment, the contact arms 70*f* and 72*f* may extend through openings in the circuit board 60 other than the openings 60*f* and 60*i*, respectively, and the size of each contact arm 70*f* and 72*f* and/or each kinked portion 70*fb* and 72*fb* may be increased, and/or the size of each opening 60*f* and 60*i* may be decreased.

In several exemplary embodiments, one or more other components of the transformer assembly 62 may extend into and/or through other openings in the circuit board 60 such as, for example, the contact pins 62*ba*, 62*bb*, 62*bc* and 62*bd*.

Figure 28:
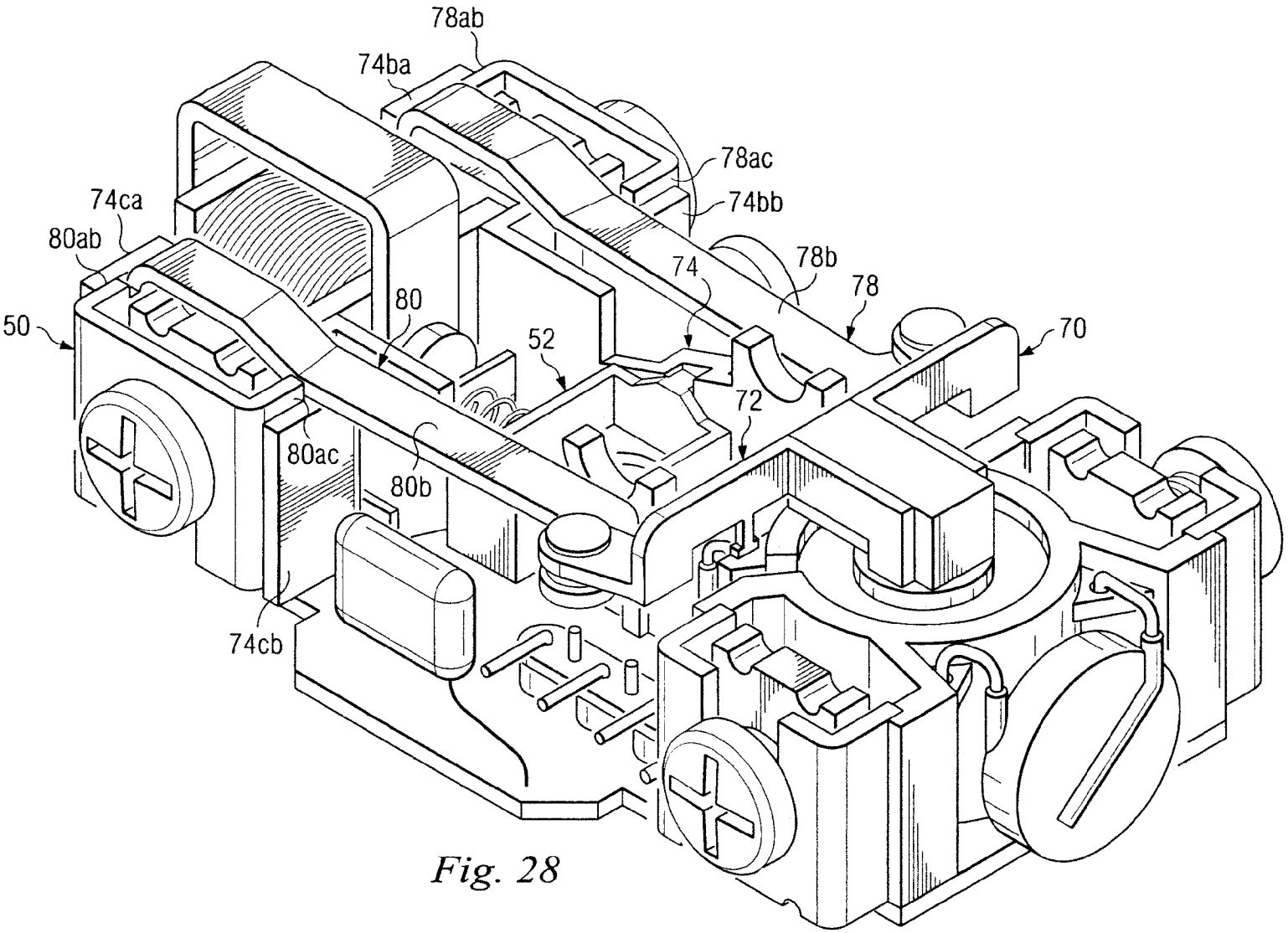
FIG. 28 is a perspective view of the latch assembly of FIGS. 13A and 13B received by the PCB assembly of FIGS. 15A and 15B.

When the PCB assembly 50 in an assembled condition, in an exemplary embodiment and as illustrated in FIG. 28 with continuing reference to FIGS. 15A through 27, the movable contacts 78 and 80 are coupled to the frame 74, as noted above. More particularly, the walls 78*ab* and 78*ac* of the line terminal portion 78*a* of the movable contact 78 extend between and contact the walls 74*ba* and 74*bb*, respectively, of the wing portion 74*b* of the frame 74, thereby coupling the movable contact 78 to the frame 74. Similarly, the walls 80*ab* and 80*ac* of the line terminal portion 80*a* of the movable contact 80 extend between and contact the walls 74*ca* and 74*cb*, respectively, of the wing portion 74*c* of the frame 74, thereby coupling the movable contact 80 to the frame 74. In an exemplary embodiment, conventional snap-fit protrusions extend from the respective inside surfaces of the walls 74*ba* and 74*ca* and into the respective notches 78*ad* and 80*ad*, thereby further coupling the movable contacts 78 and 80 to the frame 74.

The arms 78*b* and 80*b* of the movable contacts 78 and 80, respectively, are positioned so that the distal end portions 78*ba* and 80*ba* are positioned below the tabs 70*b* and 72*b*, respectively, of the stationary contacts 70 and 72, respectively, and the contact surfaces 78*ca* and 80*ca* contact the contact surfaces 70*cb* and 72*cb*, respectively. Due to the position of the tabs 70*b* and 72*b*, the arms 78*b* and 80*b* are flexed downward, causing the arms 78*b* and 80*b* to normally apply biasing or reaction forces against the tabs 70*b* and 72*b*, respectively. As a result, suitable electrical contact between the contact surfaces 78*ca* and 70*cb*, and between the contact surfaces 80*ca* and 72*cb*, is facilitated for reasons to be described.

Figure 29:
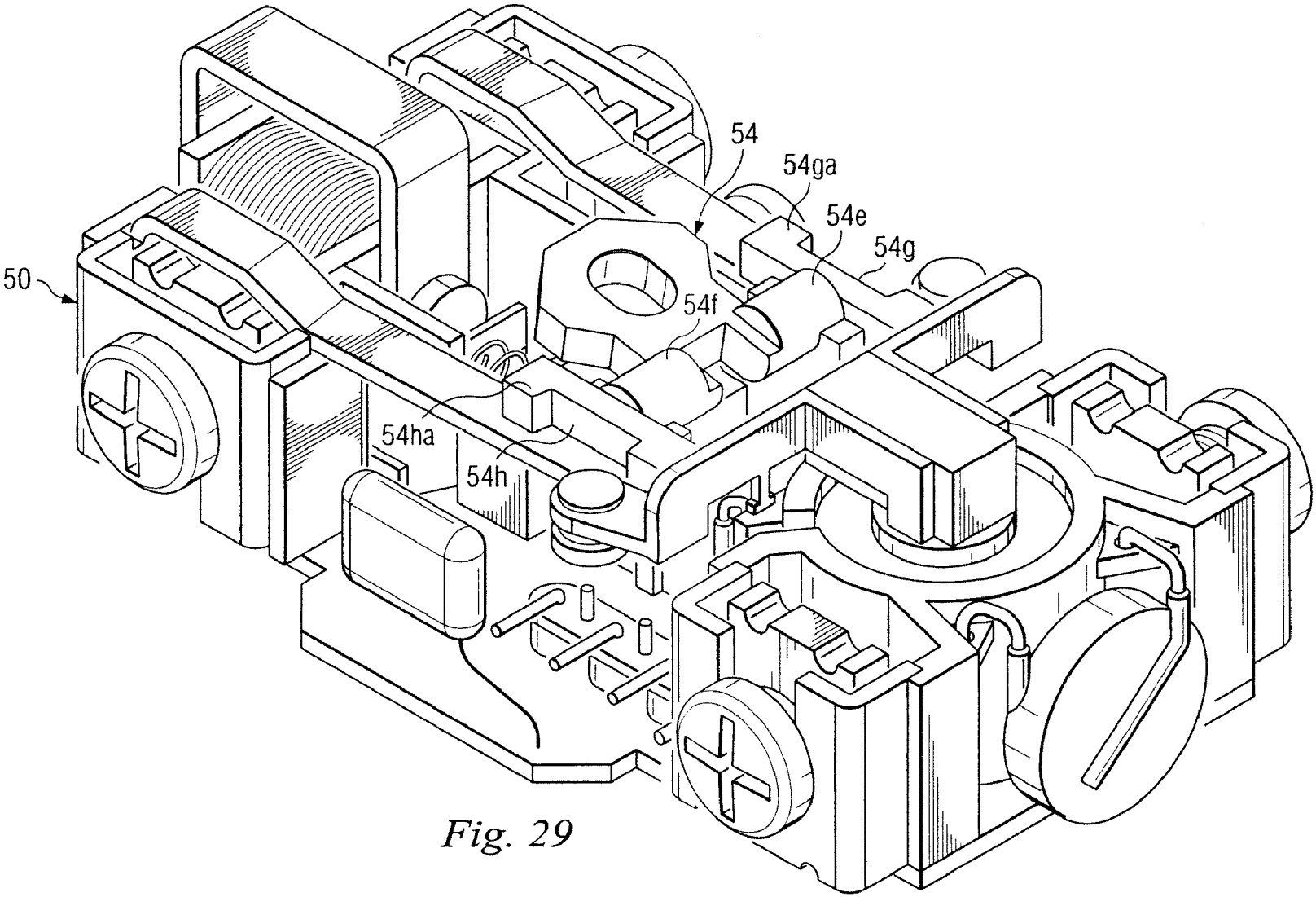
FIG. 29 is a perspective view of the cam of FIG. 14 and the latch assembly of FIGS. 13A and 14B received by the PCB assembly of FIGS. 15A and 15B.

In an exemplary embodiment, when the latch assembly 52, the cam 54 and the PCB assembly 50 are in an assembled condition as illustrated in FIGS. 28 and 29 with continuing reference to FIGS. 15A through 27, the latch assembly 52 is disposed between the walls 74*ae* and 74*af* of the frame 74 of the PCB assembly 50, which itself is in its assembled condition described above. As a result, the protrusions 52*ag* and 52*ab* of the latch assembly 52 extend within the channels 74*aa* and 74*ab*, respectively, of the frame 74, thereby preventing the latch assembly 52 from generally moving towards or away from the plunger 76*b* of the solenoid assembly 76. The curved distal end portion 52*bd* of the latch 52*b* is proximate the plunger 76*b*. The L-shaped tabs 52*ab* and 52*ac* of the latch block 52*a* contact, and are supported by, the spring arms 98*a* and 98*b*, respectively, of the spring bracket 98. Since the L-shaped tabs 52*ab* and 52*ac* are the only components of the latch assembly 52 contacting the spring bracket 98, no electrical contact or coupling is made between the latch assembly 52 and the spring bracket 98.

The cam 54 is received by the PCB assembly 50, as noted above. More particularly, the pins 54*e* and 54*f* of the cam 54 are cradled in the notches 74*ae* and 74*ad*, respectively, of the frame 54. The distal end of the stepped protrusion 54*j* of the cam 54 contacts or is proximate the end portion 86*a* of the spring 86. The end knobs 54*ga* and 54*ha* of the cam 54 contact or are proximate the arms 78*b* and 80*b*, respectively, of the movable contacts 78 and 80, respectively.

Under conditions to be described, the legs 54*g* and 54*h* of the cam 54 are adapted to extend in a parallel relation to the arms 78*b* and 80*b*, respectively, of the movable contacts 78 and 80, respectively, so that the end knobs 54*ga* and 54*ha* are proximate, but do not contact, the arms 78*b* and 80*b*, respectively, and so that the distal end of the stepped protrusion 54*j* contacts the end portion 86*a* of the spring 86. Moreover, under conditions to be described, the legs 54*g* and 54*h* are also adapted to extend angularly so that the end knobs 54*ga* and 54*ha* contact the arms 78*b* and 80*b*, respectively, and so that the distal end of the stepped protrusion 54*j* remains proximate, but does not contact, the end portion 86*a* of the spring 86.

Figure 30:
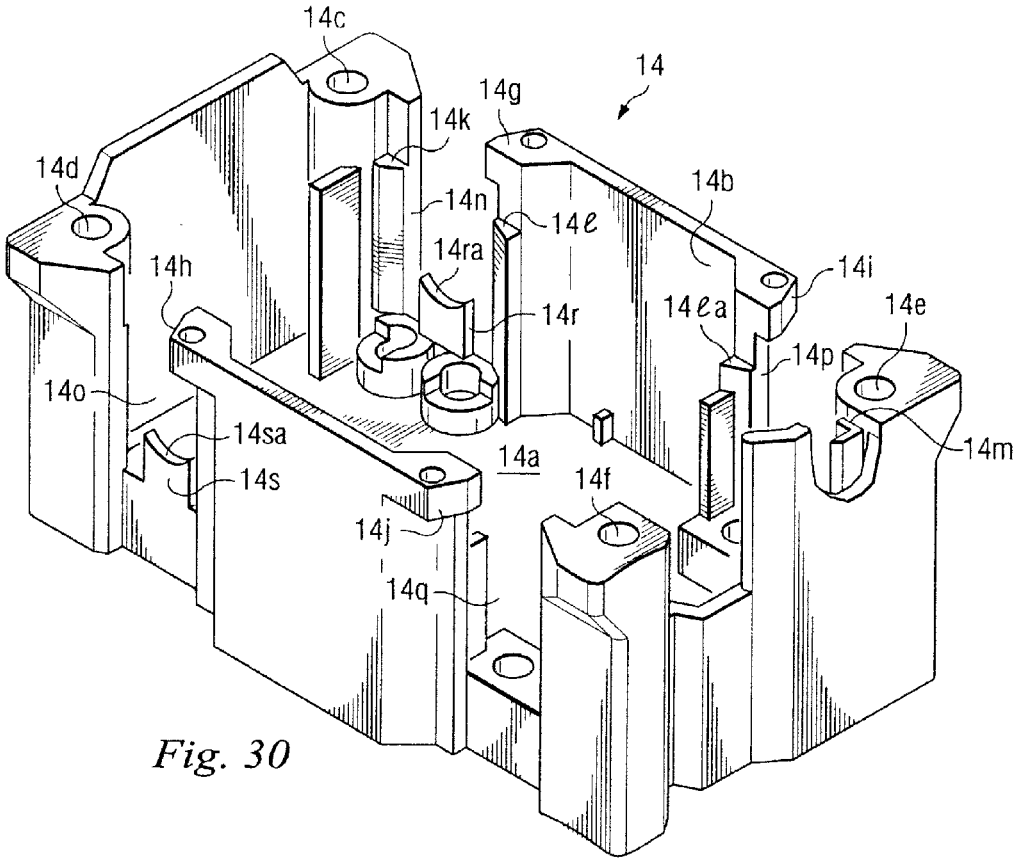
FIG. 30 is a perspective view of a bottom housing depicted in FIGS. 1 and 3.

In an exemplary embodiment, as illustrated in FIG. 30, the bottom housing 14 defines a region 14*a* having a perimeter 14*b* that substantially corresponds to the perimeter 60*a* of the circuit board 60 of the PCB assembly 50. The bottom housing 14 includes corner bores 14*c*, 14*d*, 14*e* and 14*f*, and tabs 14*g*, 14*h*, 14*i* and 14*j*, and further defines coplanar support surfaces 14*k*, 14*l*, 14*la* and 14*m*, and opposing coplanar support surfaces that are symmetric thereto, which are not shown in FIG. 27. Opposing openings 14*n* and 14*o*, and opposing openings 14*p* and 14*q*, are further defined by the bottom housing 14. Protrusions 14*r* and 14*s* having notches 14*ra* and 14*sa*, respectively, extend within the openings 14*n* and 14*o*, respectively.

Figure 31:
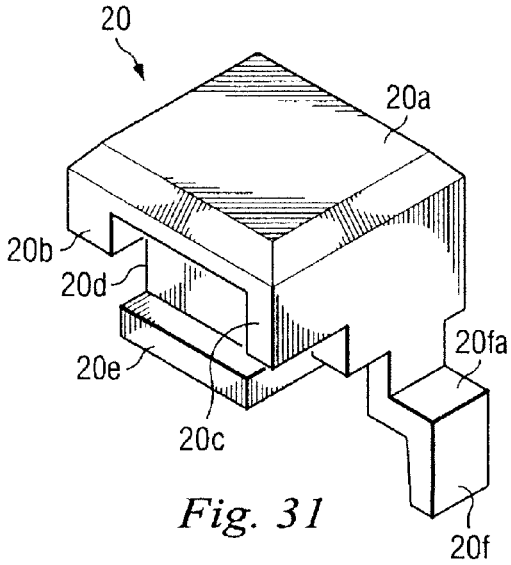
FIG. 31 is a perspective view of a test button depicted in FIGS. 1 and 3.

In an exemplary embodiment, as illustrated in FIG. 31, the test button 20 includes a substantially square-shaped protrusion 20*a* and walls 20*b* and 20*c* extending downwardly therefrom. A block 20*d* also extends downward from the protrusion 20*a*, and a protrusion 20*e* extends outward from the block 20*d*. A stepped tab 20*f* extends downward from the block 20*d* and defines a surface 20*fa*.

Figure 32:
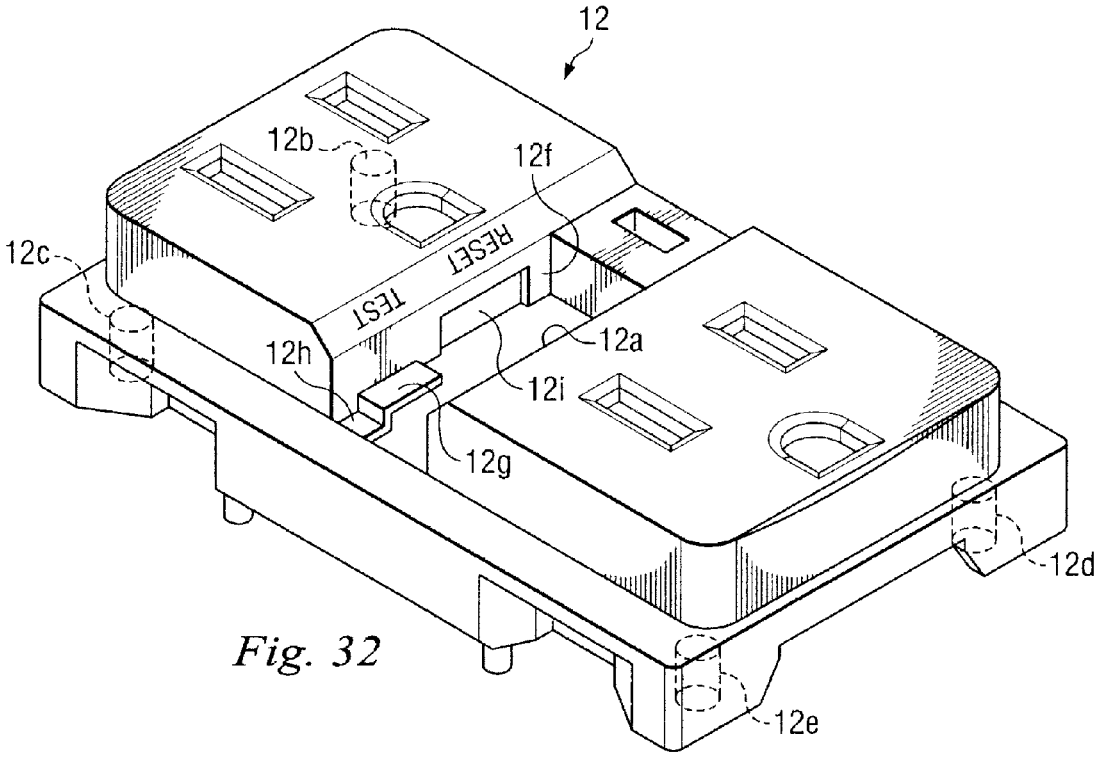
FIG. 32 is a perspective view of a top housing depicted in FIGS. 1 and 3.

In an exemplary embodiment, as illustrated in FIG. 32, the top housing 12 includes corner threaded blind bores 12*b*, 12*c*, 12*d* and 12*e*. The opening 12*a* defines a surface 12*f* and a surface spaced in a parallel relation therefrom, which is not shown in FIG. 29. A protrusion 12*g* extends from the surface 12*f* and within the opening 12*a*, and a recess 12*h* is formed in the protrusion 12*g*. A recess 12*i* is formed in the surface 12*f* and a recess opposing the recess 12*i* is formed in the surface defined by the opening 12*a* and spaced in a parallel relation from the surface 12*f*.

Figure 33:
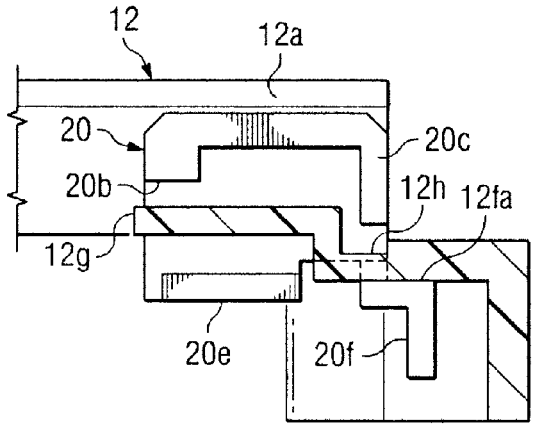
FIG. 33 is a partial sectional/partial elevational view of the test button of FIG. 31 engaged with the top housing of FIG. 32.

In an exemplary embodiment, as noted above and as illustrated in FIG. 33, the test button 20 extends within the opening 12*a* of the top housing 12. More particularly, the test button 20 is positioned within the opening 12*a* so that the protrusion 12*g* of the top housing 12 extends between the wall 20*b* and the protrusion 20*e* of the test button 20, and the wall 20*c* of the test button 20 extends into the recess 12*h* of the top housing 12. As a result, the test button 20 is captured within the opening 12*a* of the top housing 12, and is permitted to move up and down over a limited range of vertical movement, as viewed in FIG. 33.

Figure 34:
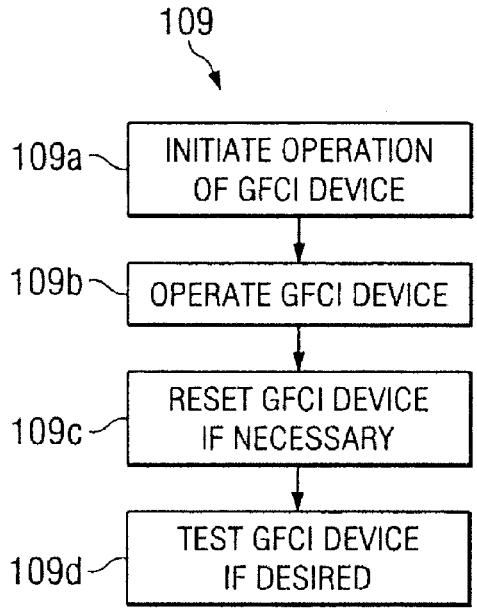
FIG. 34 is a flow chart illustration of an exemplary embodiment of a method of operating the device of FIG. 1.

In an exemplary embodiment, as illustrated in FIG. 34, a method 109 of operating the device 10 includes initiating operation of the device 10 in step 109*a*, and operating the device 10 in step 109*b*. The method 109 further includes resetting the device 10 in step 109*c*, if necessary, and testing the device 10 in step 109*d*, if desired. The steps 109*a*, 109*b*, 109*c* and 109*d* are described in further detail below.

Figure 35:
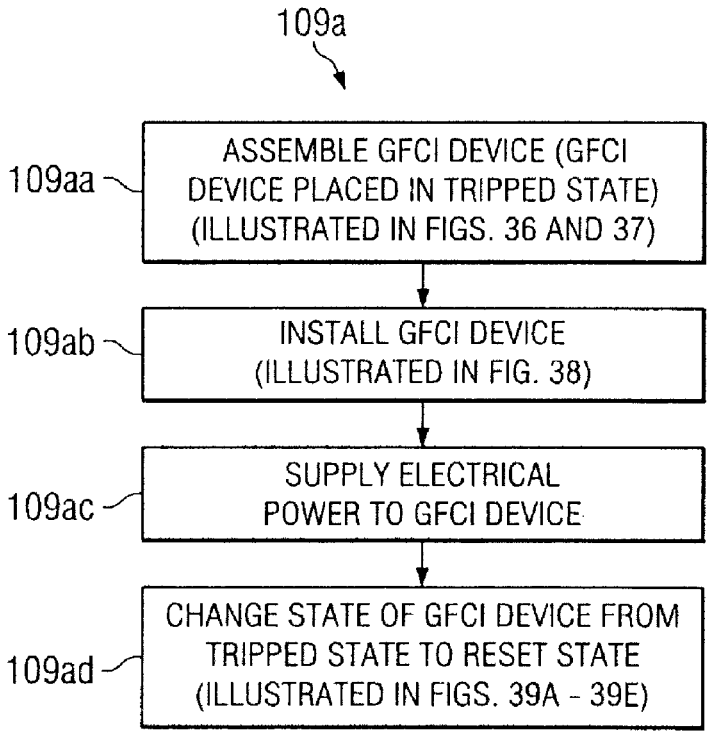
FIG. 35 is a flow chart illustration of an exemplary embodiment of a step of the method of FIG. 34.

In an exemplary embodiment, as illustrated in FIG. 35, to initiate operation of the device 10 in the step 109*a* of the method 109, the device is assembled in step 109*aa*, after which the device 10 is installed in step 109*ab*, after which electrical power is supplied to the device 10 in step 109*ac*, and after which the state of the device 10 is changed from its tripped state to its reset state in step 109*ad*, with the tripped state and the reset state being the two operational states of the device 10. The steps 109*aa*, 109*ab*, 109*ac* and 109*ad*, and the tripped and reset states of the device 10, are described in further detail below.

Figure 36:
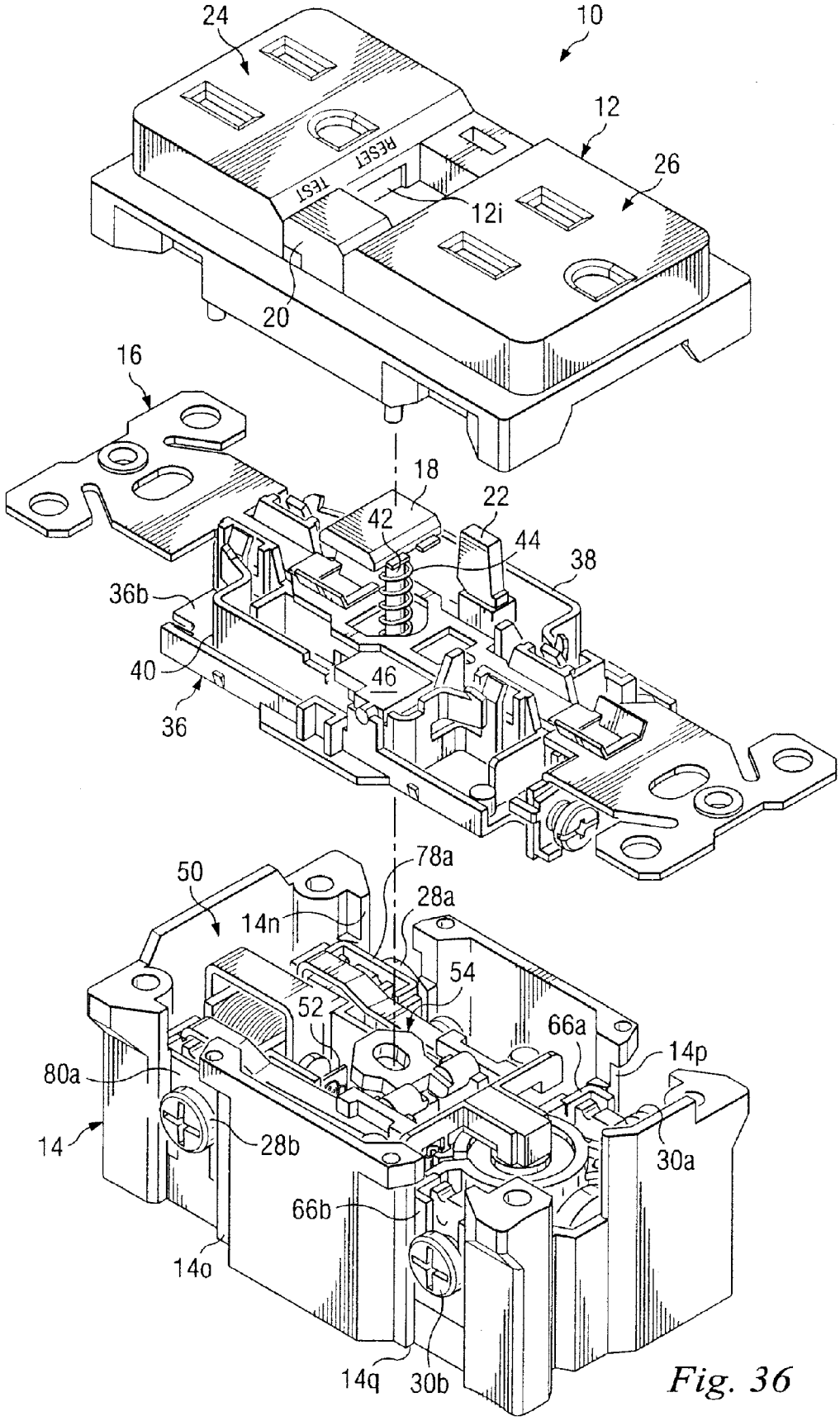
FIG. 36 is a partial exploded view of the device of FIG. 1, depicting the device 10 undergoing assembly.

In an exemplary embodiment, when the device 10 is an assembled condition after the step 109*aa*, as illustrated in FIG. 36 with continuing reference to FIGS. 1-35, the PCB assembly 50 is received by the bottom housing 14, as noted above. More particularly, the circuit board 60 is received into the region 14*a*, with the substantial correspondence between the perimeter 60*a* of the circuit board 60 and the perimeter 14*b* of the bottom housing 14 facilitating the reception of the circuit board 60. The load-terminal portion 78*a* of the movable contact 78 is aligned with the opening 14*n* and the screw 28*a* is cradled in, or proximate, the notch 14*ra* of the protrusion 14*r*. Similarly, the load-terminal portion 80*a* of the movable contact 80 is aligned with the opening 14*o* and the screw 28*b* is cradled in, or proximate, the notch 14*sa* of the protrusion 14*s*. The input line terminals 66*a* and 66*b* are aligned with the openings 14*p* and 14*q*, respectively, so that the screws 30*a* and 30*b* extend within the openings 14*p* and 14*q*, respectively.

The middle housing 36 is coupled to the bottom housing 14, as noted above. More particularly, the tray portion 36*b* of the middle housing 36 contacts, and is supported by, the support surfaces 14*k*, 14*l*, 14*la*, and 14*m*, and the corresponding surfaces symmetric thereto, of the bottom housing 14. Moreover, the snap-fit protrusions 36*p*, 36*q*, 36*r* and 36*s* of the middle housing 36 form snap-fit connections with the tabs 14*g*, 14*i*, 14*h* and 14*j*, respectively, of the bottom housing 14. The protrusions 36*t* and 36*u* extend into the openings 14*p* and 14*q*, respectively, and are proximate the screws 30*a* and 30*b*, respectively. The upper portions of the pins 54*e* and 54*f* of the cam 54 are received into the notches 36*eo* and 36*ep*, respectively, of the middle housing 36, while still being cradled in the notches 74*ac* and 74*ad*, respectively, of the frame 54. The mounting strap 16, the spring 44, the actuator 46, the torsion spring 48 and the receptacle contacts 38 and 40 are engaged with the middle housing 36, as described above.

As a result of the coupling of the middle housing 36 to the bottom housing 14, the U-shaped portion 48*c* of the torsion spring 48 contacts the center portion 54*a* of the cam 54, extending around the opening 54*b*. As a result, the torsion spring 48 applies a biasing or reaction force against the center portion 54*a* of the cam 54.

As another result of the coupling of the middle housing 36 to the bottom housing 14, the distal end of the light pipe 22, which opposes the stepped end portion 22*a*, is proximate the LED 92 of the PCB assembly 50.

The reset button 18 extends within the opening 12*a* of the top housing 12, as noted above. More particularly, the reset button 18 extends within the opening 12*a* so that the tabs 18*a* and 18*b* of the reset button extend in the recess in the top housing 12 opposing the recess 12*i*, and the tabs of the reset button 18 opposing the tabs 18*a* and 18*b* extend in the recess 12*i*. As a result, the rest button 18 is prevented from extending upward past the top housing 12. The reset shaft 42 extends downward through the spring 44, the counterbore 36*a* of the middle housing 36, the opening 54*b* of the cam 54, the opening 52*aa* in the latch block 52*a* of the latch assembly 52 and the opening 52*ba* in the latch 52*b* of the latch assembly 52.

Under conditions to be described, the flange 42*c* of the reset shaft 42 is adapted to be positioned above the latch 52*b* of the latch assembly 52 so that the surface 42*cb* of the flange 42*c* contacts the latch 52*b*. Moreover, under conditions to be described, the flange 42*c* of the reset shaft 42 is adapted to be positioned below the latch 52*b* of the latch assembly 52 so that the surface 42*ca* of the flange 42*c* contacts the latch 52*b*.

The bottom housing 14 is coupled to the top housing 12, as noted above. More particularly, the fasteners 34*a*, 34*b*, 34*c* and 34*d* extend through the corner bores 14*c*, 14*d*, 14*e* and 14*f*, respectively, of the bottom housing 14 and into, and are threadably engaged with, the corner threaded blind bores 12*b*, 12*c*, 12*d* and 12*e*, respectively, of the top housing 12. As a result, the pair of contacts 38*a* of the receptacle contact 38, and the pair of contacts 40*a* of the receptacle contact 40, are generally aligned with the corresponding openings in the receptacle outlet 24. Also, the pair of contacts 38*b* of the receptacle contact 38, and the pair of contacts 40*b* of the receptacle contact 40, are generally aligned with the corresponding openings in the receptacle outlet 26. Moreover, the helical portion 44*a* of the spring 44 is at least partially compressed between the internal shoulder 36 eq of the counterbore 36*a* of the middle housing 36 and the reset button 18.

In an exemplary embodiment, as noted above, the device 10 is initially placed in its tripped state as a result of the assembly of the device 10 in the step 109*aa*.

Figure 37:
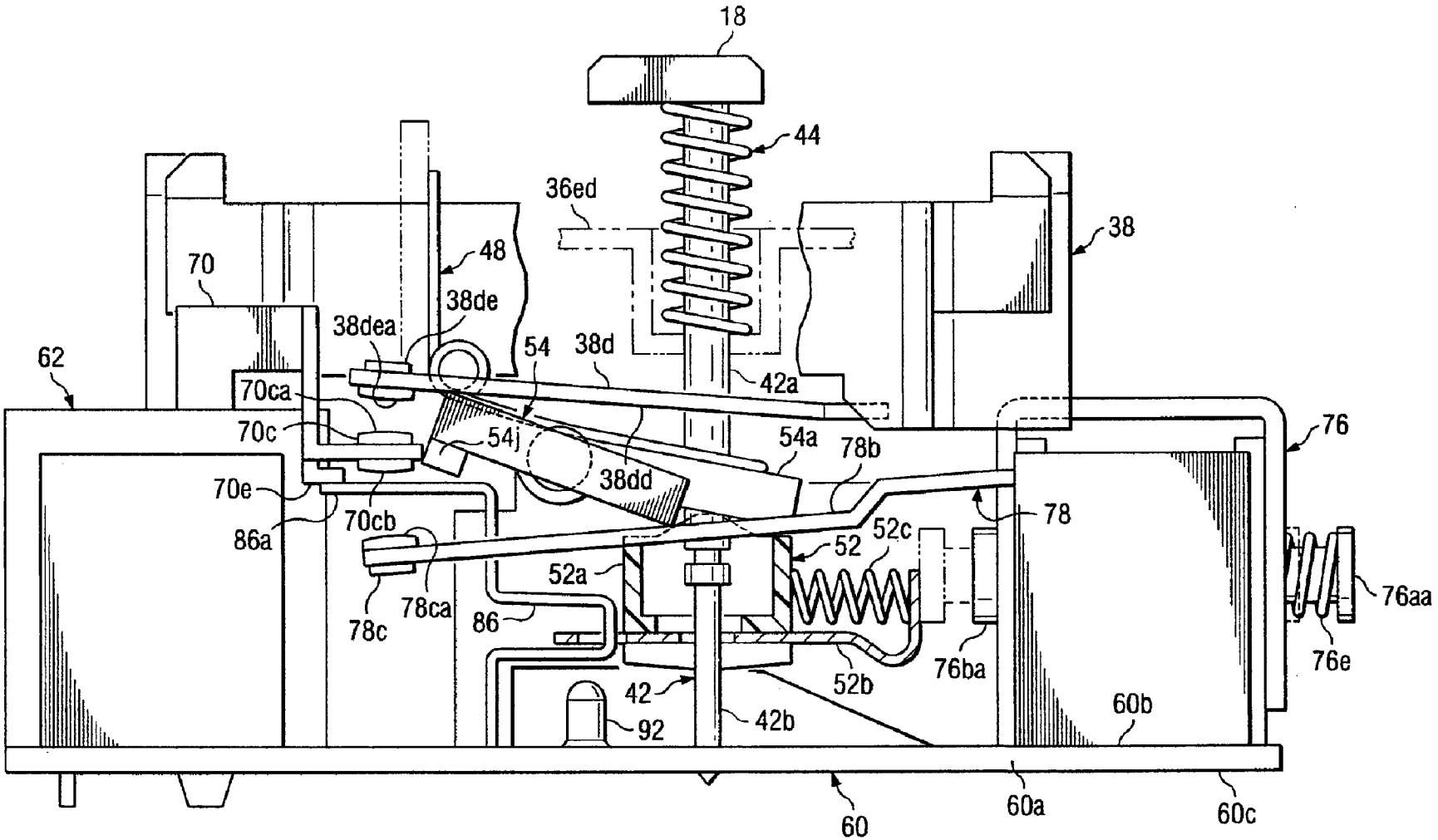
FIG. 37 is a simplified partial elevational/partial sectional view of the device 10 with several components removed for the purpose of clarity, depicting the device 10 in its tripped state, upon completion of the assembly of the device 10.

When the device 10 is in its tripped state, in an exemplary embodiment and as illustrated in FIG. 37 with continuing reference to FIGS. 1-36, the flange 42*c* of the shaft 42 is positioned above the latch 52*b* of the latch assembly 52. As a result, the torsion spring 48 applies a biasing or reaction force against the center portion 54*a* of the cam 54, forcing the cam 54 to rotate in a clockwise direction as viewed in FIG. 37, with the pins 54*e* and 54*f* of the cam 54 rotating in place, about an imaginary axis defined by the axially-aligned respective longitudinal center axes of the pins 54*e* and 54*f*. During this rotation, the pins 54*e* and 54*f* remain received within the notches 36*eo* and 36*ep*, respectively, of the middle housing 36, and within the notches 74*ac* and 74*ad*, respectively, of the frame 54. The torsion 48 spring forces the cam 54 to rotate until the center portion 54*a* of the cam 54 contacts the walls 74*ae* and 74*af* of the frame 74, at which point the cam 54 ceases to rotate.

As a result of the forced rotation of the cam 54 by the torsion spring 48, the end knobs 54*ga* and 54*ha* of the legs 54*g* and 54*h*, respectively, of the cam 54 apply respective forces against the arms 78*b* and 80*b*, respectively, of the movable contacts 78 and 80, respectively, thereby pushing the arms 78*b* and 80*b* downward as viewed in FIG. 37. As a result, the contact surface 78*ca* of the contact 78*c* of the movable contact 78 is separated from the contact surface 70*cb* of the contact 70*c* of the stationary contact 70, and the contact surface 80*ca* of the contact 80*c* of the movable contact 80 is separated from the contact surface 72*cb* of the contact 72*c* of the stationary contact 72. As a result of this separation, there is no electrical coupling between the contact surfaces 78*ca* and 70*cb*, and between the contact surfaces 80*ca* and 72*cb*, and thus the movable contacts 78 and 80 are electrically isolated from the stationary contacts 70 and 72, respectively.

The above-described separation of the movable contact 78 from the stationary contact 70 is independent of the above-described separation of the movable contact 80 from the stationary contact 72.

As another result of the forced rotation of the cam 54 by the torsion spring 48, the end knobs 54*gb* and 54*hb* of the legs 54*g* and 54*h*, respectively, of the cam 54 at least partially extend into the openings 36*n* and 36*o*, respectively, of the middle housing 36, and apply forces against the slanted portions 38*dd* and 40*dd*, respectively, of the cantilever arms 38*d* and 40*d*, respectively, of the receptacle contacts 38 and 40, respectively, thereby pushing the slanted portions 38*dd* and 40*dd* upward as viewed in FIG. 37. As a result, the contact surface 38*dea* of the contact 38*de* of the arm 38*d* is separated from the contact surface 70*ca* of the contact 70*c* of the stationary contact 70, and the contact surface 40*dea* of the contact 40*de* of the arm 40*d* is separated from the contact surface 72*ca* of the contact 72*c* of the stationary contact 72. As a result of this separation, there is no electrical coupling between the contact surfaces 38*dea* and 70*ca*, and between the contact surface 40*dea* and 72*ca*, and thus the receptacle contacts 38 and 40 are electrically isolated from the stationary contacts 70 and 72, respectively.

The above-described separation of the receptacle contact 38 from the stationary contact 70 is independent of the above-described separation of the receptacle contact 40 from the stationary contact 72.

As described above, the rotation of the cam 54 results in the independent separation, or translation or deflection, of the contact surfaces 78*ca* and 80*ca* away from the contact surfaces 70*cb* and 72*cb*, respectively, and the independent separation, or translation or deflection, of the contact surfaces 38*dea* and 40*dea* away from the contact surfaces 70*ca* and 72*ca*, respectively.

The mechanical advantage provided by the cam 54 reduces the amount of force required to be applied on the cam 54 by the torsion spring 48 in order to actuate the arms 38*d*, 40*d*, 78*b* and 80*b*. Moreover, the above-described transformation of rotational motion to translational motion by the cam 54 permits the arms 38*d*, 40*d*, 78*b* and 80*b* to be actuated using a relatively small volumetric space within the device 10. That is, the torsion spring 48 and the cam 54 take up a relatively small volumetric space within the device 10, thus permitting a more compact arrangement of components within the device 10, and potentially reducing the overall size of the device 10.

The coplanar portions of the cantilever arm 38*d*—the turn portion 38*da*, the longitudinally-extending portion 38*db* and the U-shaped portion 38*dc*—increase the overall length of the cantilever arm 38*d*, with the overall length of the cantilever arm 38*d* referring to the total of the lengths of extension of the circumferential extension of the turn portion 38*da*, the longitudinal-length extension of the longitudinally-extending portion 38*db*, the circumferential extension of the U-shaped portion 38*dcm*, and the angular-length extension of the slanted portion 38*dd*.

The magnitude of the force required to deflect the slanted portion 38*dd* of the arm 38*d* so that the contact surface 38*dea* is suitably separated from the contact surface 70*ca* and the receptacle contact 38 is electrically isolated, or decoupled, from the stationary contact 70, is inversely proportional to the overall length of the cantilever arm 38*d*. That is, the greater the overall length of the cantilever arm 38*d*, the less the amount of force required to suitably separate the contact surface 38*dea* from the contact surface 70*ca*. Therefore, since the coplanar portions 38*da*, 38*db* and 38*dc* increase the overall length of the arm 38*d*, the amount of force required to suitably deflect the arm 38*d* is decreased by the portions 38*da*, 38*db* and 38*dc*. Since less force is required to deflect the arm 38*d*, the sizes of the cam 54 and the torsion spring 48 may be minimized, thus permitting a more compact arrangement of components within the device 10, and potentially reducing the overall size of the device 10.

Using the coplanar portions 38*da*, 38*db* and 38*dc* of the arm 38*d*, the above-described increase in the overall length of the arm 38*d*, and the accompanying decrease in required force, are achieved while maintaining as substantially constant the length of the arm 38*d* in the longitudinal direction, that is, while not appreciably increasing the length of extension of the arm 38*d* in a direction that runs parallel to the wall 38*c* of the receptacle contact 38. As a result, the sizes of the receptacle contact 38 and the middle housing 36 may be minimized, thus permitting a more compact arrangement of components within the device 10, and potentially reducing the overall size of the device 10. Moreover, because the overall length of the arm 38*d* is increased, relatively thick metal is able to be used to form the receptacle contact 38, including the arm 38*d*, and the arm 38*d* is able to be integral with the remainder of the receptacle contact 38, resulting in a cost reduction.

Similarly, the coplanar portions of the cantilever arm 40*d*—the turn portion 40*da*, the longitudinally-extending portion 40*db* and the U-shaped portion 40*dc*—increase the overall length of the cantilever arm 40*d*, with the overall length of the cantilever arm 40*d* referring to the total of the lengths of extension of the circumferential extension of the turn portion 40*da*, the longitudinal-length extension of the longitudinally-extending portion 40*db*, the circumferential extension of the U-shaped portion 40*dcm*, and the angular-length extension of the slanted portion 40*dd*.

The magnitude of force required to deflect the slanted portion 40*dd* of the arm 40*d* so that the contact surface 40*dea* is suitably separated from the contact surface 72*ca* and the receptacle contact 40 is electrically isolated, or decoupled, from the stationary contact 72, is inversely proportional to the overall length of the cantilever arm 40*d*. That is, the greater the overall length of the cantilever arm 40*d*, the less the amount of force required to suitably separate the contact surface 40*dea* from the contact surface 72*ca*. Therefore, since the coplanar portions 40*da*, 40*db* and 40*dc* increase the overall length of the arm 40*d*, the amount of force required to suitably deflect the arm 40*d* is decreased by the portions 40*da*, 40*db* and 40*dc*. Since less force is required to deflect the arm 40*d*, the sizes of the cam 54 and the torsion spring 48 may be minimized, thus permitting a more compact arrangement of components within the device 10, and potentially reducing the overall size of the device 10.

Using the coplanar portions 40*da*, 40*db* and 40*dc* of the arm 40*d*, the above-described increase in the overall length of the arm 40*d*, and the accompanying decrease in required force, are achieved while maintaining as substantially constant the length of the arm 40*d* in the longitudinal direction, that is, while not appreciably increasing the length of extension of the arm 40*d* in a direction that runs parallel to the wall 40*c* of the receptacle contact 40. As a result, the sizes of the receptacle contact 40 and the middle housing 36 may be minimized, thus permitting a more compact arrangement of components within the device 10, and potentially reducing the overall size of the device 10. Moreover, because the overall length of the arm 40*d* is increased, relatively thick metal is able to be used to form the receptacle contact 40, including the arm 40*d*, and the arm 40*d* is able to be integral with the remainder of the receptacle contact 40, resulting in a cost reduction.

As another result of the forced rotation of the cam 54 by the torsion spring 48, the stepped protrusion 54*j* of the cam 54 is separated from the end portion 86*a* of the spring 86, thereby permitting the end portion 86*a* of the spring 86 to return to its normally biased position against the L-shaped tab 70*e* of the stationary contact 70, contacting and applying a biasing or reaction force against the L-shaped tab 70*e*. As result, the spring 86 is electrically coupled to the stationary contact 70 and thus the switch formed by the spring 86 and the stationary contact 70 is closed. The spring bias of the spring 86, which causes the upward movement of the end portion 86*a* of the spring 86, improves the reliability of the switch formed by the spring 86 and the stationary contact 70, and provides a low-cost switch design.

When the device 10 is in its tripped state, in an exemplary embodiment and as illustrated in FIG. 37, the input line terminals 66*a* and 66*b* are electrically coupled to the stationary contacts 70 and 72, respectively. However, the stationary contacts 70 and 72 are electrically decoupled from the movable contacts 78 and 80, respectively, because of the above-described separation between the contact surfaces 78*ca* and 80*ca* and the contact surfaces 70*cb* and 72*cb*. Moreover, the stationary contacts 70 and 72 are electrically decoupled from the receptacle contacts 38 and 40, respectively, because of the above-described separation between the contact surfaces 38*dea* and 40*dea* and the contact surfaces 70*ca* and 72*ca*, respectively.

In an exemplary embodiment, after the device 10 is assembled and thus placed in its tripped state in the step 109*aa*, the device 10 is installed in the step 109*ab*.

Figure 38:
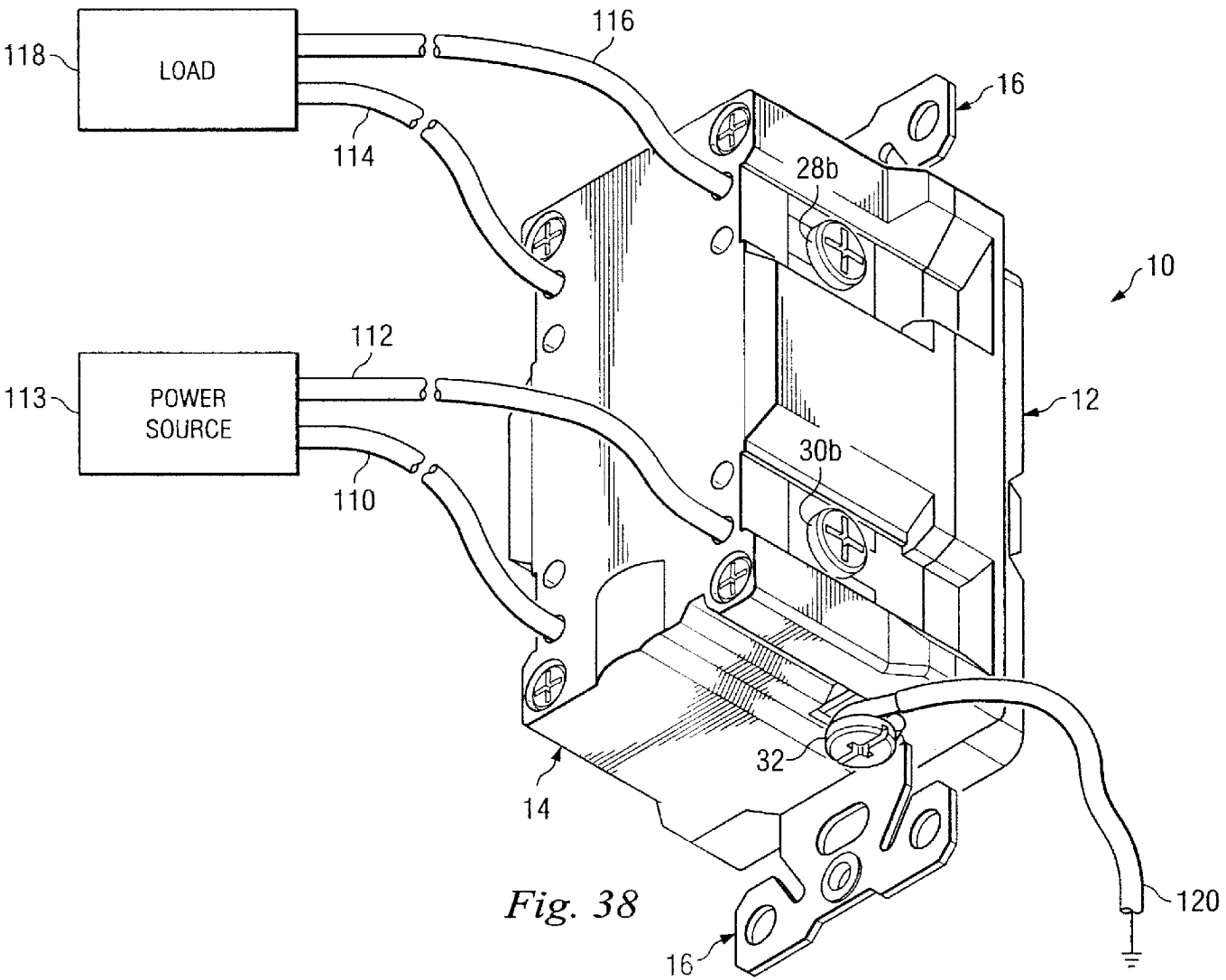
FIG. 38 is a partial diagrammatic/partial perspective view of the device 10, depicting the device 10 installed.

To install the device 10, in an exemplary embodiment and as illustrated in FIG. 38, a hot wire 110 is electrically coupled to the input line terminal 66*a*, and a neutral wire 112 is electrically coupled to the input line terminal 66*b*, in a conventional manner using the screws 30*a* and 30*b*, respectively, and the terminal plates 68*a* and 68*b*, respectively. The wires 110 and 112 are electrically coupled to a source of electrical power 113. A hot wire 114 is electrically coupled to the load-terminal portion 78*a* of the movable contact 78, and a neutral wire 116 is electrically coupled to the load-terminal portion 80*a* of the movable contact 80, in conventional manner using the screws 28*a* and 28*b*, respectively, and the terminal plates 82 and 84, respectively. The wires 114 and 116 are electrically coupled to a load 118. A ground wire 120 is electrically coupled to the mounting strap 16, in a conventional manner using the screw 32 and the terminal plate 56, and provides a ground path. In several exemplary embodiments, in addition to, or instead of the foregoing, electrical couplings between the device 10 and the wires 110, 112, 114, 116 and 120 may be made in a wide variety of conventional manners.

In an exemplary embodiment, as illustrated in FIG. 38, after the device 10 is installed in the step 109*ab*, electrical power is supplied to the device 10 in the step 109*ac*. More particularly, after the above-described electrical couplings are made between the device 10 and the wires 110, 112, 114 and 116, electrical power such as, for example, AC electrical power, is supplied by the source 113 to the device 10 in the step 109*ac*. In an exemplary embodiment, AC line power is supplied by the source 113 to the device 10, and the circuit 102 is powered, via the wires 110 and 112. However, the wires 114 and 116 do not correspondingly supply electrical power to the load 118 because the device 10 is in its tripped state. That is, the contact surfaces 78*ca* and 80*ca* are separated from the contact surfaces 70*cb* and 72*cb*, respectively, and thus the stationary contacts 70 and 72 are electrically decoupled from the movable contacts 78 and 80, as described above and illustrated in FIG. 37. Moreover, the receptacle contacts 38 and 40 do not correspondingly supply electrical power to any two-prong or three-prong electrical plug that may be conventionally coupled to the pairs of contacts 38*a* and 40*a*, and/or the pairs of contacts 38*b* and 40*b*. That is, the contact surfaces 38*dea* and 40*dea* are separated from the contact surfaces 70*ca* and 72*ca*, respectively, and thus the stationary contacts 70 and 72 are electrically decoupled from the receptacle contacts 38 and 40, respectively, as described above and illustrated in FIG. 37.

As a result of electrical power being supplied to the circuit 102 via the wire 110 and 112 and the input line terminals 66*a* and 66*b*, the LED 92 emits light, which travels through the light pipe 22 and is visible through the opening 12*b* in the housing 12. More particularly, because the switch formed by the spring 86 and the stationary contact 70 is closed, that is, because the end portion 86*a* is contacting and applying a biasing force against the tab 70*e*, a sub-circuit of the circuit 102 is completed and the LED 92 emits light, with the sub-circuit including at least the stationary contact 70, the spring 86, conventional circuitry on and/or in the circuit board 60, the LED 92, the diode 90, the cable 88 and the stationary contact 72. The light emitted by the LED 92 provides visual confirmation that the device 10 is in its tripped state.

In an exemplary embodiment, after electrical power is supplied to the device 10 in the step 109*ac*, the state of the device 10 is changed from its tripped state to its reset state in the step 109*ad*, as illustrated in FIGS. 39A, 39B, 39C, 39D and 39E.

When the device 10 is in its tripped state as illustrated in FIG. 35A, the device 10 is in the same condition as described above with reference to FIG. 37, except that electrical power is now supplied to the device 10 so that the LED 92 emits light, as described above with reference to FIG. 38.

Figure 39A:
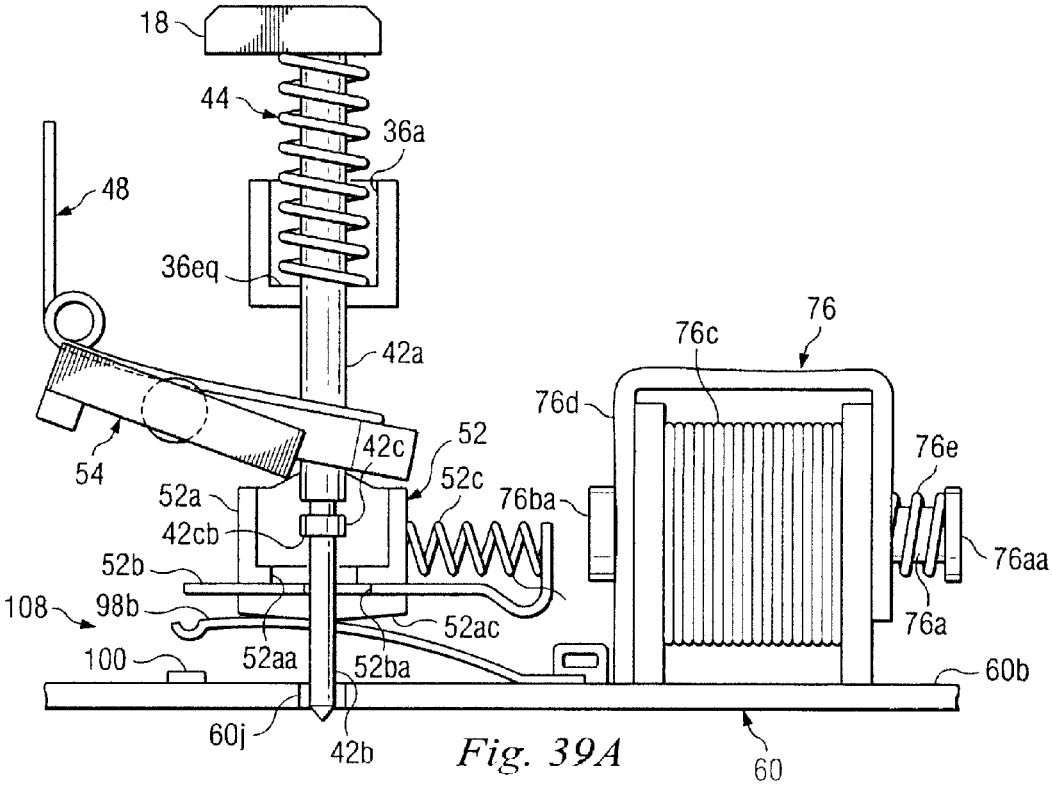
FIGS. 39A, 39B, 39C 39D, and 39E are simplified partial elevational/partial sectional views of the device 10 with several components removed for the purpose of clarity, depicting the state of the device 10 being changed from its tripped state to its reset state.

Moreover, when the device 10 is in its tripped state as further illustrated in FIG. 39A, the spring 44 is an extended condition between the internal shoulder 36 eq of the counterbore 36*a* of the middle housing 36, and the reset button 18, separating the reset button 18 from the counterbore 36*a*. The flange 42*c* of the reset shaft 42 is positioned so that the surface 42*cb* of the flange 42*c* is above the latch 52*b* of the latch assembly 52, with the portion of the reduced-diameter portion 42*b* of the reset shaft 42 below the flange 42*c* extending through the opening 52*aa* of the latch block 52*a*, through the opening 52*ba* of the latch 52*b*, and at least partially into an opening 60*j* in the circuit board 60. The flange 42*c* is positioned so that at least a portion of the surface 42*cb* is positioned over the latch 52*b*, and at least another portion of the surface 42*cb* is positioned over the opening 52*ba* of the latch 52*b*.

The tabs 52*ab* and 52*ac* of the latch block 52*a* of the latch assembly 52 contact the spring arms 98*a* and 98*b*, respectively, of the spring bracket 98. As a result, the spring arms 98*a* and 98*b* prevent the latch assembly 52 from moving towards the surface 60*b* of the circuit board 60. The switch 108 is open, that is, the distal end of the spring arm 98*b* is separated from the contact 100. The spring 76*e* applies a biasing or reaction force against the enlarged-diameter portion 76*aa* of the rod 76*a*, thereby causing the enlarged-diameter end portion 76*ba* of the plunger 76*b* to be biased against the end surface 76*d* of the solenoid assembly 76, and causing the portion 76*ba* to be separated from the distal end portion 52*bd* of the latch 52*b* of the latch assembly 52.

Figure 39B:
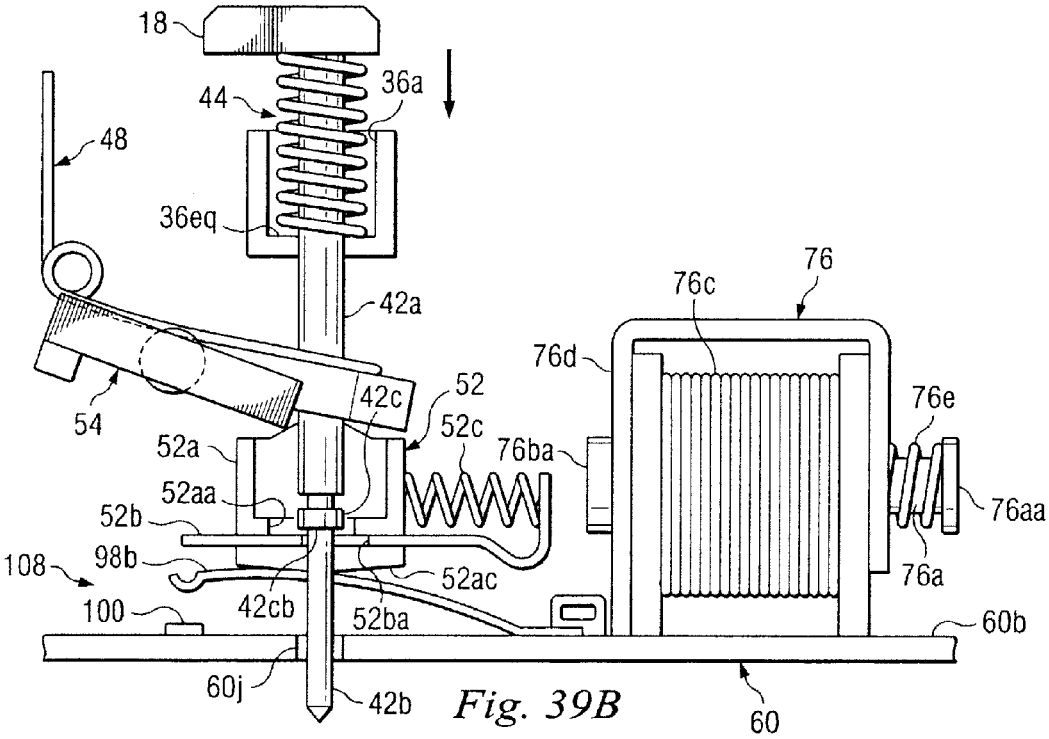

As illustrated in FIG. 39B, to change the state of the device 10 from its tripped state to its reset state, the reset button 18 is moved downward towards the counterbore 36*a* by, for example, having an operator push the reset button 18 downward, as indicated by the arrow in FIG. 39B. In response, the reset shaft 42 moves downward and the spring 44 begins to compress.

During the downward movement of the reset button 18, at least a portion of the surface 42*cb* of the flange 42*fc* approaches and eventually contacts the latch 52*b* of the latch assembly 52. Subsequent downward movement of the reset button 18 causes the spring 44 to compress further, and causes the surface 42*cb* to push the latch 52*b* downward and thus, since the latch 52*b* contacts the L-shaped tabs 52*ab* and 52*ac*, causes the tabs 52*ab* and 52*ac* to push the spring arms 98*a* and 98*b*, respectively, downward as viewed in FIG. 39B.

Figure 39C:
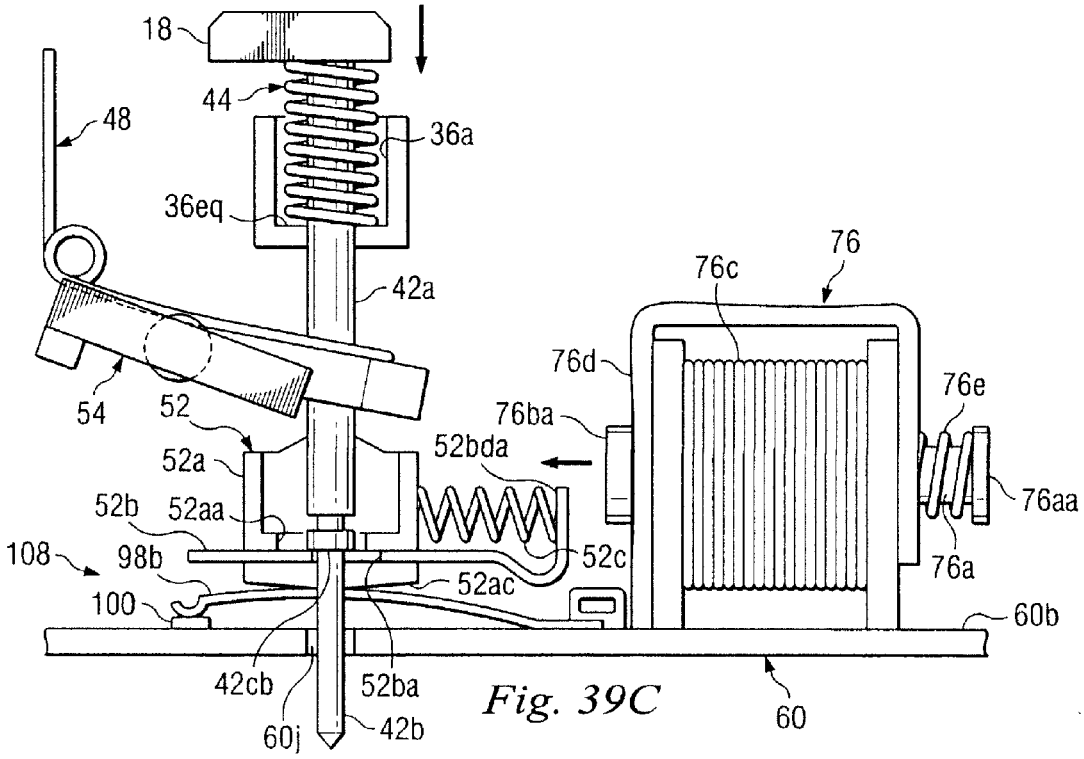

As illustrated in FIG. 39C, continued downward movement of the reset button 18, and thus the reset shaft 42, eventually causes the distal end of the spring arm 98*b* to compress and contact the contact 100, thus closing the switch 108. In response to the closing of the switch 108, the circuit 102 operates to cause a test current to flow to the transformer assembly 62, thereby simulating a ground fault by causing a difference, or an imbalance, between the electrical currents flowing in the contact arms 70*f* and 72*f*. Using the transformer coils 62*c* and 62*d* of the transformer assembly 62 of the sensing device 104, the circuit 102 senses the difference between the electrical currents in the contact arms 70*f* and 72*f*. In response to this sensing by the transformer coils 62*c* and 62*d*, the circuit 102 operates the actuator 106 by energizing the solenoid assembly 76 to cause the rod 76*a* and the plunger 76*b* to move quickly to the left.

Figure 39D:
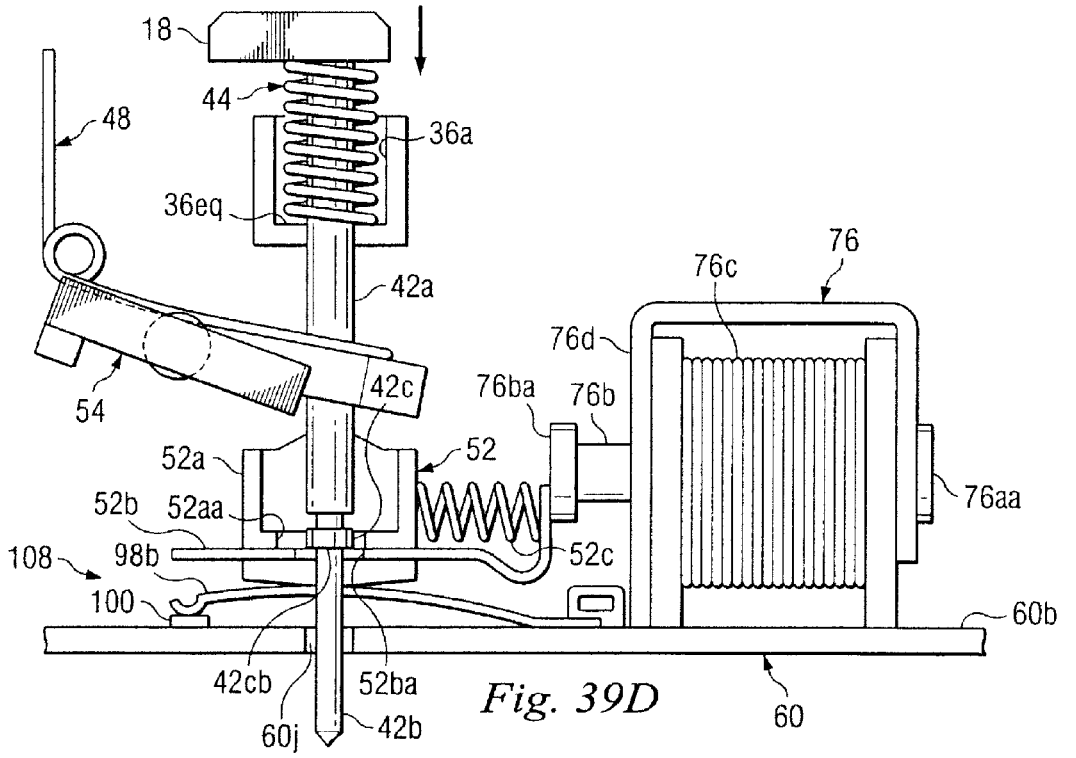

As illustrated in FIG. 39D, during the movement of the rod 76*a* and the plunger 76*b*, the spring 76*e* is compressed and the enlarged-diameter end portion 76*ba* of the plunger 76*b* moves away from the end surface 76*d*, contacting and pushing against the end portion 52*bd* of the latch 52*b*. As a result, the spring 52*c* is compressed between the latch block 52*a* and the surface 52*bda* of the latch 52*b*, and the latch 52*b* slides to the left, along the tabs 52*ab* and 52*ac*, as viewed in FIG. 39D. As a result, the surface 42*cb* of the flange 42*c* of the reset shaft 42 is positioned over the opening 52*ba* of the latch 52*b*, thereby permitting the reset button 18 and the reset shaft 42 to continue their movement downwards, as indicated by the arrow in FIG. 39D. As another result, and because the surface 42*cb* of the flange 42*c* is positioned over the opening 52*ba*, the spring arm 98*b* begins to decompress and move upwards, as viewed in FIG. 39D, pushing the latch block 52*a* upwards, relative to the reset shaft 42, so that the flange 42*c* is positioned below the latch 52*b*.

Figure 39E:
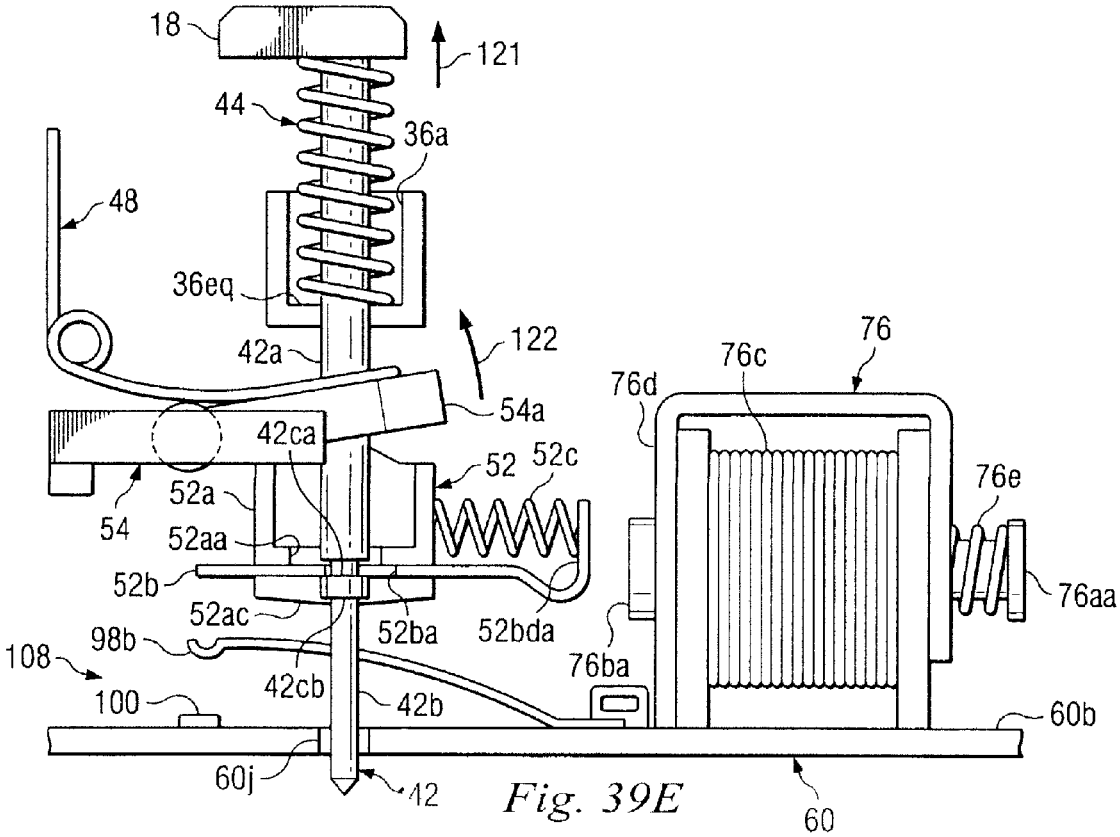

As illustrated in FIG. 39E, continued movement of the spring arm 98*b* causes the switch 108 to open, that is, causes the distal end of the spring arm 98*b* to separate from the contact 100. As a result, the circuit 102 no longer operates to cause a test current to flow to the transformer assembly 62 and thus the above-described simulated ground fault ceases. In response, the circuit 102 no longer operates to energize the solenoid assembly 76 and the spring 76*e* forces the rod 76*a* and the plunger 76*b* to move to the right, as viewed in FIG. 39E, so that the end portion 76*ba* of the plunger 76*b* is again biased against the end surface 76*d* of the solenoid assembly 76. In response, the spring 52*c* of the latch assembly 52 applies a biasing force against the surface 52*ba*, causing the latch 52*b* to slide to the right, as viewed in FIG. 39E, so that the latch 52*b* is positioned between the enlarged-diameter portion 42*a* and the flange 42*c* of the reset shaft 42. The surface 42*ca* of the flange 42*c* is positioned below the latch 52*b*, with at least a portion of the surface 42*ca* being positioned below a surface of the latch 52*b* and at least another portion of the surface 42*ca* being positioned below the opening 52*ba* of the latch 52*b*.

The reset button 18 is released, causing the downward movement of the reset button 18 and the reset shaft 42 to cease. As a result, the spring 44 immediately decompresses and extends upward, thus pushing the reset button 18 upward, as indicated by an arrow 12*l* in FIG. 39E. The reset shaft 42 also moves upward so that the surface 42*ca* contacts the latch 52*b*, thereby causing the latch assembly 52 to also move upward.

As the latch assembly 52 moves upward, the latch block 52*a* approaches and contacts the center portion 54*a* of the cam 54, forcing the cam 54 to rotate in a counterclockwise direction, as viewed in FIG. 39E, and as indicated by an arrow 122, so that the initial biasing force applied by the torsion spring 48 on the cam 54 is overcome. During this rotation, the pins 54*e* and 54*f* of the cam 54 rotate in place, about an imaginary axis defined by the axially-aligned respective longitudinal center axes of the pins 54*e* and 54*f*. During this rotation, the pins 54*e* and 54*f* remain received within the notches 36*eo* and 36*ep*, respectively, of the middle housing 36, and within the notches 74*ac* and 74*ad*, respectively, of the frame 74. The reset button 18, the shaft 42 and the latch assembly 52 continue to move upwards, and the cam 54 continues to rotate until the reaction or biasing force applied by the torsion spring 48 increases to the point that the cam 54 is no longer able to rotate, thereby preventing any further upward movement of the latch block 52*a*, thereby preventing any further upward movement of the reset shaft 42 and the reset button 18. As a result, the device 10 is placed in its reset state.

In an exemplary embodiment, the device 10 is unable to be placed in its reset state in the step 109*ad* if the circuit 102 is nonfunctional, at least with respect to the operation of the solenoid assembly 76 in response to the sensing of the ground fault by the transformer coils 62*c* and 62*d*. In an exemplary embodiment, the device 10 is unable to be placed in its reset state in the step 109*ad* if electrical power is not, or becomes, unavailable to power the circuit 102. In an exemplary embodiment, electrical power may be unavailable as a result of, for example, the wires 110 and 112 being mistakenly electrically coupled to the terminal portions 78*a* and 80*a*, respectively, of the movable contacts 78 and 80. This protects against any incorrect electrical coupling between the device 10 and the wires 110, 112, 114 and 116, and prevents the device 10 from supplying electrical power to the load 118 without ground-fault-interrupt protection by the circuit 102 of the device 10.

Figure 40:
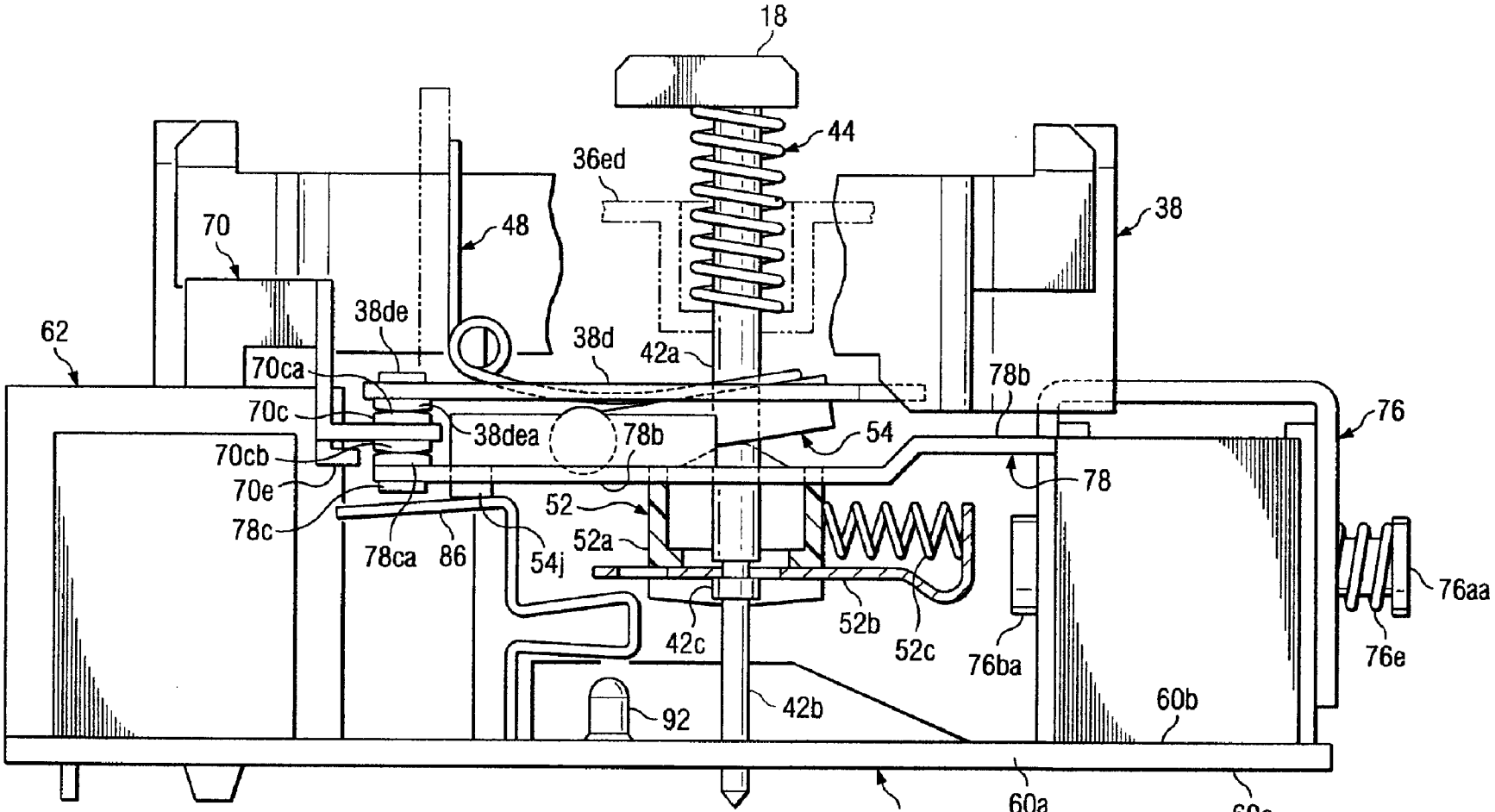
FIG. 40 is a view similar to that of FIG. 37, but depicting the device 10 in its reset state.
Figure 41:
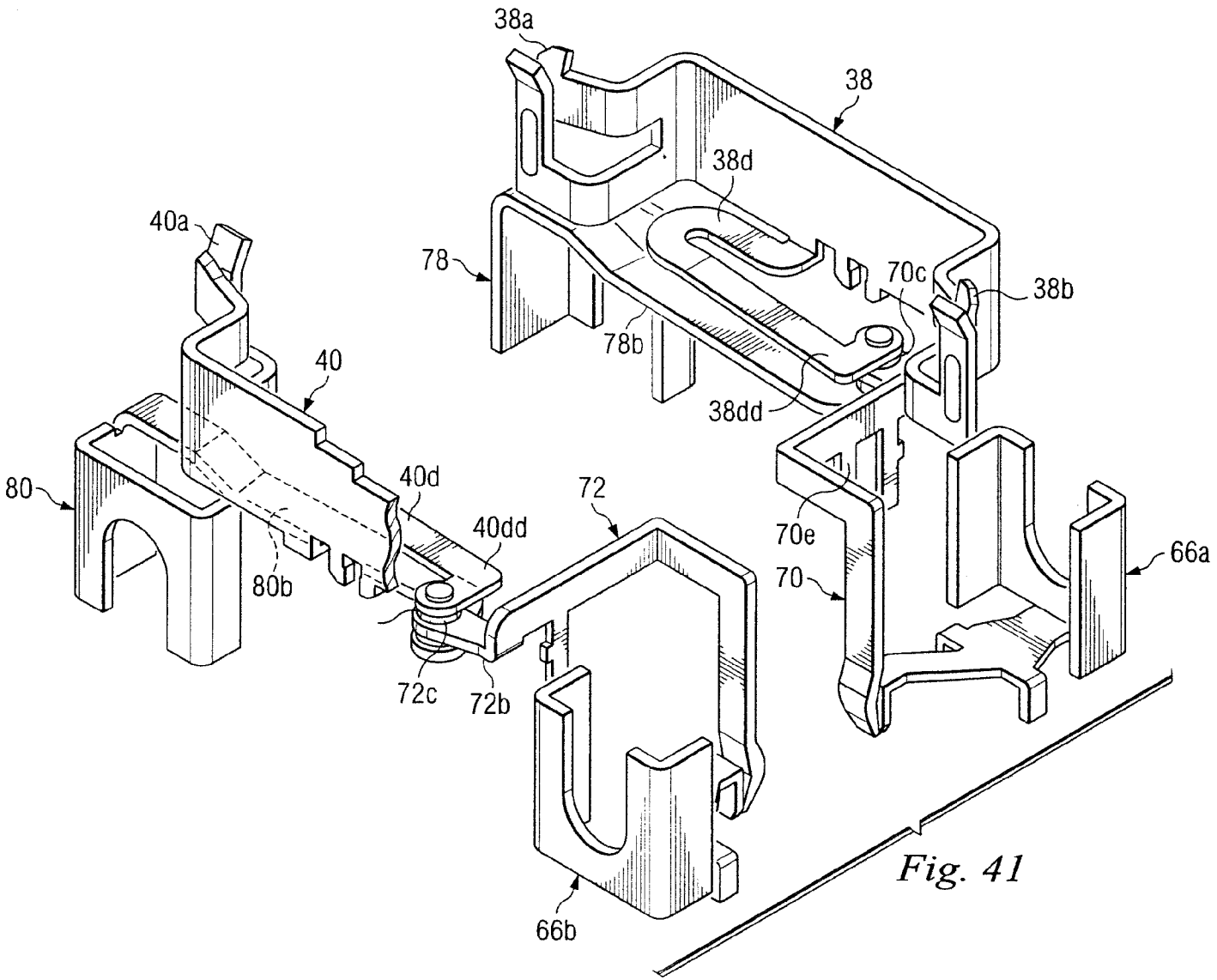
FIG. 41 is a perspective view of the receptacle contacts of FIG. 9 when the device 10 is in its reset state, as shown in FIG. 40.

In an exemplary embodiment, as illustrated in FIGS. 40 and 41, when the device 10 is in its reset state and as a result of the forced rotation of the cam 54 by the latch block 52*a*, the legs 54*g* and 54*h* are generally horizontal so that the end knobs 54*ga* and 54*ha* of the legs 54*g* and 54*h*, respectively, of the cam 54 no longer apply respective forces against the arms 78*b* and 80*b*, respectively, of the movable contacts 78 and 80, respectively. As a result, the distal end portion 78*ba* of the arm 78*b* is permitted to return to its normally biased position, moving upward so that the contact surface 78*ca* of the contact 78*c* of the movable contact 78 contacts the contact surface 70*cb* of the contact 70*c* of the stationary contact 70. Also, the distal end portion 80*ba* of the arm 80*b* is permitted to return to its normally biased position, moving upward so that the contact surface 80*ca* of the contact 80*c* of the movable contact 80 contacts the contact surface 72*cb* of the contact 72*c* of the stationary contact 72. The angle 54*i* of the cam 54 facilitates the ability of the legs 54*g* and 54*h* to be generally horizontal when the device 10 is in its reset state.

The respective upward movements of the distal end portions 78*ba* and 80*ba* are due to the above-described relative arrangement between the tabs 70*b* and 72*b* and the distal end portions 78*ba* and 80*ba*, respectively, according to which the arms 78*b* and 80*b* are normally flexed downward and therefore are spring biased, normally applying biasing forces against the tabs 70*b* and 72*b*, respectively. As a result, the stationary contacts 70 and 72 are no longer electrically isolated from the movable contacts 78 and 80, respectively, and instead are electrically coupled to the movable contacts 78 and 80, respectively.

The spring bias and resulting movement of the arm 78*b* towards the stationary contact 70, and the subsequent electrical coupling between the movable contact 78 and the stationary contact 70, are independent of the spring bias and resulting movement of the arm 80*b* towards the stationary contact 72, and the subsequent electrical coupling between the movable contact 80 and the stationary contact 72. This independence improves the reliability of the device 10. Moreover, this independence makes the device 10 easier to build in that a more complex and demanding design, at least with respect to precision, is not necessary in order to ensure an acceptable electrical coupling between the movable contact 78 and the stationary contact 70, and between the movable contact 80 and the stationary contact 72.

As another result of the forced rotation of the cam 54 by the latch block 52*a*, the end knobs 54*gb* and 54*hb* of the legs 54*g* and 54*h*, respectively, of the cam 54 no longer apply respective forces against the slanted portions 38*dd* and 40*dd*, respectively, of the cantilever arms 38*d* and 40*d*, respectively, of the receptacle contacts 38 and 40, respectively.

As a result, the distal end portion of the slanted portion 38*dd* of the arm 38*d* is permitted to return to its normally biased position, moving downward so that the contact surface 38*dea* of the contact 38*de* of the arm 38*d* of the receptacle contact 38 contacts the surface 70*ca* of the contact 70*c* of the stationary contact 70. Also, the distal end portion of the slanted portion 40*dd* of the arm 40*d* is permitted to return to its normally biased position, moving downward so that the contact surface 40*dea* of the contact 40*de* of the arm 40*d* of the receptacle contact 40 contacts the surface 72*ca* of the contact 72*c* of the stationary contact 72.

The respective upward movements of the distal end portions of the slanted portions 38*dd* and 40*dd* are due to the above-described relative arrangement between the tabs 70*b* and 72*b* and the slanted portions 38*dd* and 40*dd*, respectively, according to which the slanted portions 38*dd* and 40*dd* are normally flexed upward and therefore are spring biased, normally applying biasing forces against the tabs 70*b* and 72*b*, respectively. As a result, the stationary contacts 70 and 72 are no longer electrically isolated from the receptacle contacts 38 and 40, respectively, and instead are electrically coupled to the receptacle contacts 38 and 40, respectively.

The spring bias and resulting movement of the slanted portion 38*dd* towards the stationary contact 70, and the subsequent electrical coupling between the receptacle contact 38 and the stationary contact 70, are independent of the spring bias and resulting movement of the slanted portion 40*dd* towards the stationary contact 72, and the subsequent electrical coupling between the receptacle contact 40 and the stationary contact 72. This independence improves the reliability of the device 10. Moreover, this independence makes the device 10 easier to build in that a more complex and demanding design, at least with respect to precision, is not necessary in order to ensure acceptable electrical coupling between the receptacle contact 38 and the stationary contact 70, and between the receptacle contact 40 and the stationary contact 72.

As another result of the force rotation of the cam 54 by the latch block 52*a*, the stepped protrusion 54*j* of the cam 54 contacts and pushes the end portion 86*a* of the spring 86 downward so that the end portion 86*a* is separated from the L-shaped tab 70*e* of the stationary contact 70. As a result, the spring 86 is electrically decoupled from the stationary contact 70 and thus the switch formed by the spring 86 and the stationary contact 70 is open, thereby causing the LED 92 to cease emitting light. The absence of the emission of light from the LED 92 provides visual confirmation that the device 10 is in its reset state.

When the device 10 is in its reset state, in an exemplary embodiment and as illustrated in FIGS. 40 and 41, the input line terminals 66*a* and 66*b* are electrically coupled to the stationary contacts 70 and 72, respectively. Moreover, the stationary contacts 70 and 72 are electrically coupled to the movable contacts 78 and 80, respectively. The stationary contacts 70 and 72 are also electrically coupled to the receptacle contacts 38 and 40, respectively.

In an exemplary embodiment, after the state of the device 10 has been changed from its tripped state to its reset state in the step 109*ad*, thus completing the initiation of the operation of the device 10 in the step 109*a* of the method 109, the device 10 is then operated in the step 109*b*.

Figure 42:
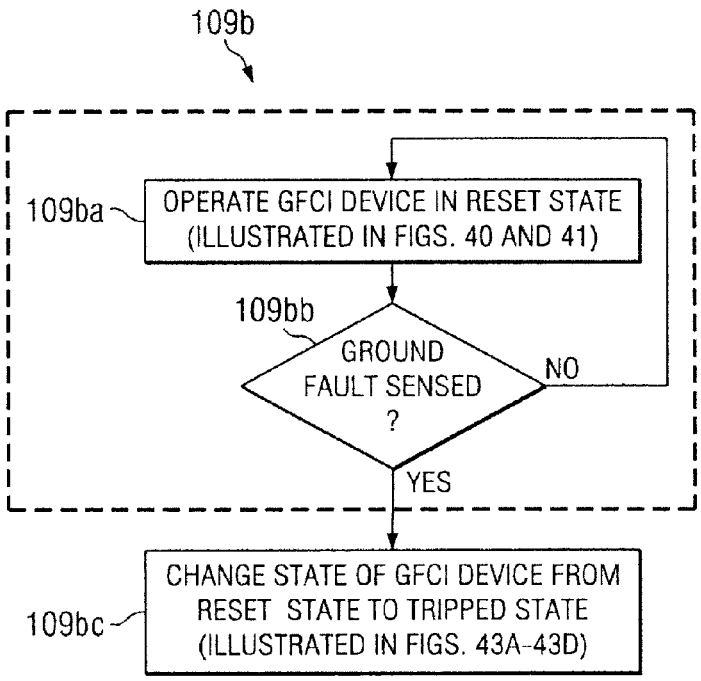
FIG. 42 is a flow chart illustration of an exemplary embodiment of another step of the method of FIG. 34.

In an exemplary embodiment, as illustrated in FIG. 42 with continuing reference to FIGS. 40 and 41, to operate the device 10 in the step 109*b* of the method 109, the device 10 is operated in its reset state in step 109*ba*. During the step 109*ba*, the device 10 remains in the reset state as described above with reference to FIGS. 40 and 41. Electrical power continues to be supplied by the source 113 to the device 10 via the wires 110 and 112, and the circuit 102 is powered. Due to the above-described electrical couplings between the stationary contacts 70 and 72 and the movable contacts 78 and 80, respectively, electrical power is supplied to the load 118 via the wires 114 and 116. Moreover, due to the electrical couplings between the stationary contacts 70 and 72 and the receptacle contacts 38 and 40, respectively, the receptacle contacts 38 and 40 are permitted to supply electrical power to any two-prong or three-prong electrical plug that may be conventionally coupled to the pairs of contacts 38*a* and 40*a*, and/or the pairs of contacts 38*b* and 40*b*.

During the step 109*ba*, the device 10 is continually operating to determine whether a ground fault has occurred in step 109*bb*. If no ground fault is sensed in the step 109*bb*, the device 10 continues to operate in its reset state in the step 109*ba*, as described above. If a ground fault is sensed in the step 109*bb*, the state of the device 10 is changed from its reset state to its tripped state in step 109*bc*.

More particularly, as electrical power is supplied to the load 118, electrical current flows through the stationary contact 70, the movable contact 78 and the wire 110, and to the load 118. Electrical current also flows from the load 118 and through the wire 112, the movable contact 80 and the stationary contact 72.

Also, as electrical power is supplied to any two-prong or three-prong electrical plug that may be coupled to the pairs of contacts 38*a* and 40*a*, and/or the pairs of contacts 38*b* and 40*b*, electrical current flows through the stationary contact 70 and the receptacle contact 38 and to the pairs of contacts 38*a* and/or 38*b*. Electrical current also flows from the pairs of contacts 38*b* and/or 40*b* and through the receptacle contact 40 and the stationary contact 72.

In the step 109*bb*, a ground fault is not sensed if the electrical current flowing through the stationary contact 70 is approximately equal and opposite to the electrical current flowing through the stationary contact 72.

In the step 109*bb*, a ground fault is sensed if a difference, or an imbalance, between the respective electrical currents flowing in the stationary contacts 70 and 72 is detected, and the imbalance reaches a predetermined threshold. More particularly, using the transformer coils 62*c* and 62*d* of the transformer assembly 62 of the sensing device 104, the circuit 102 senses the difference or imbalance between the electrical currents in the contact arms 70*f* and 72*f* of the stationary contacts 70 and 72, respectively. If this difference or imbalance reaches the predetermined threshold, a ground fault is sensed in the step 109*bb*.

In the step 109*bb*, a ground fault may be sensed in response to a wide variety of conditions. For example, a short circuit may occur in the load 118 and the path may be to ground instead of to neutral via the wire 112. For another example, a short circuit may occur in a load electrically coupled to any plug coupled to the pairs of contacts 38*a* and 40*a*, or to the pairs of contacts 38*b* and 40*b*.

As noted above, the state of the device 10 is changed from its reset state to its tripped state in the step 109*bc* if the presence of a ground fault is sensed by the transformer coils 62*c* and 62*d* in the step 109*bb*.

Figure 43A:
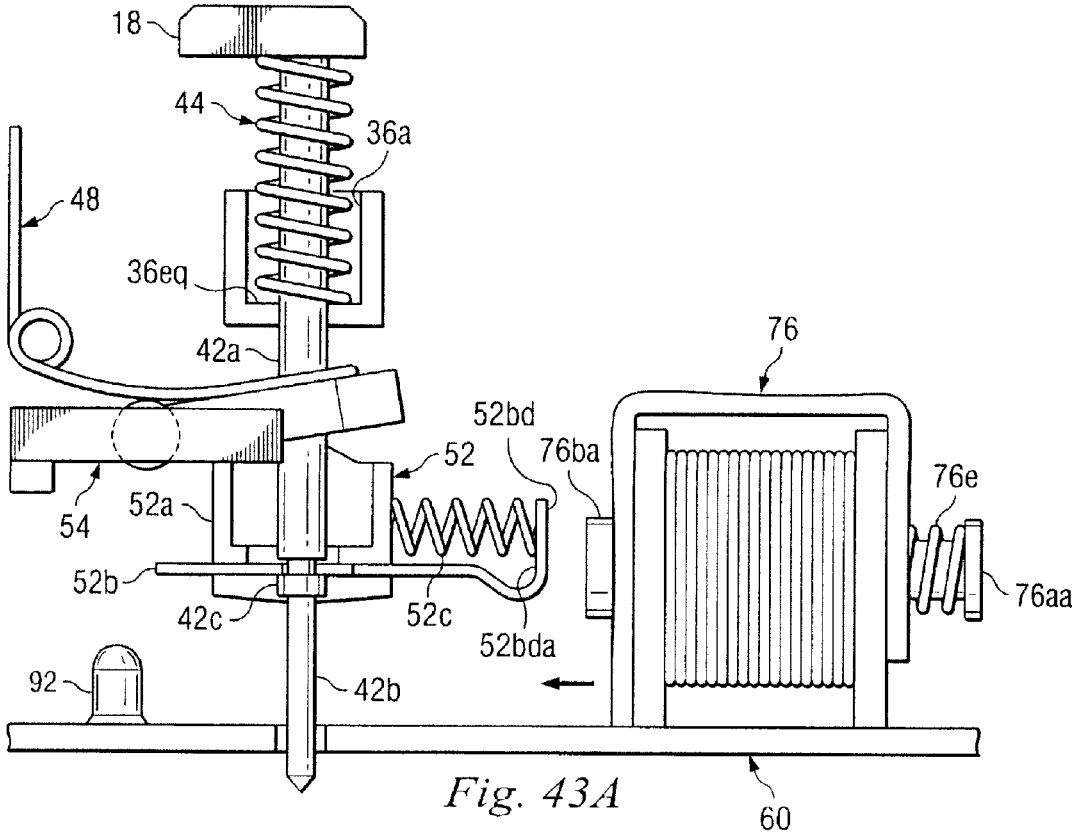
FIGS. 43A, 43B, 43C, and 43D are simplified partial elevational/partial sectional views of the device 10 with several components removed for the purpose of clarity, depicting the state of the device 10 being changed from its reset state to its tripped state.

In an exemplary embodiment, as illustrated in FIGS. 43A, 43B, 43C and 43D, to change the state of the device 10 from its reset state to its tripped state in the step 109*bc*, the circuit 102 operates to energize the solenoid assembly 76, causing the rod 76*a* and the plunger 76*b* to move quickly to the left, as indicated by the arrow in FIG. 43A.

Figure 43B:
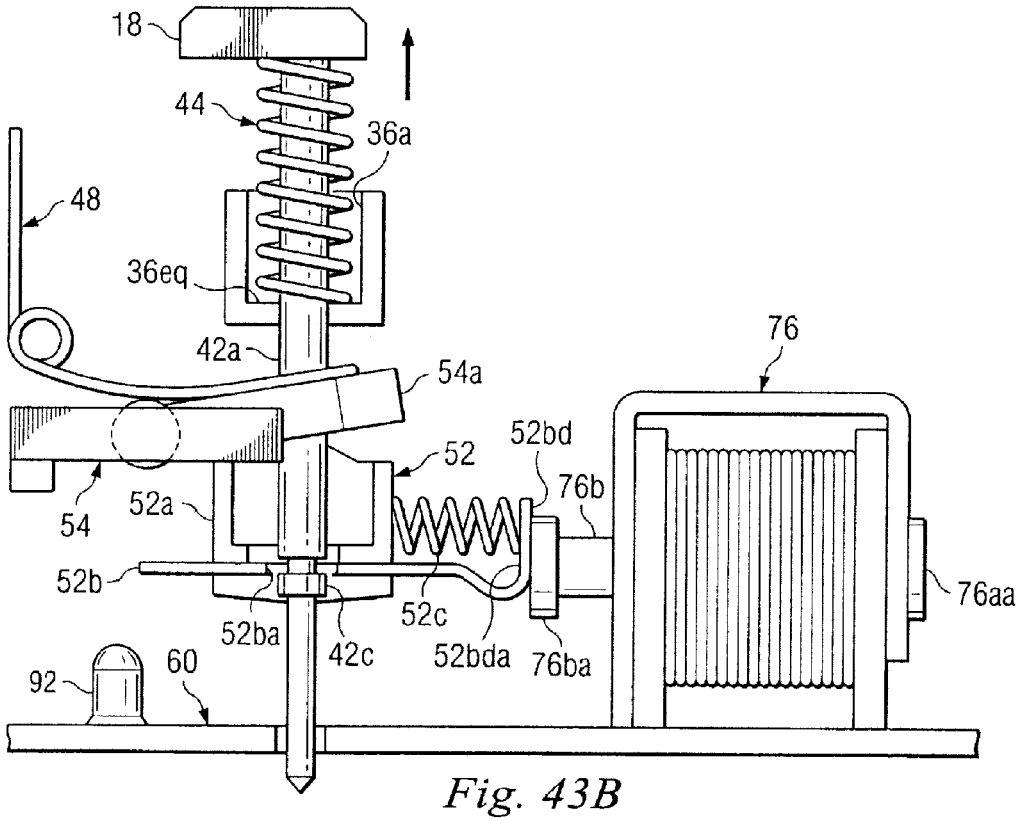

In an exemplary embodiment, as illustrated in FIG. 43B, during the movement of the rod 76*a* and the plunger 76*b*, the spring 76*e* is compressed and the enlarged-diameter end portion 76*ba* of the plunger 76*b* moves away from the end surface 76*d*, contacting and pushing against the end portion 52*bd* of the latch 52*b*. As a result, the spring 52*c* is compressed between the latch block 52*a* and the surface 52*bda* of the latch 52*b*, and the latch 52*b* slides to the left, along the tabs 52*ab* and 52*ac*, as viewed in FIG. 43B. As a result, the flange 42*c* of the reset shaft 42 is positioned below the opening 52*ba* of the latch 52*b* without any portion of the flange 42*c* being positioned below a surface defined by the latch 52*b*, thereby permitting the spring 44 to further decompress and extend upwards. As a result, the reset shaft 42 and the reset button 18 move upwards, as indicated by the arrow in FIG. 43B.

Figure 43C:
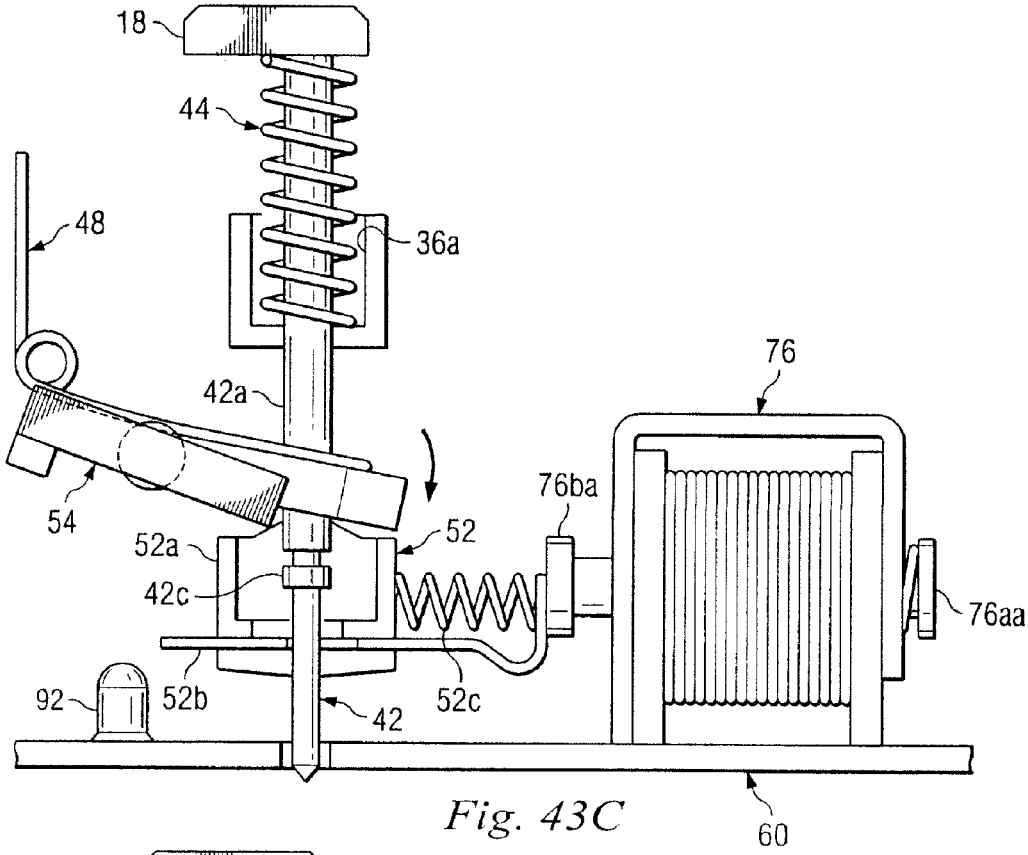

In an exemplary embodiment, as illustrated in FIG. 43C, as a result of the upward movement of the reset shaft 42, the flange 42*c* of the reset shaft 42 is positioned above the latch 52*b*. Due to the position of the flange 42*c*, the latch block 52*a* no longer appreciably resists the biasing force applied on the cam 54 by the torsion spring 48. Thus, the torsion spring 48 causes the cam 54 to rotate in a clockwise direction as viewed in FIG. 43C, and as indicated by the arrow in FIG. 43C. The torsion spring 48 forces the cam 54 to rotate until the center portion 54*a* of the cam 54 contacts the walls 74*ae* and 74*af* of the frame 74, at which point the cam 54 ceases to rotate.

As a result of the forced rotation of the cam 54 by the torsion spring 48, the end knobs 54*ga* and 54*ha* of the legs 54*g* and 54*h*, respectively, of the cam 54 apply respective forces against the arms 78*b* and 80*b*, respectively, of the movable contacts 78 and 80, respectively, thereby pushing the arms 78*b* and 80*b* downward as viewed in FIG. 37. As a result, the contact surface 78*ca* of the contact 78*c* of the movable contact 78 is separated from the contact surface 70*cb* of the contact 70*c* of the stationary contact 70, and the contact surface 80*ca* of the contact 80*c* of the movable contact 80 is separated from the contact surface 72*cb* of the contact 72*c* of the stationary contact 72. As a result of this separation, there is no electrical coupling between the contact surfaces 78*ca* and 70*cb*, and between the contact surfaces 80*ca* and 72*cb*, and thus the movable contacts 78 and 80 are electrically isolated from the stationary contacts 70 and 72, respectively.

As another result of the forced rotation of the cam 54 by the torsion spring 48, the end knobs 54*gb* and 54*hb* of the legs 54*g* and 54*h*, respectively, of the cam 54 at least partially extend into the openings 36*n* and 36*o*, respectively, of the middle housing 36, and apply forces against the slanted portions 38*dd* and 40*dd*, respectively, of the cantilever arms 38*d* and 40*d*, respectively, of the receptacle contacts 38 and 40, respectively, thereby pushing the slanted portions 38*dd* and 40*dd* upward as viewed in FIG. 37. As a result, the contact surface 38*dea* of the contact 38*de* of the arm 38*d* is separated from the contact surface 70*ca* of the contact 70*c* of the stationary contact 70, and the contact surface 40*dea* of the contact 40*de* of the arm 40*d* is separated from the contact surface 72*ca* of the contact 72*c* of the stationary contact 72. As a result of this separation, there is no electrical coupling between the contact surfaces 38*dea* and 70*ca*, and between the contact surface 40*dea* and 72*ca*, and thus the receptacle contacts 38 and 40 are electrically isolated from the stationary contacts 70 and 72, respectively.

As described above, as a result of the rotation of the cam 54, the stationary contacts 70 and 72 are each independently electrically decoupled from the movable contacts 78 and 80, respectively, because of the above-described separation between the contact surfaces 78*ca* and 80*ca* and the contact surfaces 70*cb* and 72*cb*. Moreover, the stationary contacts 70 and 72 are each independently electrically decoupled from the receptacle contacts 38 and 40, respectively, because of the above-described separation between the contact surfaces 38*dea* and 40*dea* and the contact surfaces 70*ca* and 72*ca*, respectively.

Figure 43D:
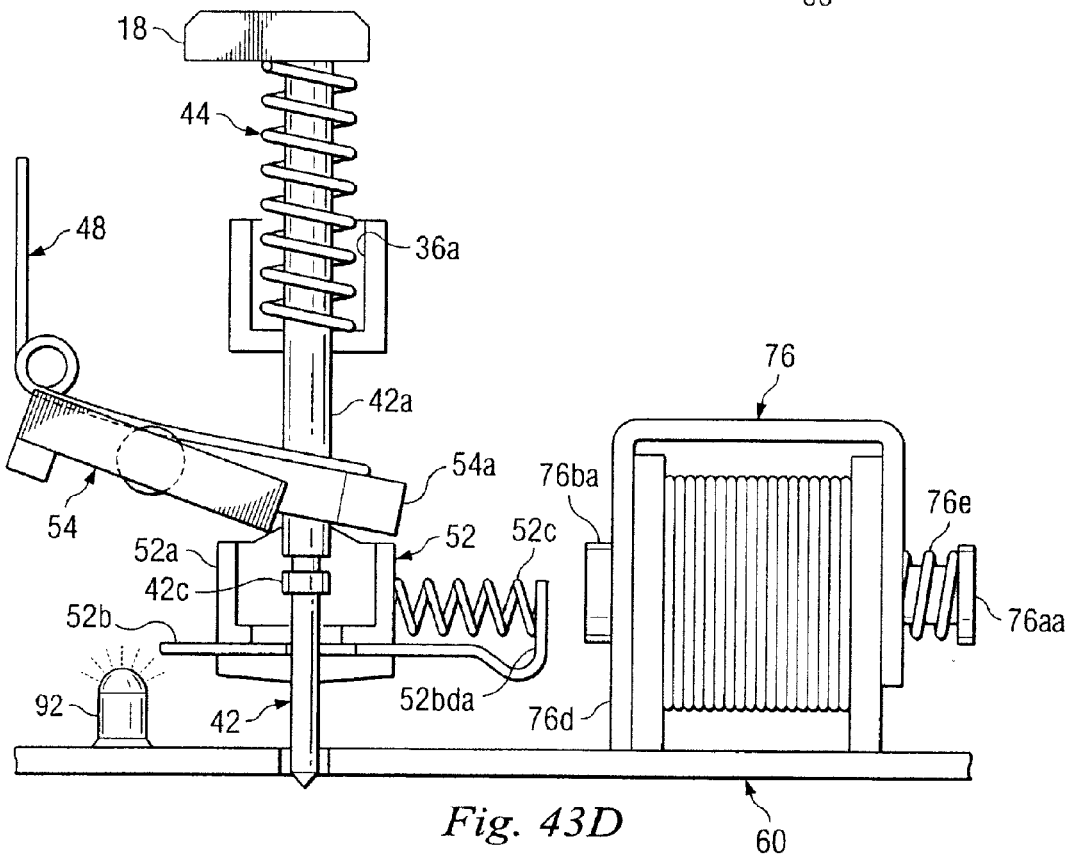

In an exemplary embodiment, as illustrated in FIG. 43D, and as a result of the movable contacts 78 and 80 being electrically decoupled from the stationary contacts 70 and 72, respectively, and the receptacle contacts 38 and 40 being electrically decoupled from the stationary contacts 70 and 72, respectively, electrical current no longer flows through the contact arms 70*f* and 72*f* of the stationary contacts 70 and 72, respectively. As a result, the transformer coils 62*c* and 62*d* of the transformer assembly 62 of the sensing device 104 no longer sense a ground fault and thus the solenoid assembly 76 is de-energized, causing the spring 76*e* to force the rod 76*a* and the plunger 76*b* to move to the right, as viewed in FIG. 43D, so that the end portion 76*ba* of the plunger 76*b* is again biased against the end surface 76*d* of the solenoid assembly 76. In response, the spring 52*c* of the latch assembly 52 applies a biasing force against the surface 52*bda*, causing the latch 52*b* to slide to the right, as viewed in FIG. 43D, so that the surface 42*cb* of the flange 42*c* is positioned above the latch 52*b*, with at least a portion of the surface 42*cb* being positioned above a surface of the latch 52*b* and at least another of the surface 42*cb* being positioned above the opening 52*ba* of the latch 52*b*.

Also, as another result of the forced rotation of the cam 54 by the torsion spring 48, the stepped protrusion 54*j* of the cam 54 is separated from the end portion 86*a* of the spring 86, thereby permitting the end portion 86*a* of the spring 86 to return to its normally biased position against the L-shaped tab 70*e* of the stationary contact 70, contacting and applying a biasing or reaction force against the L-shaped tab 70*e*. As a result, the spring 86 is electrically coupled to the stationary contact 70 and thus the switch formed by the spring 86 and the stationary contact 70 is closed, causing the LED 92 to emit light, as indicated in FIG. 39D. The emitted light travels through the light pipe 22 and is visible through the opening 12*b* in the housing 12. The light emitted by the LED 92 provides visual confirmation that the device 10 is in its tripped state. The spring bias of the spring 86, which causes the upward movement of the end portion 86*a* of the spring 86, improves the reliability of the switch formed by the spring 86 and the stationary contact 70, and provides a low-cost switch design.

When the device 10 is in its tripped state as illustrated in FIG. 43D, the device 10 is in the same condition as described above with reference to FIG. 39A, and is in the same condition as described above with reference to FIG. 37, except that the LED 92 emits light, as described above.

In an exemplary embodiment, and as noted above, if the state of the device 10 is changed from its reset state to its tripped state during the operation of the device 10 in the step 109*b*, then the device 10 is reset in the step 109*c* of the method 109.

Figure 44:
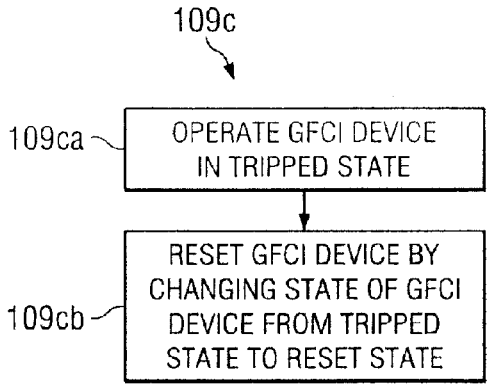
FIG. 44 is a flow chart illustration of an exemplary embodiment of yet another step of the method of FIG. 34.

In an exemplary embodiment, in the step 109*c* and as illustrated in FIG. 44, the device 10 first operates in its tripped state in step 109*ca*. More particularly, the LED 92 emits light, and electrical power is supplied by the source 113 to the device 10, and thus to the circuit 102, via the wires 110 and 112. However, the wires 114 and 116 do not correspondingly supply electrical power to the load 118 because the device 10 is in its tripped state. That is, the contact surfaces 78*ca* and 80*ca* are separated from the contact surfaces 70*cb* and 72*cb*, respectively, and thus the stationary contacts 70 and 72 are electrically decoupled from the movable contacts 78 and 80, as described above and illustrated in FIG. 37. Moreover, the receptacle contacts 38 and 40 do not correspondingly supply electrical power to any two-prong or three-prong electrical plug that may be coupled to the pairs of contacts 38*a* and 40*a*, and/or to the pairs of contacts 38*b* and 40*b*. That is, the contact surfaces 38*dea* and 40*dea* are separated from the contact surfaces 70*ca* and 72*ca*, respectively, and thus the stationary contacts 70 and 72 are electrically decoupled from the receptacle contacts 38 and 40, respectively, as described above and illustrated in FIG. 37.

In the step 109*c*, the device 10 is operated in its tripped state in the step 109*ca* and then, in step 109*cb*, the device 10 is reset by changing the state of the device 10 from its tripped state to its reset state. The changing of the state of the device 10 from its tripped state to its reset state in the step 109*cb* is substantially identical to the changing of the state of the device 10 from its tripped state to its reset state in the step 109*ad*, as described above and illustrated in FIGS. 39A, 39B, 39C, 39D and 39E, and therefore the step 109*cb* will not be described in detail.

In an exemplary embodiment, the device 10 is unable to be placed in its reset state in the step 109*cb* if the circuit 102 is nonfunctional, at least with respect to the operation of the solenoid assembly 76 in response to the sensing of the ground fault by the transformer coils 62*c* and 62*d*.

In an exemplary embodiment, the device 10 is unable to be placed in its reset state in the step 109*cb* if electrical power is not, or becomes, unavailable to power the circuit 102. In an exemplary embodiment, electrical power may be unavailable as a result of, for example, the wires 110 and 112 being mistakenly electrically coupled to the terminal portions 78*a* and 80*a*, respectively, of the movable contacts 78 and 80. This protects against any incorrect electrical coupling between the device 10 and the wires 110, 112, 114 and 116, and prevents the device 10 from supplying electrical power to the load 118 without ground-fault-interrupt protection by the circuit 102 of the device 10.

In an exemplary embodiment, and as noted above, the method 109 also includes optionally testing the device 10 in the step 109*d*.

Figure 45:
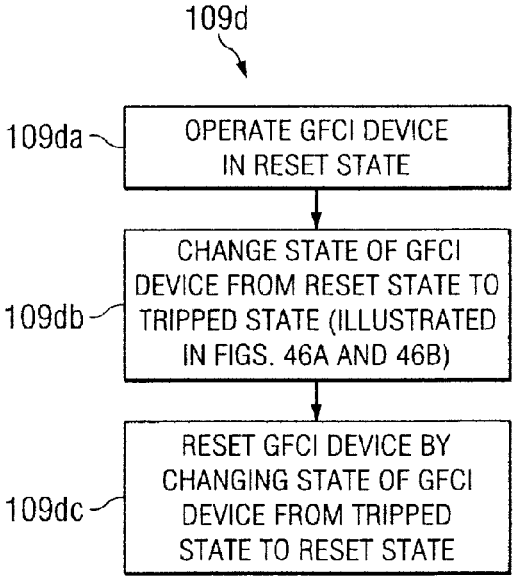
FIG. 45 is a flow chart illustration of an exemplary embodiment of still yet another step of the method of FIG. 34.

In an exemplary embodiment, as illustrated in FIG. 45, optionally testing the device 10 in the step 109*d* includes operating the device 10 in its reset state in step 109*da*, changing the state of the device 10 from its reset state to its tripped state in step 109*db*, and resetting the device 10 in step 109*dc*.

In an exemplary embodiment, operating the device 10 in its reset state in the step 109*da* is substantially identical to operating the device 10 in its reset state in the step 109*ba* of the step 109*b* of the method 109, as described above and illustrated in FIGS. 36 and 37, and therefore the step 109*da* will not be described in detail.

Figure 46A:
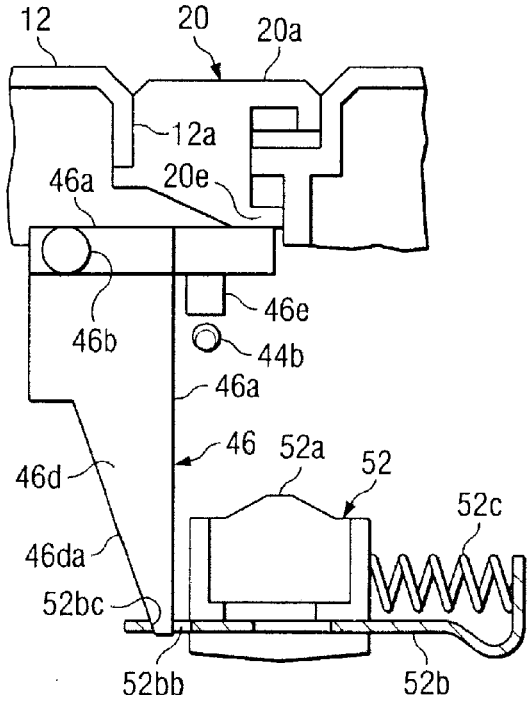
FIGS. 46A and 46B are partial elevational/partial sectional views of a spring depicted in FIG. 3, the actuator of FIG. 7, the latch assembly of FIGS. 13A and 13B, the test button of FIG. 31 and the top housing of FIG. 32, depicting the state of the device 10 being changed from its reset state to its tripped state.

In an exemplary embodiment, as illustrated in FIG. 46A, when the device 10 is in its reset state in the step 109*ba*, the protrusion 46*d* of the actuator 46 extends downward between the walls 36*eb* and 36*ec* of the middle housing 36, between the opposing legs of the U-shaped portion 48*c* of the torsion spring 48, and into the opening 52*bb* so that at least the distal end of the protrusion 46*d* is at least partially positioned in the opening 52*bb*, as described above. The protrusion 46*e* extends downward into the region 36*m*, and contacts the leg 44*b* of the spring 44. The protrusion 20*e* of the test button 20 is supported by the planar portion 46*a* of the actuator 46. As noted above, the test button 20 is captured within the opening 12*a* of the top housing 12, and is permitted to move up and down over a limited range of vertical movement.

Figure 46B:
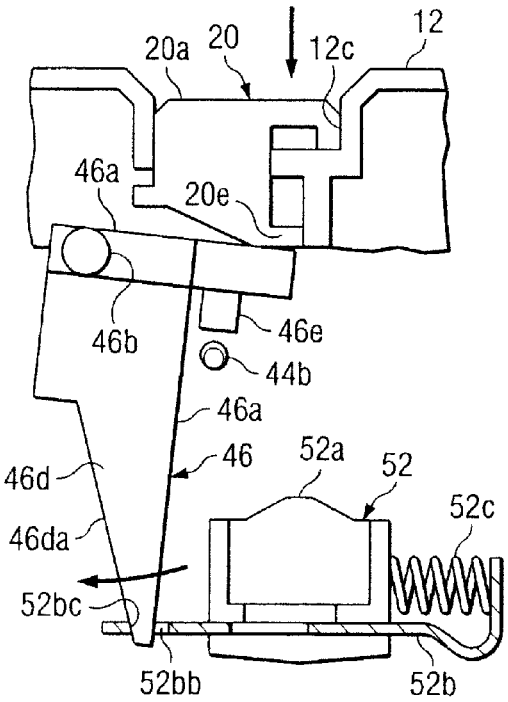

In an exemplary embodiment, as illustrated in FIG. 46B, to change the state of the device 10 from its reset state to its tripped state in the step 109*db*, the top surface of the protrusion 20*a* of the test button 20 is pressed downward, as viewed in FIG. 46B. As a result, the protrusion 20*e* of the test button pushes at least a portion of the planar portion 46*a* downward, causing the actuator 46 to rotate in place in a clockwise direction as viewed in FIG. 46B, with the tabs 46*b* and 46*c* rotating in place in the notches 36*ee* and 36*da*, respectively, of the middle housing 36. As a result of the rotation of the actuator 46, the slanted surface 46*da* of the protrusion 46*d* applies a force against the surface 52*bc*, causing the latch 52*b* of the latch assembly 52 to slide to the left, as viewed in FIG. 46B. Therefore, instead of the transformer coils 62*c* and 62*d* sensing a ground fault to energize the solenoid assembly 76 to slide the latch 52*b* to the left, the latch 52*b* is slid to the left by the operation of the actuator 46, as viewed in FIG. 46B.

As a result of the latch 52*b* sliding to the left as viewed in FIG. 46B, the state of the device 10 is changed from its reset state to its tripped state in a manner substantially similar to the manner described above in connection with the step 109*bc*, and as illustrated in FIGS. 43A, 43B, 43C and 43D, and therefore will not be described in detail, except that the plunger 76*b* of the solenoid assembly 76 remains stationary throughout the step 109*db*, with the solenoid assembly 76 being neither energized nor de-energized during the step 109*db*. That is, instead of the solenoid assembly 76 being energized in order to slide the latch 52*b* to the left, as viewed in FIG. 46B, the actuator 46 rotates in order to slide the latch 52*b* to the left, as described above. And instead of the solenoid assembly 76 being de-energized in order for the spring 52*c* to cause the latch 52*b* to slide to the right, as viewed in FIG. 46B, the test button 20 is released, thereby permitting the arm 44*b* of the spring 44 to rotate the actuator 46 in place in a counterclockwise direction as viewed in FIG. 46B, which, in turn, causes the slanted surface 46*da* of the protrusion 46 to cease applying a force against the surface 52*bc* of the latch 52*b*, thereby permitting the spring 52*c* to cause the latch 52*b* to slide to the right.

In an exemplary embodiment, as noted above, after the state of the device 10 is changed from its reset state to its tripped state in the step 109*db*, the device 10 is reset in the step 109*dc*. To reset the device 10 in the step 109*dc*, the state of the device 10 is changed from its tripped state to its reset state. The changing of the state of the device 10 from its tripped state to its reset state in the step 109*dc* is substantially identical to the changing of the state of the device 10 from its tripped state to its reset state in the step 109*ad*, as described above and illustrated in FIGS. 39A, 39B, 39C, 39D and 39E. Therefore, the step 109*dc* will not be described in detail.

In an exemplary embodiment, the device 10 is unable to be placed in its reset state in the step 109*dc* if the circuit 102 is nonfunctional, at least with respect to the operation of the solenoid assembly 76 in response to the sensing of the ground fault by the transformer coils 62*c* and 62*d*. In an exemplary embodiment, the device 10 is unable to be placed in its reset state in the step 109*dc* if electrical power is not, or becomes, unavailable to power the circuit 102. In an exemplary embodiment, electrical power may be unavailable as a result of, for example, the wires 110 and 112 being mistakenly electrically coupled to the terminal portions 78*a* and 80*a*, respectively, of the movable contacts 78 and 80. This protects against any incorrect electrical coupling between the device 10 and the wires 110, 112, 114 and 116, and prevents the device 10 from supplying electrical power to the load 118 without ground-fault-interrupt protection by the circuit 102 of the device 10.

After resetting the device 10 in the step 109*dc*, the testing of the device 10 in the step 109*d* of the method 109 is completed. If the device 10 is successfully reset in the step 109*dc*, as described above, then the testing of the device 10 in the step 109*d* is successful.

A device has been described that includes a first stationary contact; a first movable arm adapted to be controllably electrically coupled to the first stationary contact; and a cam adapted to rotate in place and positioned, relative to the first movable arm, so that at least a portion of the first movable arm moves, relative to the first stationary contact, in response to the rotation of the cam. In an exemplary embodiment, the device comprises a second movable arm adapted to be controllably electrically coupled to the first stationary contact; wherein the cam is positioned, relative to the first and second movable arms, so that at least portions of the first and second movable arms move, relative to the first stationary contact, in response to the rotation of the cam. In an exemplary embodiment, the cam and the first and second movable arms are positioned so that the at least portions of the first and second movable arms move away from the first stationary contact in response to the rotation of the cam in a first direction. In an exemplary embodiment, the cam and the first and second movable arms are positioned so that the at least portions of the first and second arms move towards the first stationary contact in response to the rotation of the cam in a second direction. In an exemplary embodiment, the first and second movable arms are electrically decoupled from the first stationary contact in response to the rotation of the cam in a first direction. In an exemplary embodiment, the first and second movable arms are electrically coupled to the first stationary contact in response to the rotation of the cam in a second direction. In an exemplary embodiment, the cam and the first and second movable arms are positioned so that the at least portions of the first and second movable arms move away from the first stationary contact in opposite directions in response to the rotation of the cam in a first direction. In an exemplary embodiment, the cam and the first and second movable arms are positioned so that the at least portions of the first and second arms move towards the first stationary contact and towards each other in response to the rotation of the cam in a second direction. In an exemplary embodiment, the device comprises a second stationary contact; and third and fourth movable arms adapted to be controllably electrically coupled to the second stationary contact; wherein at least portions of the third and fourth movable arms move, relative to the second stationary contact, in response to the rotation of the cam. In an exemplary embodiment, the cam and the first, second, third and fourth movable arms are positioned so that the at least portions of the first and second movable arms move away from the first stationary contact in response to the rotation of the cam in a first direction; and the at least portions of the third and fourth movable arms move away from the second stationary contact in response to the rotation of the cam in the first direction. In an exemplary embodiment, the cam and the first, second, third and fourth movable arms are positioned so that the at least portions of the first and second arms move towards the first stationary contact in response to the rotation of the cam in a second direction; and the at least portions of the third and fourth arms move towards the second stationary contact in response to the rotation of the cam in the second direction. In an exemplary embodiment, the first and second movable arms are electrically decoupled from the first stationary contact in response to the rotation of the cam in a first direction; and wherein the third and fourth movable arms are electrically decoupled from the second stationary contact in response to the rotation of the cam in the first direction. In an exemplary embodiment, the first and second movable arms are electrically coupled to the first stationary contact in response to the rotation of the cam in a second direction; and wherein the third and fourth movable arms are electrically coupled to the second stationary contact in the response to the rotation of the cam in the second direction. In an exemplary embodiment, the cam and the first, second, third and fourth movable arms are positioned so that the at least portions of the first and second movable arms move away from the first stationary contact in opposite directions in response to the rotation of the cam in a first direction; and the at least portions of the third and fourth movable arms move away from the second stationary contact in opposite directions in response to the rotation of the cam in the first direction. In an exemplary embodiment, the cam and the first, second, third and fourth movable arms are positioned so that the at least portions of the first and second arms move towards the first stationary contact and towards each other in response to the rotation of the cam in a second direction; and the at least portions of the third and fourth arms move towards the second stationary contact and towards each other in response to the rotation of the cam in the second direction. In an exemplary embodiment, the device comprises a sensing device operably coupled to the first and second stationary contacts wherein the sensing device is adapted to sense an imbalance between respective electrical currents in the first and second stationary contacts. In an exemplary embodiment, an actuator operably coupled to the sensing device; wherein the actuator is adapted to actuate in response to the sensing of the imbalance by the sensing device; and wherein the cam rotates in place in response to the actuation of the actuator. In an exemplary embodiment, the sensing device comprises a transformer assembly and the actuator comprises a solenoid assembly. In an exemplary embodiment, the device is a ground fault circuit interrupter device and is adapted to supply electrical power to a load. In an exemplary embodiment, the device is adapted to supply electrical power to the load when the load is electrically coupled to the first and third movable arms; the first movable arm is electrically coupled to the first stationary contact; and the third movable arm is electrically coupled to the second stationary contact. In an exemplary embodiment, the cam comprises a center portion; and first and second legs coupled to the center portion and spaced in a parallel relation, one of the first and second legs being adapted to contact the first movable arm; wherein an angle is defined between the center portion and the first and second legs. In an exemplary embodiment, the first movable arm is spring biased towards the first stationary contact; and wherein a first configuration in which the one of the first and second legs contacts the first movable arm and is positioned so that the one of the first and second legs resists the spring bias of the first movable arm, and the at least a portion of the first movable arm is electrically decoupled from the first stationary contact; and a second configuration in which the one of the first and second legs is positioned so that the first movable arm is permitted to be electrically coupled to the first stationary contact in response to its own spring bias. In an exemplary embodiment, the cam further comprises axially-aligned first and second pins extending between the center portion and the first and second legs, respectively; wherein an axis is defined by the respective longitudinal center axes of the axially-aligned first and second pins; and wherein the cam is adapted to rotate in place about the axis. In an exemplary embodiment, a switch, the switch comprises the first stationary contact; and a spring, a distal end portion of which is spring biased towards the first stationary contact; wherein the switch comprises an open configuration in which the distal end portion is separated from the first stationary contact and a closed configuration in which the distal end portion contacts the first stationary contact. In an exemplary embodiment, the switch is placed in the open configuration in response to the rotation of the cam in a first direction; and wherein the switch is placed in the closed configuration in response to the rotation of the cam in a second direction. In an exemplary embodiment, the device further comprises a light-emitting diode electrically coupled to the switch, wherein the diode is adapted to emit light when the switch is in the closed configuration. In an exemplary embodiment, the cam further comprises a protrusion extending from one of the first and second legs; wherein the protrusion is adapted to contact and separate the distal end portion of the spring from the first stationary contact, thereby placing the switch in the open configuration, in response to the rotation of the cam in the first direction.

A method has been described that includes providing a first stationary contact and a first movable arm adapted to be controllably electrically coupled thereto; rotating a cam in a first direction; and electrically decoupling the first movable arm from the first stationary contact in response to rotating the cam in the first direction. In an exemplary embodiment, the method comprises rotating the cam in a second direction; and electrically coupling the first movable arm to the first stationary contact in response to rotating the cam in the second direction. In an exemplary embodiment, the method comprises sensing the presence of a ground fault; wherein rotating the cam in the first direction comprises rotating the cam in the first direction in response to sensing the presence of the ground fault. In an exemplary embodiment, rotating the cam in the second direction comprises rotating the cam in the second direction after rotating the cam in the first direction in response to sensing the presence of the ground fault. In an exemplary embodiment, the method comprises providing a second stationary contact and a second movable arm adapted to be controllably electrically coupled to the second stationary contact; electrically decoupling the second movable arm from the second stationary contact in response to rotating the cam in the first direction. In an exemplary embodiment, the method comprises rotating the cam in a second direction; electrically coupling the first movable arm to the first stationary contact in response to rotating the cam in the second direction; and electrically coupling the second movable arm to the second stationary contact in response to rotating the cam in the second direction. In an exemplary embodiment, the method comprises sensing the presence of a ground fault; wherein rotating the cam in the first direction comprises rotating the cam in the first direction in response to sensing the presence of the ground fault so that the first and second movable arms are electrically decoupled from the first and second stationary contacts, respectively. In an exemplary embodiment, rotating the cam in the second direction comprises rotating the cam in the second direction, after rotating the cam in the first direction in response to sensing the presence of the ground fault, so that the first and second movable arms are electrically coupled to the first and second stationary contacts, respectively. In an exemplary embodiment, the method comprises electrically coupling a load to the first and second movable arms; supplying electrical power to the load via the first and second movable arms; and stopping the supply of electrical power to the load via the first and second movable arms in response to rotating the cam in the first direction in response to sensing the presence of the ground fault. In an exemplary embodiment, the method comprises emitting light in response to sensing the ground fault, comprising closing a switch in response to rotating the cam in the first direction in response to sensing the ground fault.

A method of operating a device has been described that includes a cam, the method comprising electrically coupling a load to the device; supplying electrical power to the load via the device; sensing whether a ground fault is present or absent using the device; and if the ground fault is present, stopping the supply of electrical power to the load; wherein stopping the supply of electrical power to the load comprises rotating the cam in a first direction. In an exemplary embodiment, the method comprises resuming the supply of electrical power to the load after stopping the supply of electrical power to the load; wherein resuming the supply of electrical power to the load comprises rotating the cam in a second direction. In an exemplary embodiment, the method comprises emitting light in response to rotating the cam in the first direction. In an exemplary embodiment, the method comprises testing the device. In an exemplary embodiment, testing the device comprises rotating the cam in the first direction to stop the supply of electrical power to the load; and rotating the cam in a second direction to resume the supply of electrical power to the load. In an exemplary embodiment, testing the device further comprises emitting light in response to rotating the cam in the first direction to stop the supply of electrical power to the load; and stopping the emission of light in response to rotating the cam in the second direction to resume the supply of electrical power to the load.

A system has been described that includes means for providing a first stationary contact and a first movable arm adapted to be controllably electrically coupled thereto; means for rotating a cam in a first direction; and means for electrically decoupling the first movable arm from the first stationary contact in response to rotating the cam in the first direction. In an exemplary embodiment, the system comprises means for rotating the cam in a second direction; and means for electrically coupling the first movable arm to the first stationary contact in response to rotating the cam in the second direction. In an exemplary embodiment, the system comprises means for sensing the presence of a ground fault;

wherein means for rotating the cam in the first direction comprises means for rotating the cam in the first direction in response to sensing the presence of the ground fault. In an exemplary embodiment, means for rotating the cam in the second direction comprises means for rotating the cam in the second direction after rotating the cam in the first direction in response to sensing the presence of the ground fault. In an exemplary embodiment, the system comprises means for providing a second stationary contact and a second movable arm adapted to be controllably electrically coupled to the second stationary contact; means for electrically decoupling the second movable arm from the second stationary contact in response to rotating the cam in the first direction. In an exemplary embodiment, the system comprises means for rotating the cam in a second direction; means for electrically coupling the first movable arm to the first stationary contact in response to rotating the cam in the second direction; and means for electrically coupling the second movable arm to the second stationary contact in response to rotating the cam in the second direction. In an exemplary embodiment, the system comprises means for sensing the presence of a ground fault; wherein means for rotating the cam in the first direction comprises means for rotating the cam in the first direction in response to sensing the presence of the ground fault so that the first and second movable arms are electrically decoupled from the first and second stationary contacts, respectively. In an exemplary embodiment, means for rotating the cam in the second direction comprises means for rotating the cam in the second direction, after rotating the cam in the first direction in response to sensing the presence of the ground fault, so that the first and second movable arms are electrically coupled to the first and second stationary contacts, respectively. In an exemplary embodiment, the system comprises means for electrically coupling a load to the first and second movable arms; means for supplying electrical power to the load via the first and second movable arms; and means for stopping the supply of electrical power to the load via the first and second movable arms in response to rotating the cam in the first direction in response to sensing the presence of the ground fault. In an exemplary embodiment, the system comprises means for emitting light in response to sensing the ground fault, comprising means for closing a switch in response to rotating the cam in the first direction in response to sensing the ground fault.

A system for operating a device comprising a cam has been described that includes means for electrically coupling a load to the device; means for supplying electrical power to the load via the device; means for sensing whether a ground fault is present or absent using the device; and means for if the ground fault is present, stopping the supply of electrical power to the load, comprising means for rotating the cam in a first direction. In an exemplary embodiment, the system comprises means for resuming the supply of electrical power to the load after stopping the supply of electrical power to the load, comprising means for rotating the cam in a second direction. In an exemplary embodiment, the system comprises means for emitting light in response to rotating the cam in the first direction. In an exemplary embodiment, the system comprises means for testing the device. In an exemplary embodiment, means for testing the device comprises means for rotating the cam in the first direction to stop the supply of electrical power to the load; and means for rotating the cam in a second direction to resume the supply of electrical power to the load. In an exemplary embodiment, means for testing the device further comprises means for emitting light in response to rotating the cam in the first direction to stop the supply of electrical power to the load; and means for stopping the emission of light in response to rotating the cam in the second direction to resume the supply of electrical power to the load.

A method of operating a device comprising a cam, first and second stationary contacts, and first and second movable arms adapted to be controllably electrically coupled to the first and second stationary contacts, respectively, has been described that includes electrically coupling the first movable arm to the first stationary contact; electrically coupling the second movable arm to the second stationary contact; electrically coupling a load to the first and second movable arms; supplying electrical power to the load via the first and second stationary contacts and the first and second movable arms; sensing whether a ground fault is present or absent using the device; and if the ground fault is present, stopping the supply of electrical power to the load; wherein stopping the supply of electrical power to the load comprises rotating the cam in a first direction; electrically decoupling the first movable arm from the first stationary contact in response to rotating the cam in the first direction; and electrically decoupling the second movable arm from the second stationary contact in response to rotating the cam in the first direction; wherein the method further comprises resuming the supply of electrical power to the load after stopping the supply of electrical power to the load; wherein resuming the supply of electrical power to the load comprises rotating the cam in a second direction; electrically coupling the first movable arm to the first stationary contact in response to rotating the cam in the second direction; and electrically coupling the second movable arm to the second stationary contact in response to rotating the cam in the second direction; and wherein the method further comprises if the ground fault is present, emitting light in response to rotating the cam in the first direction, comprising closing a switch in response rotating the cam in the first direction; and testing the device, comprising rotating the cam in the first direction to stop the supply of electrical power to the load; and rotating the cam in a second direction to resume the supply of electrical power to the load; emitting light in response to rotating the cam in the first direction to stop the supply of electrical power to the load; and stopping the emission of light in response to rotating the cam in the second direction to resume the supply of electrical power to the load.

A ground fault circuit interrupter device has been described that includes first and second stationary contacts; first and second movable arms adapted to be controllably electrically coupled to the first stationary contact; third and fourth movable arms adapted to be controllably electrically coupled to the second stationary contact; and a cam adapted to rotate in place and positioned, relative to the first and second movable arms, so that least portions of the first and second movable arms move, relative to the first stationary contact, in response to the rotation of the cam; wherein at least portions of the third and fourth movable arms move, relative to the second stationary contact, in response to the rotation of the cam; wherein the cam and the first, second, third and fourth movable arms are positioned so that the at least portions of the first and second movable arms move away from the first stationary contact in opposite directions in response to the rotation of the cam in a first direction; the at least portions of the third and fourth movable arms move away from the second stationary contact in opposite directions in response to the rotation of the cam in the first direction; the at least portions of the first and second arms move towards the first stationary contact and towards each other in response to the rotation of the cam in a second direction; and the at least portions of the third and fourth arms move towards the second stationary contact and towards each other in response to the rotation of the cam in the second direction; wherein the first and second movable arms are electrically decoupled from the first stationary contact in response to the rotation of the cam in a first direction; wherein the third and fourth movable arms are electrically decoupled from the second stationary contact in response to the rotation of the cam in the first direction; wherein the first and second movable arms are electrically coupled to the first stationary contact in response to the rotation of the cam in a second direction; wherein the third and fourth movable arms are electrically coupled to the second stationary contact in the response to the rotation of the cam in the second direction; wherein the device further comprises a sensing device operably coupled to the first and second stationary contacts, wherein the sensing device is adapted to sense an imbalance between respective electrical currents in the first and second stationary contacts; an actuator operably coupled to the sensing device, wherein the actuator is adapted to actuate in response to the sensing of the imbalance by the sensing device; wherein the cam rotates in place in response to the actuation of the actuator; wherein the sensing device comprises a transformer assembly and the actuator comprises a solenoid assembly; wherein the device is a ground fault circuit interrupter device and is adapted to supply electrical power to a load; wherein the device is adapted to supply electrical power to the load when the load is electrically coupled to the first and third movable arms; the first movable arm is electrically coupled to the first stationary contact; and the third movable arm is electrically coupled to the second stationary contact; wherein the cam comprises a center portion; and first and second legs coupled to the center portion and spaced in a parallel relation, one of the first and second legs being adapted to contact the first movable arm, wherein an angle is defined between the center portion and the first and second legs; wherein the first movable arm is spring biased towards the first stationary contact; wherein the device comprises a first configuration in which the one of the first and second legs contacts the first movable arm and is positioned so that the one of the first and second legs resists the spring bias of the first movable arm, and the at least a portion of the first movable arm is electrically decoupled from the first stationary contact; and a second configuration in which the one of the first and second legs is positioned so that the first movable arm is permitted to be electrically coupled to the first stationary contact in response to its own spring bias; wherein the cam further comprises axially-aligned first and second pins extending between the center portion and the first and second legs, respectively; wherein an axis is defined by the axially-aligned first and second pins; wherein the cam is adapted to rotate in place about the axis; wherein the device further comprises a switch, the switch comprising the first stationary contact; and a spring, a distal end portion of which is spring biased towards the first stationary contact; wherein the switch comprises an open configuration in which the distal end portion is separated from the first stationary contact and a closed configuration in which the distal end portion contacts the first stationary contact; wherein the switch is placed in the open configuration in response to the rotation of the cam in the first direction; and wherein the switch is placed in the closed configuration in response to the rotation of the cam in the second direction; wherein the device further comprises a light-emitting diode electrically coupled to the switch, wherein the diode is adapted to emit light when the switch is in the closed configuration; wherein the cam further comprises a protrusion extending from one of the first and second legs; and wherein the protrusion is adapted to contact and separate the distal end portion of the spring from the first stationary contact, thereby placing the switch in the open configuration, in response to the rotation of the cam in the first direction.

A system for operating a device comprising a cam, first and second stationary contacts, and first and second movable arms adapted to be controllably electrically coupled to the first and second stationary contacts, respectively, has been described that includes means for electrically coupling the first movable arm to the first stationary contact; means for electrically coupling the second movable arm to the second stationary contact; means for electrically coupling a load to the first and second movable arms; means for supplying electrical power to the load via the first and second stationary contacts and the first and second movable arms; means for sensing whether a ground fault is present or absent using the device; and means for if the ground fault is present, stopping the supply of electrical power to the load, comprising means for rotating the cam in a first direction; means for electrically decoupling the first movable arm from the first stationary contact in response to rotating the cam in the first direction; and means for electrically decoupling the second movable arm from the second stationary contact in response to rotating the cam in the first direction; wherein the system further comprises means for resuming the supply of electrical power to the load after stopping the supply of electrical power to the load, comprising means for rotating the cam in a second direction; means for electrically coupling the first movable arm to the first stationary contact in response to rotating the cam in the second direction; and means for electrically coupling the second movable arm to the second stationary contact in response to rotating the cam in the second direction; and wherein the system further comprises means for if the ground fault is present, emitting light in response to rotating the cam in the first direction, comprising means for closing a switch in response rotating the cam in the first direction; and means for testing the device, comprising means for rotating the cam in the first direction to stop the supply of electrical power to the load; means for rotating the cam in a second direction to resume the supply of electrical power to the load; means for emitting light in response to rotating the cam in the first direction to stop the supply of electrical power to the load; and means for stopping the emission of light in response to rotating the cam in the second direction to resume the supply of electrical power to the load.

A device has been described that includes a stationary contact; and an arm adapted to be controllably electrically coupled to the stationary contact, the arm comprising a first portion; and a second portion extending from the first portion and adapted to be controllably electrically coupled to the stationary contact to controllably electrically couple the arm to the stationary contact; wherein at least a portion of the first portion extends in a direction that is parallel to at least a directional component of the direction of extension of the second portion from the first portion. In an exemplary embodiment, a force is adapted to be applied against the second portion to electrically decouple the arm from the stationary contact; and wherein the first portion increases the overall length of the arm and is sized and positioned so that the magnitude of the force required to electrically decouple the arm from the stationary contact is reduced. In an exemplary embodiment, the first portion comprises a longitudinally-extending portion; and a U-shaped portion extending between the longitudinally extending portion and the second portion. In an exemplary embodiment, the second portion comprises an angularly-extending portion. In an exemplary embodiment, the first portion comprises a longitudinally-extending portion and a U-shaped portion extending therefrom; and wherein the second portion comprises an angularly-extending portion extending from the U-shaped portion. In an exemplary embodiment, the at least a portion of the first portion comprises the longitudinally-extending portion. In an exemplary embodiment, the longitudinally-extending portion and the U-shaped portion are coplanar. In an exemplary embodiment, the device comprises a housing defining a region within which the first portion extends and within which at least a portion of the second portion extends. In an exemplary embodiment, the device comprises first and second pairs of contacts, wherein each of the first and second pairs of contacts is a hot or neutral receptacle contact adapted to receive a prong of a plug; and at least one wall extending between the first and second pairs of contacts, the first portion extending from the at least one wall. In an exemplary embodiment, the arm, the first and second pairs of contacts, and the at least one wall are integral. In an exemplary embodiment, the device comprises a sensing device operably coupled to the stationary contact and adapted to sense a ground fault. In an exemplary embodiment, a force is adapted to be applied against the second portion to electrically decouple the arm from the stationary contact; wherein the device further comprises a cam adapted to rotate in place; and wherein, in response to the rotation of the cam in a first direction, the force is applied against the arm to electrically decouple the arm from the stationary contact. In an exemplary embodiment, the second portion is spring biased towards the stationary contact; and wherein the arm is electrically coupled to the stationary contact in response to its own spring bias and the rotation of the cam in a second direction. In an exemplary embodiment, the second portion is spring biased towards the stationary contact.

A receptacle contact adapted to be controllably electrically coupled to a stationary contact has been described that includes an arm comprising a first portion; and a second portion extending from the first portion and against which a force is adapted to be applied to electrically decouple the arm from the stationary contact; first and second pairs of contacts, wherein each of the first and second pairs of contacts is a hot or neutral receptacle contact adapted to receive a prong of a plug; and at least one wall extending between the first and second pairs of contacts, the first portion extending from the at least one wall; wherein the first and second pairs of contacts, the at least one wall, and the arm are integral. In an exemplary embodiment, at least a portion of the first portion extends in a direction that is parallel to at least a directional component of the direction of extension of the second portion from the first portion. In an exemplary embodiment, the first portion increases the overall length of the arm and is sized and positioned so that the magnitude of the force required to electrically decouple the arm from the stationary contact is reduced. In an exemplary embodiment, the first portion comprises a longitudinally-extending portion; and a U-shaped portion extending between the longitudinally extending portion and the second portion. In an exemplary embodiment, the second portion comprises an angularly-extending portion. In an exemplary embodiment, the first portion comprises a longitudinally-extending portion and a U-shaped portion extending therefrom; and wherein the second portion comprises an angularly-extending portion extending from the U-shaped portion. In an exemplary embodiment, the at least a portion of the first portion comprises the longitudinally-extending portion. In an exemplary embodiment, the longitudinally-extending portion and the U-shaped portion are coplanar. In an exemplary embodiment, the second portion is adapted to be spring biased towards the stationary contact.

A device has been described that includes a stationary contact; and a receptacle contact comprising an arm adapted to be controllably electrically coupled to the stationary contact, the arm comprising a first portion; and a second portion extending from the first portion and adapted to be controllably electrically coupled to the stationary contact to controllably electrically couple the arm to the stationary contact, wherein at least a portion of the first portion extends in a direction that is parallel to at least a directional component of the direction of extension of the second portion from the first portion; first and second pairs of contacts, wherein each of the first and second pairs of contacts is a hot or neutral receptacle contact adapted to receive a prong of a plug; and at least one wall extending between the first and second pairs of contacts, the first portion extending from the at least one wall; a housing defining a region within which the first portion extends and within which at least a portion of the second portion extends; a sensing device operably coupled to the stationary contact and adapted to sense a ground fault; and a cam adapted to rotate in place; wherein a force is adapted to be applied against the second portion to electrically decouple the arm from the stationary contact; wherein the first portion increases the overall length of the arm and is sized and positioned so that the magnitude of the force required to electrically decouple the arm from the stationary contact is reduced; wherein the first portion comprises a longitudinally-extending portion and a U-shaped portion extending therefrom; and wherein the second portion comprises an angularly-extending portion extending from the U-shaped portion; wherein the at least a portion of the first portion comprises the longitudinally-extending portion; wherein the longitudinally-extending portion and the U-shaped portion are coplanar; wherein the arm, the first and second pairs of contacts, and the at least one wall are integral; wherein, in response to the rotation of the cam in a first direction, the force is applied against the arm to electrically decouple the arm from the stationary contact; wherein the second portion is spring biased towards the stationary contact; and wherein the arm is electrically coupled to the stationary contact in response to its spring bias and the rotation of the cam in a second direction.

A method has been described that includes providing a device comprising a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and reducing the magnitude of the force required to electrically decouple the arm from the stationary contact while maintaining as substantially constant the longitudinal length of the arm. In an exemplary embodiment, the method comprises electrically decoupling the arm from the stationary contact, comprising applying the force against the arm. In an exemplary embodiment, the method comprises electrically coupling the arm to the stationary contact. In an exemplary embodiment, the arm is spring biased towards the stationary contact; and wherein electrically coupling the arm to the stationary contact comprises permitting the arm to be electrically coupled to the stationary contact in response to the spring bias of the arm. In an exemplary embodiment, the method comprises providing first and second pairs of contacts, wherein each of the first and second pairs is a hot or neutral receptacle contact adapted to receive a prong of a plug. In an exemplary embodiment, the method comprises extending at least one wall between the first and second pairs of contacts; and extending the arm from the at least one wall. In an exemplary embodiment, the arm, the first and second pairs of contacts, and the at least one wall are integral. In an exemplary embodiment, the method comprises electrically coupling a load to the device; supplying electrical power to the load via the device; and sensing whether a ground fault is present or absent. In an exemplary embodiment, the method comprises if the ground fault is present, electrically decoupling the arm from the stationary contact. In an exemplary embodiment, the method comprises if the ground fault is present, stopping the supply of electrical power to the load.

A method has been described that includes providing a device comprising a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; providing first and second pairs of contacts, wherein each of the first and second pairs is a hot or neutral receptacle contact adapted to receive a prong of a plug; extending at least one wall between the first and second pairs of contacts; extending the arm from the at least one wall; reducing the magnitude of the force required to electrically decouple the arm from the stationary contact while maintaining as substantially constant the longitudinal length of the arm; electrically decoupling the arm from the stationary contact, comprising applying the force against the arm; electrically coupling the arm to the stationary contact; electrically coupling a load to the device; supplying electrical power to the load via the device; sensing whether a ground fault is present or absent; if the ground fault is present, electrically decoupling the arm from the stationary contact; and if the ground fault is present, stopping the supply of electrical power to the load; wherein the arm is spring biased towards the stationary contact; wherein electrically coupling the arm to the stationary contact comprises permitting the arm to be electrically coupled to the stationary contact in response to the spring bias of the arm; and wherein the arm, the first and second pairs of contacts, and the at least one wall are integral.

A system has been described that includes means for providing a device comprising a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and means for reducing the magnitude of the force required to electrically decouple the arm from the stationary contact while maintaining as substantially constant the longitudinal length of the arm. In an exemplary embodiment, the system comprises means for electrically decoupling the arm from the stationary contact, comprising means for applying the force against the arm. In an exemplary embodiment, the system comprises means for electrically coupling the arm to the stationary contact. In an exemplary embodiment, the arm is spring biased towards the stationary contact; and wherein means for electrically coupling the arm to the stationary contact comprises means for permitting the arm to be electrically coupled to the stationary contact in response to the spring bias of the arm. In an exemplary embodiment, the system comprises means for providing first and second pairs of contacts, wherein each of the first and second pairs is a hot or neutral receptacle contact adapted to receive a prong of a plug. In an exemplary embodiment, the system comprises means for extending at least one wall between the first and second pairs of contacts; and means for extending the arm from the at least one wall. In an exemplary embodiment, the arm, the first and second pairs of contacts, and the at least one wall are integral. In an exemplary embodiment, the system comprises means for electrically coupling a load to the device; means for supplying electrical power to the load via the device; and means for sensing whether a ground fault is present or absent. In an exemplary embodiment, the system comprises means for if the ground fault is present, electrically decoupling the arm from the stationary contact. In an exemplary embodiment, the system comprises means for if the ground fault is present, stopping the supply of electrical power to the load.

A system has been described that includes means for providing a device comprising a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; means for providing first and second pairs of contacts, wherein each of the first and second pairs is a hot or neutral receptacle contact adapted to receive a prong of a plug; means for extending at least one wall between the first and second pairs of contacts; means for extending the arm from the at least one wall; means for reducing the magnitude of the force required to electrically decouple the arm from the stationary contact while maintaining as substantially constant the longitudinal length of the arm; means for electrically decoupling the arm from the stationary contact, comprising applying the force against the arm; means for electrically coupling the arm to the stationary contact; means for electrically coupling a load to the device; means for supplying electrical power to the load via the device; means for sensing whether a ground fault is present or absent; means for if the ground fault is present, electrically decoupling the arm from the stationary contact; and means for if the ground fault is present, stopping the supply of electrical power to the load; wherein the arm is spring biased towards the stationary contact; wherein means for electrically coupling the arm to the stationary contact comprises means for permitting the arm to be electrically coupled to the stationary contact in response to the spring bias of the arm; and wherein the arm, the first and second pairs of contacts, and the at least one wall are integral.

An apparatus has been described that includes a transformer assembly comprising a first opening; and a first contact arm extending through the first opening of the transformer assembly, the first contact arm comprising a first portion; and a second portion extending from the first portion, at least a portion of the second portion being offset from the first portion. In an exemplary embodiment, the transformer is adapted to be coupled to a circuit board comprising a second opening; and wherein the at least a portion of the second portion is adapted to be inserted through the second opening and engage the circuit board to couple the transformer assembly to the circuit board. In an exemplary embodiment, the apparatus comprises a circuit board to which the transformer assembly is coupled, the circuit board comprising a second opening within which the first portion extends; wherein the at least a portion of the second portion engages the circuit board to couple the transformer assembly to the circuit board; and wherein the engagement between the at least a portion of the second portion and the circuit board generally holds the transformer assembly in place, relative to the circuit board, to facilitate soldering the first contact arm to the circuit board. In an exemplary embodiment, the circuit board defines first and second surfaces; wherein the transformer assembly is adjacent the first surface of the circuit board; and wherein the at least a portion of the second portion engages the second surface of the circuit board to couple the transformer assembly to the circuit board. In an exemplary embodiment, the at least a portion of the second portion comprises a generally curved portion, at least a portion of the generally curved portion engaging the circuit board. In an exemplary embodiment, the apparatus comprises the first and second portions of the first contact arm are integrally formed. In an exemplary embodiment, a second contact arm extending through the first opening of the transformer assembly, the second contact arm comprising a first portion and a second portion extending from the first portion, at least a portion of the second portion of the second contact arm being offset from the first portion of the second contact arm; wherein the circuit board comprises a third opening within which the first portion of the second contact arm extends; and wherein the at least a portion of the second portion of the second contact arm engages the circuit board to further couple the transformer assembly to the circuit board. In an exemplary embodiment, the second portions are adapted to be forced through the second and third openings, respectively, to couple the transformer assembly to the circuit board; and wherein the second portions deflect away from each other during the forcing of the second portions through the second and third openings, respectively. In an exemplary embodiment, the transformer assembly comprises a boat comprising an at least partially circumferentially-extending wall and a cylindrical protrusion at least partially surrounded by the wall, wherein the first opening extends through the cylindrical protrusion; and a pair of transformer coils, each transformer coil circumferentially extending about the cylindrical protrusion and radially extending between the cylindrical protrusion and the inside surface of the wall; wherein the first opening defines parallel-spaced first and second inside surfaces of the cylindrical protrusion; and wherein the apparatus further comprises a isolating member extending within the first opening so that the first and second contact arms are disposed between the isolating member and the first and second inside surfaces, respectively, of the cylindrical protrusion. In an exemplary embodiment, the transformer assembly, the first contact arm and the circuit board are part of a ground fault circuit interrupter device; and wherein the transformer assembly is adapted to sense a ground fault.

A method has been described that includes providing a circuit board defining first and second surfaces spaced in a parallel relation, and a transformer assembly comprising an opening; extending a first contact arm through the opening of the transformer assembly; and coupling the transformer assembly to the circuit board, comprising coupling the first contact arm to the circuit board so that the transformer assembly is adjacent the first surface of the circuit board and the first contact arm engages the second surface of the circuit board. In an exemplary embodiment, the first contact arm comprises a first portion and a second portion extending therefrom, at least a portion of the second portion being offset from the first portion. In an exemplary embodiment, the method comprises extending a second contact arm through the opening of the transformer assembly; wherein coupling the transformer assembly to the circuit board further comprises coupling the second contact arm to the circuit board so that the second contact arm engages the second surface of the circuit board. In an exemplary embodiment, each of the first and second contact arms comprises a first portion and a second portion extending therefrom, at least a portion of the second portion being offset from the first portion; wherein coupling the transformer assembly to the circuit board further comprises forcing the first and second contact arms through respective openings in the circuit board; and wherein the second portions deflect away from each other during forcing the first and second contact arms through the respective openings in the circuit board. In an exemplary embodiment, coupling the first contact arm to the circuit board so that the transformer assembly is adjacent the first surface of the circuit board and the first contact arm engages the second surface of the circuit board comprises engaging the at least a portion of the second portion of the first contact arm with the circuit board; and wherein coupling the second contact arm to the circuit board so that the second contact arm engages the second surface of the circuit board comprises engaging the at least a portion of the second portion of the second contact arm with the circuit board. In an exemplary embodiment, the method comprises soldering the first and second contact arms to the circuit board after coupling the first and second contact arms to the circuit board; wherein the respective couplings between the first and second contact arms and the circuit board generally hold the transformer assembly in place to facilitate soldering the first and second contact arms to the circuit board. In an exemplary embodiment, the method comprises electrically isolating the first and second contact arms. In an exemplary embodiment, the method comprises sensing a ground fault using the transformer assembly; and energizing a solenoid in response to sensing the ground fault using the transformer assembly.

A system has been described that includes means for providing a circuit board defining first and second surfaces spaced in a parallel relation, and a transformer assembly comprising an opening; means for extending a first contact arm through the opening of the transformer assembly; and means for coupling the transformer assembly to the circuit board, comprising means for coupling the first contact arm to the circuit board so that the transformer assembly is adjacent the first surface of the circuit board and the first contact arm engages the second surface of the circuit board. In an exemplary embodiment, the first contact arm comprises a first portion and a second portion extending therefrom, at least a portion of the second portion being offset from the first portion. In an exemplary embodiment, the system comprises means for extending a second contact arm through the opening of the transformer assembly; wherein means for coupling the transformer assembly to the circuit board further comprises means for coupling the second contact arm to the circuit board so that the second contact arm engages the second surface of the circuit board. In an exemplary embodiment, each of the first and second contact arms comprises a first portion and a second portion extending therefrom, at least a portion of the second portion being offset from the first portion; wherein means for coupling the transformer assembly to the circuit board further comprises means for forcing the first and second contact arms through respective openings in the circuit board; and wherein the second portions deflect away from each other during forcing the first and second contact arms through the respective openings in the circuit board. In an exemplary embodiment, means for coupling the first contact arm to the circuit board so that the transformer assembly is adjacent the first surface of the circuit board and the first contact arm engages the second surface of the circuit board comprises means for engaging the at least a portion of the second portion of the first contact arm with the circuit board; and wherein means for coupling the second contact arm to the circuit board so that the second contact arm engages the second surface of the circuit board comprises means for engaging the at least a portion of the second portion of the second contact arm with the circuit board. In an exemplary embodiment, the system comprises means for soldering the first and second contact arms to the circuit board after coupling the first and second contact arms to the circuit board; wherein the respective couplings between the first and second contact arms and the circuit board generally hold the transformer assembly in place to facilitate soldering the first and second contact arms to the circuit board. In an exemplary embodiment, the system comprises means for electrically isolating the first and second contact arms. In an exemplary embodiment, the system comprises means for sensing a ground fault using the transformer assembly; and means for energizing a solenoid in response to sensing the ground fault using the transformer assembly.

A ground fault circuit interrupter device has been described that includes a transformer assembly comprising a first opening; and a first contact arm extending through the first opening of the transformer assembly, the first contact arm comprising a first portion; and a second portion extending from the first portion, at least a portion of the second portion being offset from the first portion; a circuit board to which the transformer assembly is coupled, the circuit board comprising a second opening within which the first portion extends; wherein the at least a portion of the second portion engages the circuit board to couple the transformer assembly to the circuit board; wherein the engagement between the at least a portion of the second portion and the circuit board generally holds the transformer assembly in place, relative to the circuit board, to facilitate soldering the first contact arm to the circuit board; wherein the circuit board defines first and second surfaces; wherein the transformer assembly is adjacent the first surface of the circuit board; wherein the at least a portion of the second portion engages the second surface of the circuit board to couple the transformer assembly to the circuit board; wherein the at least a portion of the second portion comprises a generally curved portion, at least a portion of the generally curved portion engaging the circuit board; wherein the first and second portions of the first contact arm are integrally formed; wherein the ground fault circuit interrupter device further comprises a second contact arm extending through the first opening of the transformer assembly, the second contact arm comprising a first portion and a second portion extending from the first portion, at least a portion of the second portion of the second contact arm being offset from the first portion of the second contact arm; wherein the circuit board comprises a third opening within which the first portion of the second contact arm extends; wherein the at least a portion of the second portion of the second contact arm engages the circuit board to further couple the transformer assembly to the circuit board; wherein the second portions are adapted to be forced through the second and third openings, respectively, to couple the transformer assembly to the circuit board; and wherein the second portions deflect away from each other during the forcing of the second portions through the second and third openings, respectively; wherein the transformer assembly comprises a boat comprising an at least partially circumferentially-extending wall and a cylindrical protrusion at least partially surrounded by the wall, wherein the first opening extends through the cylindrical protrusion; and a pair of transformer coils, each transformer coil circumferentially extending about the cylindrical protrusion and radially extending between the cylindrical protrusion and the inside surface of the wall; wherein the first opening defines parallel-spaced first and second inside surfaces of the cylindrical protrusion; wherein the ground fault circuit interrupter device further comprises a isolating member extending within the first opening so that the first and second contact arms are disposed between the isolating member and the first and second inside surfaces, respectively, of the cylindrical protrusion; and wherein the transformer assembly is adapted to sense a ground fault.

A method has been described that includes providing a circuit board defining first and second surfaces spaced in a parallel relation, and a transformer assembly comprising an opening; extending a first contact arm through the opening of the transformer assembly; coupling the transformer assembly to the circuit board, comprising coupling the first contact arm to the circuit board so that the transformer assembly is adjacent the first surface of the circuit board and the first contact arm engages the second surface of the circuit board; extending a second contact arm through the opening of the transformer assembly; wherein coupling the transformer assembly to the circuit board further comprises coupling the second contact arm to the circuit board so that the second contact arm engages the second surface of the circuit board; wherein each of the first and second contact arms comprises a first portion and a second portion extending therefrom, at least a portion of the second portion being offset from the first portion; wherein coupling the transformer assembly to the circuit board further comprises forcing the first and second contact arms through respective openings in the circuit board; wherein the second portions deflect away from each other during forcing the first and second contact arms through the respective openings in the circuit board; wherein coupling the first contact arm to the circuit board so that the transformer assembly is adjacent the first surface of the circuit board and the first contact arm engages the second surface of the circuit board comprises engaging the at least a portion of the second portion of the first contact arm with the circuit board; wherein coupling the second contact arm to the circuit board so that the second contact arm engages the second surface of the circuit board comprises engaging the at least a portion of the second portion of the second contact arm with the circuit board; and wherein the method further comprises soldering the first and second contact arms to the circuit board after coupling the first and second contact arms to the circuit board, wherein the respective couplings between the first and second contact arms and the circuit board generally hold the transformer assembly in place to facilitate soldering the first and second contact arms to the circuit board; electrically isolating the first and second contact arms; sensing a ground fault using the transformer assembly; and energizing a solenoid in response to sensing the ground fault using the transformer assembly.

A system has been described that includes means for providing a circuit board defining first and second surfaces spaced in a parallel relation, and a transformer assembly comprising an opening; means for extending a first contact arm through the opening of the transformer assembly; means for coupling the transformer assembly to the circuit board, comprising means for coupling the first contact arm to the circuit board so that the transformer assembly is adjacent the first surface of the circuit board and the first contact arm engages the second surface of the circuit board; means for extending a second contact arm through the opening of the transformer assembly; wherein means for coupling the transformer assembly to the circuit board further comprises means for coupling the second contact arm to the circuit board so that the second contact arm engages the second surface of the circuit board; wherein each of the first and second contact arms comprises a first portion and a second portion extending therefrom, at least a portion of the second portion being offset from the first portion; wherein means for coupling the transformer assembly to the circuit board further comprises means for forcing the first and second contact arms through respective openings in the circuit board; wherein the second portions deflect away from each other during forcing the first and second contact arms through the respective openings in the circuit board; wherein means for coupling the first contact arm to the circuit board so that the transformer assembly is adjacent the first surface of the circuit board and the first contact arm engages the second surface of the circuit board comprises means for engaging the at least a portion of the second portion of the first contact arm with the circuit board; wherein means for coupling the second contact arm to the circuit board so that the second contact arm engages the second surface of the circuit board comprises means for engaging the at least a portion of the second portion of the second contact arm with the circuit board; and wherein the system further comprises means for soldering the first and second contact arms to the circuit board after coupling the first and second contact arms to the circuit board, wherein the respective couplings between the first and second contact arms and the circuit board generally hold the transformer assembly in place to facilitate soldering the first and second contact arms to the circuit board; means for electrically isolating the first and second contact alms; means for sensing a ground fault using the transformer assembly; and means for energizing a solenoid in response to sensing the ground fault using the transformer assembly.

An apparatus has been described that includes a switch comprising a stationary contact; and a member comprising a distal end portion biased towards the stationary contact; and a cam adapted to rotate in place so that the distal end portion is electrically coupled to the stationary contact, and thus the switch is closed, in response to the rotation of the cam in a first direction; and the distal end portion is electrically decoupled from the stationary contact, and thus the switch is open, in response to the rotation of the cam in a second direction. In an exemplary embodiment, in response to the rotation of the cam in the first direction, the bias of the distal end portion is permitted to cause the distal end portion to be electrically coupled to the stationary contact. In an exemplary embodiment, in response to the rotation of the cam in the second direction, the bias of the distal end portion is resisted by the cam. In an exemplary embodiment, the member comprises a wire spring comprising one or more bends formed therein, the distal end portion being at least partially defined by at least one of the one or more bends. In an exemplary embodiment, the cam comprises a protrusion adapted to engage the distal end portion when the cam rotates in the second direction. In an exemplary embodiment, the cam further comprises a sensing device adapted to sense a ground fault; wherein the cam is adapted to rotate in the first direction in response to the sensing of the ground fault by the sensing device. In an exemplary embodiment, the cam further comprises an actuator operably coupled to the sensing device; wherein the actuator is adapted to actuate in response to the sensing of the ground fault by the sensing device; and wherein the cam is adapted to rotate in the first direction in response to the actuation of the actuator in response to the sensing of the ground fault by the sensing device. In an exemplary embodiment, the sensing device comprises a transformer assembly operably coupled to the stationary contact; and wherein the actuator comprises a solenoid assembly adapted to be energized in response to the sensing of the ground fault by the sensing device. In an exemplary embodiment, the apparatus further comprises a light source electrically coupled to the switch and adapted to emit light when the switch is closed. In an exemplary embodiment, wherein the light source comprises one or more light-emitting diodes. In an exemplary embodiment, the apparatus further comprises at least one movable arm adapted to be controllably electrically coupled to the stationary contact and arranged so that at least a portion of the at least one movable arm moves, relative to the stationary contact, in response to the rotation of the cam. In an exemplary embodiment, wherein the at least one arm is electrically decoupled from the stationary contact in response to the rotation of the cam in the first direction. In an exemplary embodiment, wherein the at least one arm is electrically coupled to the stationary contact in response to the rotation of the cam in the second direction. In an exemplary embodiment, wherein the at least one movable arm is adapted to be electrically coupled to a load and used to supply electrical power to the load when the at least one arm is electrically coupled to the stationary contact.

A method of operating a device comprising a switch and a cam has been described that includes electrically coupling a load to the device; supplying electrical power to the load via the device; sensing whether a ground fault is present or absent using the device; and if the ground fault is present, closing the switch; wherein closing the switch comprises rotating the cam in a first direction. In an exemplary embodiment, the method comprises electrically coupling a light source to the switch; and emitting light from the light source in response to closing the switch. In an exemplary embodiment, the light source comprises one or more light-emitting diodes. In an exemplary embodiment, the method comprises opening the switch after closing the switch, comprising rotating the cam in a second direction. In an exemplary embodiment, the supply of electrical power to the load is stopped in response to rotating the cam in the first direction. In an exemplary embodiment, the method comprises resuming the supply of electrical power to the load after the supply of electrical power to the load is stopped, comprising rotating the cam in a second direction. In an exemplary embodiment, the method comprises testing the device. In an exemplary embodiment, testing the device comprises rotating the cam in the first direction to close the switch. In an exemplary embodiment, testing the device further comprises rotating the cam in a second direction to open the switch. In an exemplary embodiment, testing the device further comprises electrically coupling a light source to the switch; emitting light from the light source in response to closing the switch; and stopping the emission of light from the light source in response to opening the switch. In an exemplary embodiment, the switch comprises a stationary contact and a member, the member comprising a distal end portion biased towards the stationary contact.

A method has been described that includes providing a switch comprising a stationary contact and a member comprising a distal end portion that is adapted to be controllably electrically coupled to the stationary contact; and closing the switch, comprising rotating a cam in a first direction; and electrically coupling the distal end portion to the stationary contact in response to rotating the cam in the first direction. In an exemplary embodiment, the method comprises opening the switch, comprising rotating the cam in a second direction; and electrically decoupling the distal end portion from the stationary contact in response to rotating the cam in the second direction. In an exemplary embodiment, the method comprises sensing the presence of a ground fault; wherein rotating the cam in the first direction comprises rotating the cam in the first direction in response to sensing the presence of the ground fault. In an exemplary embodiment, rotating the cam in the second direction comprises rotating the cam in the second direction after rotating the cam in the first direction in response to sensing the presence of the ground fault. In an exemplary embodiment, the method comprises electrically coupling a light source to the switch; and emitting light from the light source in response to closing the switch. In an exemplary embodiment, the light source comprises one or more light-emitting diodes.

A system for operating a device comprising a switch and a cam has been described that includes means for electrically coupling a load to the device; means for supplying electrical power to the load via the device; means for sensing whether a ground fault is present or absent using the device; and means for if the ground fault is present, closing the switch, comprising means for rotating the cam in a first direction. In an exemplary embodiment, the system comprises means for electrically coupling a light source to the switch; and means for emitting light from the light source in response to closing the switch. In an exemplary embodiment, the light source comprises one or more light-emitting diodes. In an exemplary embodiment, the system comprises means for opening the switch after closing the switch, comprising means for rotating the cam in a second direction. In an exemplary embodiment, the supply of electrical power to the load is stopped in response to rotating the cam in the first direction. In an exemplary embodiment, the system comprises means for resuming the supply of electrical power to the load after the supply of electrical power to the load is stopped, comprising means for rotating the cam in a second direction. In an exemplary embodiment, the system comprises means for testing the device. In an exemplary embodiment, means for testing the device comprises means for rotating the cam in the first direction to close the switch. In an exemplary embodiment, means for testing the device further comprises means for rotating the cam in a second direction to open the switch. In an exemplary embodiment, means for testing the device further comprises means for electrically coupling a light source to the switch; means for emitting light from the light source in response to closing the switch; and means for stopping the emission of light from the light source in response to opening the switch. In an exemplary embodiment, the switch comprises a stationary contact and a member, the member comprising a distal end portion biased towards the stationary contact.

A system has been described that includes means for providing a switch comprising a stationary contact and a member comprising a distal end portion that is adapted to be controllably electrically coupled to the stationary contact; and means for closing the switch, comprising means for rotating a cam in a first direction; and means for electrically coupling the distal end portion to the stationary contact in response to rotating the cam in the first direction. In an exemplary embodiment, the system comprises means for opening the switch, comprising means for rotating the cam in a second direction; and means for electrically decoupling the distal end portion from the stationary contact in response to rotating the cam in the second direction. In an exemplary embodiment, the system comprises means for sensing the presence of a ground fault; wherein means for rotating the cam in the first direction comprises means for rotating the cam in the first direction in response to sensing the presence of the ground fault. In an exemplary embodiment, means for rotating the cam in the second direction comprises means for rotating the cam in the second direction after rotating the cam in the first direction in response to sensing the presence of the ground fault. In an exemplary embodiment, the system comprises means for electrically coupling a light source to the switch; and means for emitting light from the light source in response to closing the switch. In an exemplary embodiment, the light source comprises one or more light-emitting diodes.

A method of operating a device comprising a cam and a switch, the switch comprising a stationary contact and a member comprising a distal end portion that is adapted to be controllably electrically coupled to the stationary contact has been described that includes electrically coupling a load to the device; supplying electrical power to the load via the device; sensing whether a ground fault is present or absent using the device; if the ground fault is present, closing the switch, comprising rotating the cam in a first direction, wherein the supply of electrical power to the load is stopped in response to rotating the cam in the first direction; and electrically coupling the distal end portion to the stationary contact in response to rotating the cam in the first direction; electrically coupling a light source to the switch, wherein the light source comprises one or more light-emitting diodes; emitting light from the light source in response to closing the switch; opening the switch after closing the switch, comprising rotating the cam in a second direction, wherein the supply of electrical power to the load is resumed in response to rotating the cam in the second direction; and electrically decoupling the distal end portion from the stationary contact in response to rotating the cam in the second direction; and testing the device, comprising rotating the cam in the first direction to close the switch; emitting light from the light source in response to closing the switch; rotating the cam in the second direction to open the switch; and stopping the emission of light from the light source in response to opening the switch.

A ground fault interrupter device has been described that includes a switch comprising a stationary contact; and a member comprising a distal end portion biased towards the stationary contact; and a cam adapted to rotate in place so that the distal end portion is electrically coupled to the stationary contact, and thus the switch is closed, in response to the rotation of the cam in a first direction; and the distal end portion is electrically decoupled from the stationary contact, and thus the switch is open, in response to the rotation of the cam in a second direction; wherein, in response to the rotation of the cam in the first direction, the bias of the distal end portion is permitted to cause the distal end portion to be electrically coupled to the stationary contact; wherein, in response to the rotation of the cam in the second direction, the bias of the distal end portion is resisted by the cam; wherein the member comprises a wire spring comprising one or more bends formed therein, the distal end portion being defined by at least one of the one or more bends; wherein the cam comprises a protrusion adapted to engage the distal end portion when the cam rotates in the second direction; wherein the device further comprises a sensing device adapted to sense a ground fault; wherein the cam is adapted to rotate in first direction in response to the sensing of the ground fault by the sensing device; wherein the device further comprises an actuator operably coupled to the sensing device; wherein the actuator is adapted to actuate in response to the sensing of the ground fault by the sensing device; wherein the cam is adapted to rotate in the first direction in response to the actuation of the actuator in response to the sensing of the ground fault by the sensing device; wherein the sensing device comprises a transformer assembly operably coupled to the stationary contact; wherein the actuator comprises a solenoid assembly adapted to be energized in response to the sensing of the ground fault by the sensing device; wherein the device further comprises a light source electrically coupled to the switch and adapted to emit light when the switch is closed; wherein the light source comprises one or more light-emitting diodes; wherein the device further comprises at least one movable arm adapted to be controllably electrically coupled to the stationary contact and arranged so that at least a portion of the at least one movable arm moves, relative to the stationary contact, in response to the rotation of the cam; wherein the at least one arm is electrically decoupled from the stationary contact in response to the rotation of the cam in the first direction; wherein the at least one arm is electrically coupled to the stationary contact in response to the rotation of the cam in the second direction; and wherein the at least one movable arm is adapted to be electrically coupled to a load and used to supply electrical power to the load when the at least one arm is electrically coupled to the stationary contact.

A system for operating a device comprising a cam and a switch, the switch comprising a stationary contact and a member comprising a distal end portion that is adapted to be controllably electrically coupled to the stationary contact has been described that includes means for electrically coupling a load to the device; means for supplying electrical power to the load via the device; means for sensing whether a ground fault is present or absent using the device; means for if the ground fault is present, closing the switch, comprising means for rotating the cam in a first direction, wherein the supply of electrical power to the load is stopped in response to rotating the cam in the first direction; and means for electrically coupling the distal end portion to the stationary contact in response to rotating the cam in the first direction; means for electrically coupling a light source to the switch, wherein the light source comprises one or more light-emitting diodes; means for emitting light from the light source in response to closing the switch; means for opening the switch after closing the switch, comprising means for rotating the cam in a second direction, wherein the supply of electrical power to the load is resumed in response to rotating the can in the second direction; and means for electrically decoupling the distal end portion from the stationary contact in response to rotating the cam in the second direction; and means for testing the device, comprising means for rotating the cam in the first direction to close the switch; means for emitting light from the light source in response to closing the switch; means for rotating the cam in the second direction to open the switch; and means for stopping the emission of light from the light source in response to opening the switch.

A device has been described that includes a first stationary contact; a first movable arm adapted to be controllably electrically coupled to the first stationary contact; and at least one of the following: a cam adapted to rotate in place and positioned, relative to the first movable arm, so that at least a portion of the first movable arm moves, relative to the first stationary contact, in response to the rotation of the cam; a switch comprising the first stationary contact; a member comprising a distal end portion biased towards the first stationary contact; and the cam, wherein the cam is adapted to rotate in place so that the distal end portion is electrically coupled to the first stationary contact, and thus the switch is closed, in response to the rotation of the cam in a first direction; and the distal end portion is electrically decoupled from the first stationary contact, and thus the switch is open, in response to the rotation of the cam in a second direction; a receptacle contact comprising an arm adapted to be controllably electrically coupled to the first stationary contact, the arm comprising a first portion and a second portion extending from the first portion and adapted to be controllably electrically coupled to the first stationary contact to controllably electrically couple the arm to the first stationary contact, wherein at least a portion of the first portion extends in a direction that is parallel to at least a directional component of the direction of extension of the second portion from the first portion; and a transformer assembly comprising a first opening and a first contact arm extending through the first opening of the transformer assembly, the first contact arm being integral with the first stationary contact and comprising a first portion and a second portion extending from the first portion, at least a portion of the second portion being offset from the first portion. In an exemplary embodiment, the device comprises at least another of the following: the cam adapted to rotate in place and positioned, relative to the first movable arm, so that the at least a portion of the first movable arm moves, relative to the first stationary contact, in response to the rotation of the cam; the switch comprising the first stationary contact; the member comprising the distal end portion biased towards the first stationary contact; and the cam, wherein the cam is adapted to rotate in place so that the distal end portion is electrically coupled to the first stationary contact, and thus the switch is closed, in response to the rotation of the cam in the first direction; and the distal end portion is electrically decoupled from the first stationary contact, and thus the switch is open, in response to the rotation of the cam in the second direction; the receptacle contact comprising the arm adapted to be controllably electrically coupled to the first stationary contact, the arm comprising the first portion and the second portion extending from the first portion and adapted to be controllably electrically coupled to the first stationary contact to controllably electrically couple the arm to the first stationary contact, wherein the at least a portion of the first portion extends in a direction that is parallel to at least the directional component of the direction of extension of the second portion from the first portion; and the transformer assembly comprising the first opening and the first contact arm extending through the first opening of the transformer assembly, the first contact arm being integral with the first stationary contact and comprising the first portion and the second portion extending from the first portion, the at least a portion of the second portion being offset from the first portion. In an exemplary embodiment, the device comprises at least one other of the following: the cam adapted to rotate in place and positioned, relative to the first movable arm, so that the at least a portion of the first movable arm moves, relative to the first stationary contact, in response to the rotation of the cam; the switch comprising the first stationary contact; the member comprising the distal end portion biased towards the first stationary contact; and the cam, wherein the cam is adapted to rotate in place so that the distal end portion is electrically coupled to the first stationary contact, and thus the switch is closed, in response to the rotation of the cam in the first direction; and the distal end portion is electrically decoupled from the first stationary contact, and thus the switch is open, in response to the rotation of the cam in the second direction; the receptacle contact comprising the arm adapted to be controllably electrically coupled to the first stationary contact, the arm comprising the first portion and the second portion extending from the first portion and adapted to be controllably electrically coupled to the first stationary contact to controllably electrically couple the arm to the first stationary contact, wherein the at least a portion of the first portion extends in a direction that is parallel to at least the directional component of the direction of extension of the second portion from the first portion; and the transformer assembly comprising the first opening and the first contact arm extending through the first opening of the transformer assembly, the first contact arm being integral with the first stationary contact and comprising the first portion and the second portion extending from the first portion, the at least a portion of the second portion being offset from the first portion. In an exemplary embodiment, the device comprises all of the following: the cam adapted to rotate in place and positioned, relative to the first movable arm, so that the at least a portion of the first movable arm moves, relative to the first stationary contact, in response to the rotation of the cam; the switch comprising the first stationary contact; the member comprising the distal end portion biased towards the first stationary contact; and the cam, wherein the cam is adapted to rotate in place so that the distal end portion is electrically coupled to the first stationary contact, and thus the switch is closed, in response to the rotation of the cam in the first direction; and the distal end portion is electrically decoupled from the first stationary contact, and thus the switch is open, in response to the rotation of the cam in the second direction; the receptacle contact comprising the arm adapted to be controllably electrically coupled to the first stationary contact, the arm comprising the first portion and the second portion extending from the first portion and adapted to be controllably electrically coupled to the first stationary contact to controllably electrically couple the arm to the first stationary contact, wherein the at least a portion of the first portion extends in a direction that is parallel to at least the directional component of the direction of extension of the second portion from the first portion; and the transformer assembly comprising the first opening and the first contact arm extending through the first opening of the transformer assembly, the first contact arm being integral with the first stationary contact and comprising the first portion and the second portion extending from the first portion, the at least a portion of the second portion being offset from the first portion. In an exemplary embodiment, the device comprises a second stationary contact; a second movable arm, wherein the first and second movable arms are arranged so that the first and second movable arms normally apply biasing forces against the first and second stationary contacts, respectively, and are thereby normally electrically coupled to the first and second stationary contacts, respectively; and third and fourth movable arms arranged so that the third and fourth movable arms normally apply biasing forces against the first and second stationary contacts, respectively, and are thereby normally electrically coupled to the first and second stationary contacts, respectively; wherein the application of the biasing force by each one of the first, second, third and fourth movable arms is independent of the application of the biasing force by each of the other first, second, third and fourth movable arms. In an exemplary embodiment, the device is a ground fault circuit interrupter device adapted to sense a ground fault. In an exemplary embodiment, the device is a ground fault circuit interrupter device adapted to sense a ground fault; and wherein the first movable arm is adapted to be electrically decoupled from the first stationary contact in response to the sensing of the ground fault by the device.

A device has been described that includes first and second stationary contacts; first and second movable arms arranged so that the first and second movable arms normally apply biasing forces against the first and second stationary contacts, respectively, and are thereby normally electrically coupled to the first and second stationary contacts, respectively; and third and fourth movable arms arranged so that the third and fourth movable arms normally apply biasing forces against the first and second stationary contacts, respectively, and are thereby normally electrically coupled to the first and second stationary contacts, respectively; wherein the application of the biasing force by each one of the first, second, third and fourth movable arms is independent of the application of the biasing force by each of the other first, second, third and fourth movable arms. In an exemplary embodiment, the device comprises a sensing device operably coupled to the first and second stationary contacts; wherein the sensing device is adapted to sense a ground fault. In an exemplary embodiment, the device comprises first and second pairs of contacts electrically coupled to the first movable arm; and third and fourth pairs of contacts electrically coupled to the second movable arm. In an exemplary embodiment, the device is adapted to be electrically coupled to a load; and wherein electrical power is adapted to be supplied to the load via the third and fourth movable arms. In an exemplary embodiment, the device comprises a cam engaged with the first, second, third and fourth movable arms and adapted to rotate in place in a first direction to overcome the respective biasing forces applied by the first, second, third and fourth movable arms. In an exemplary embodiment, the device is adapted to sense a ground fault; and wherein the cam is adapted to rotate in the first direction so that the first and second movable arms are electrically decoupled from the first and second stationary contacts, respectively, and the third and fourth movable arms are electrically decoupled from the first and second stationary contacts, respectively, in response to the sensing of the ground fault by the device. In an exemplary embodiment, the device comprises a switch comprising the stationary contact; and a member comprising a distal end portion biased towards the stationary contact; wherein the cam is adapted to rotate in place so that the distal end portion is electrically coupled to the stationary contact, and thus the switch is closed, in response to the rotation of the cam in the first direction; and the distal end portion is electrically decoupled from the stationary contact, and thus the switch is open, in response to the rotation of the cam in a second direction. In an exemplary embodiment, the device comprises a receptacle contact comprising an arm adapted to be controllably electrically coupled to the first stationary contact, the arm comprising a first portion and a second portion extending from the first portion and adapted to be controllably electrically coupled to the first stationary contact to controllably electrically couple the arm to the first stationary contact, wherein at least a portion of the first portion extends in a direction that is parallel to at least a directional component of the direction of extension of the second portion from the first portion. In an exemplary embodiment, the device comprises a transformer assembly comprising a first opening and a first contact arm extending through the first opening of the transformer assembly, the first contact arm being integral with the first stationary contact and comprising a first portion and a second portion extending from the first portion, at least a portion of the second portion being offset from the first portion.

A ground fault circuit interrupter device has been described that includes first and second stationary contacts; first and second movable arms arranged so that the first and second movable arms normally apply biasing forces against the first and second stationary contacts, respectively, and are thereby normally electrically coupled to the first and second stationary contacts, respectively; third and fourth movable arms arranged so that the third and fourth movable arms normally apply biasing forces against the first and second stationary contacts, respectively, and are thereby normally electrically coupled to the first and second stationary contacts, respectively, wherein the application of the biasing force by each one of the first, second, third and fourth movable arms is independent of the application of the biasing force by each of the other first, second, third and fourth movable arms; a cam engaged with the first, second, third and fourth movable arms and adapted to rotate in place in a first direction to overcome the respective biasing forces applied by the first, second, third and fourth movable arms; a switch comprising the stationary contact; and a member comprising a distal end portion biased towards the stationary contact; wherein the cam is adapted to rotate in place so that the distal end portion is electrically coupled to the stationary contact, and thus the switch is closed, in response to the rotation of the cam in the first direction; and the distal end portion is electrically decoupled from the stationary contact, and thus the switch is open, in response to the rotation of the cam in a second direction; a receptacle contact comprising an arm adapted to be controllably electrically coupled to the stationary contact, the arm comprising a first portion and a second portion extending from the first portion and adapted to be controllably electrically coupled to the stationary contact to controllably electrically couple the arm to the stationary contact, wherein at least a portion of the first portion extends in a direction that is parallel to at least a directional component of the direction of extension of the second portion from the first portion; and a transformer assembly comprising a first opening and a first contact arm extending through the first opening of the transformer assembly, the first contact arm being integral with the stationary contact and comprising a first portion and a second portion extending from the first portion, at least a portion of the second portion being offset from the first portion; wherein the device is adapted to sense a ground fault; and wherein the cam is adapted to rotate in the first direction so that the first and second movable arms are electrically decoupled from the first and second stationary contacts, respectively, and the third and fourth movable arms are electrically decoupled from the first and second stationary contacts, respectively, in response to the sensing of the ground fault by the device.

A method of operating a device comprising a cam, a switch and a circuit board defining first and second surfaces spaced in a parallel relation has been described that includes electrically coupling a load to the device; supplying electrical power to the load via the device; sensing whether a ground fault is present or absent using the device; and at least one of the following: if the ground fault is present, stopping the supply of electrical power to the load, wherein stopping the supply of electrical power to the load comprises rotating the cam in a first direction; if the ground fault is present, closing the switch, wherein closing the switch comprises rotating the cam in the first direction; and coupling a transformer assembly comprising an opening to the circuit board, comprising extending a first contact arm through the opening of the transformer assembly; and coupling the first contact arm to the circuit board so that the transformer assembly is adjacent the first surface of the circuit board and the first contact arm engages the second surface of the circuit board. In an exemplary embodiment, the device further comprises a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and wherein the method further comprises reducing the magnitude of the force required to electrically decouple the arm from the stationary contact while maintaining as substantially constant the longitudinal length of the arm. In an exemplary embodiment, the method comprises at least another of the following: if the ground fault is present, stopping the supply of electrical power to the load, wherein stopping the supply of electrical power to the load comprises rotating the cam in the first direction; if the ground fault is present, closing the switch, wherein closing the switch comprises rotating the cam in the first direction; and coupling the transformer assembly comprising the opening to the circuit board, comprising extending the first contact arm through the opening of the transformer assembly; and coupling the first contact arm to the circuit board so that the transformer assembly is adjacent the first surface of the circuit board and the first contact arm engages the second surface of the circuit board. In an exemplary embodiment, the method comprises all of the following: if the ground fault is present, stopping the supply of electrical power to the load, wherein stopping the supply of electrical power to the load comprises rotating the cam in the first direction; if the ground fault is present, closing the switch, wherein closing the switch comprises rotating the cam in the first direction; and coupling the transformer assembly comprising the opening to the circuit board, comprising extending the first contact arm through the opening of the transformer assembly; and coupling the first contact arm to the circuit board so that the transformer assembly is adjacent the first surface of the circuit board and the first contact arm engages the second surface of the circuit board. In an exemplary embodiment, the method comprises resuming the supply of electrical power to the load after stopping the supply of electrical power to the load; wherein resuming the supply of electrical power to the load comprises rotating the cam in a second direction. In an exemplary embodiment, the method comprises emitting light in response to rotating the cam in the first direction. In an exemplary embodiment, the method comprises testing the device. In an exemplary embodiment, testing the device comprises rotating the cam in the first direction to stop the supply of electrical power to the load; and rotating the cam in a second direction to resume the supply of electrical power to the load. In an exemplary embodiment, testing the device further comprises emitting light in response to rotating the cam in the first direction to stop the supply of electrical power to the load; and stopping the emission of light in response to rotating the cam in the second direction to resume the supply of electrical power to the load.

A method of operating a device comprising a cam, a switch and a circuit board defining first and second surfaces spaced in a parallel relation has been described that includes electrically coupling a load to the device; supplying electrical power to the load via the device; sensing whether a ground fault is present or absent using the device; if the ground fault is present, stopping the supply of electrical power to the load, wherein stopping the supply of electrical power to the load comprises rotating the cam in a first direction; if the ground fault is present, closing the switch, wherein closing the switch comprises rotating the cam in the first direction; coupling a transformer assembly comprising an opening to the circuit board, comprising extending a first contact arm through the opening of the transformer assembly; and coupling the first contact arm to the circuit board so that the transformer assembly is adjacent the first surface of the circuit board and the first contact arm engages the second surface of the circuit board; wherein the device further comprises a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and wherein the method further comprises reducing the magnitude of the force required to electrically decouple the arm from the stationary contact while maintaining as substantially constant the longitudinal length of the arm; resuming the supply of electrical power to the load after stopping the supply of electrical power to the load, wherein resuming the supply of electrical power to the load comprises rotating the cam in a second direction; emitting light in response to rotating the cam in the first direction; and testing the device, comprising rotating the cam in the first direction to stop the supply of electrical power to the load; rotating the cam in the second direction to resume the supply of electrical power to the load; emitting light in response to rotating the cam in the first direction to stop the supply of electrical power to the load; and stopping the emission of light in response to rotating the cam in the second direction to resume the supply of electrical power to the load.

A system for operating a device comprising a cam, a switch and a circuit board defining first and second surfaces spaced in a parallel relation has been described that includes means for electrically coupling a load to the device; means for supplying electrical power to the load via the device; means for sensing whether a ground fault is present or absent using the device; and at least one of the following: means for if the ground fault is present, stopping the supply of electrical power to the load, comprising means for rotating the cam in a first direction; means for if the ground fault is present, closing the switch, comprising means for rotating the cam in the first direction; and means for coupling a transformer assembly comprising an opening to the circuit board, comprising means for extending a first contact arm through the opening of the transformer assembly; and means for coupling the first contact arm to the circuit board so that the transformer assembly is adjacent the first surface of the circuit board and the first contact arm engages the second surface of the circuit board. In an exemplary embodiment, the device further comprises a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and wherein the system further comprises means for reducing the magnitude of the force required to electrically decouple the arm from the stationary contact while maintaining as substantially constant the longitudinal length of the arm. In an exemplary embodiment, the system comprises at least another of the following: means for if the ground fault is present, stopping the supply of electrical power to the load, comprising means for rotating the cam in the first direction; means for if the ground fault is present, closing the switch, comprising means for rotating the cam in the first direction; and means for coupling the transformer assembly comprising the opening to the circuit board, comprising means for extending the first contact arm through the opening of the transformer assembly; and means for coupling the first contact arm to the circuit board so that the transformer assembly is adjacent the first surface of the circuit board and the first contact arm engages the second surface of the circuit board. In an exemplary embodiment, the system comprises all of the following: means for if the ground fault is present, stopping the supply of electrical power to the load, comprising means for rotating the cam in the first direction; if the ground fault is present, closing the switch, comprising means for rotating the cam in the first direction; and means for coupling the transformer assembly comprising the opening to the circuit board, comprising means for extending the first contact arm through the opening of the transformer assembly; and means for coupling the first contact arm to the circuit board so that the transformer assembly is adjacent the first surface of the circuit board and the first contact arm engages the second surface of the circuit board. In an exemplary embodiment, the system comprises means for resuming the supply of electrical power to the load after stopping the supply of electrical power to the load; wherein means for resuming the supply of electrical power to the load comprises means for rotating the cam in a second direction. In an exemplary embodiment, the system comprises means for emitting light in response to rotating the cam in the first direction. In an exemplary embodiment, the system comprises means for testing the device. In an exemplary embodiment, means for testing the device comprises means for rotating the cam in the first direction to stop the supply of electrical power to the load; and means for rotating the cam in a second direction to resume the supply of electrical power to the load. In an exemplary embodiment, means for testing the device further comprises means for emitting light in response to rotating the cam in the first direction to stop the supply of electrical power to the load; and means for stopping the emission of light in response to rotating the cam in the second direction to resume the supply of electrical power to the load.

A system for operating a device comprising a cam, a switch and a circuit board defining first and second surfaces spaced in a parallel relation has been described that includes means for electrically coupling a load to the device; means for supplying electrical power to the load via the device; means for sensing whether a ground fault is present or absent using the device; and means for if the ground fault is present, stopping the supply of electrical power to the load, comprising means for rotating the cam in a first direction; means for if the ground fault is present, closing the switch, comprising means for rotating the cam in the first direction; means for coupling a transformer assembly comprising an opening to the circuit board, comprising means for extending a first contact arm through the opening of the transformer assembly; and means for coupling the first contact arm to the circuit board so that the transformer assembly is adjacent the first surface of the circuit board and the first contact arm engages the second surface of the circuit board; wherein the device further comprises a stationary contact and an arm adapted to be controllably electrically coupled to the stationary contact, at least a portion of the arm comprising a direction of extension comprising a longitudinal directional component that generally defines the majority of the longitudinal length of the arm, wherein a force is adapted to be applied against the at least a portion of the arm to electrically decouple the arm from the stationary contact; and wherein the system further comprises means for reducing the magnitude of the force required to electrically decouple the arm from the stationary contact while maintaining as substantially constant the longitudinal length of the arm; means for resuming the supply of electrical power to the load after stopping the supply of electrical power to the load, wherein means for resuming the supply of electrical power to the load comprises means for rotating the cam in the second direction; means for emitting light in response to rotating the cam in the first direction; and means for testing the device, comprising means for rotating the cam in the first direction to stop the supply of electrical power to the load; means for rotating the cam in a second direction to resume the supply of electrical power to the load; means for emitting light in response to rotating the cam in the first direction to stop the supply of electrical power to the load; and means for stopping the emission of light in response to rotating the cam in the second direction to resume the supply of electrical power to the load.

It is understood that variations may be made in the foregoing without departing from the scope of the disclosure. In several exemplary embodiments, the device 10 and/or one or more components thereof such as, for example, the circuit 102, may be modified for use with, and/or may be incorporated into, other types of circuits that require, for example, quickly and efficiently stopping the flow of one or more electrical currents, quickly and efficiently stopping the supply of electrical power to one or more loads, and/or quickly and efficiently causing one or more electrical couplings to be decoupled. Examples of such other types of circuits include, but are not limited to, arc fault detection circuits and/or circuit-breaker circuits.

In several exemplary embodiments, instead of, or in addition to providing receptacle outlets that supply electrical power, the device 10 and/or one or more components thereof such as, for example, the circuit 102, may be modified for use in, and/or may be incorporated into, other types of GFCI devices such as, for example, a wide variety of residual current devices, a wide variety of residual current circuit breakers, a wide variety of electrical plugs, a wide variety of arc fault circuit interrupters, a wide variety of sockets, and/or any combination thereof.

In several exemplary embodiments, in addition to, or instead of the transformer assembly 62, the sensing device 104 may include one or more other types of sensors. In several exemplary embodiments, in addition to, or instead of the solenoid assembly 76, the actuator 106 may include one or more other types of transducer devices.

In several exemplary embodiments, in addition to, or instead of the foregoing, the cam 54 may include a wide variety of profiles and/or shapes. In several exemplary embodiments, in addition to, or instead of the cam 54, a wide variety of other force actuation means may be used to independently electrically decouple each of the arms 78 and 80 from the stationary contacts 70 and 72, respectively, and to independently electrically decouple each of the arms 38*d* and 40*d* from the stationary contacts 70 and 72, respectively.

In several exemplary embodiments, in addition to, or instead of the foregoing, the stationary contacts 70 and/or 72 may include a wide variety of shapes. In several exemplary embodiments, in addition to, or instead of the foregoing, the wire spring 86 may include a wide variety of wire forms and/or bends, and/or may be in the form of a flat spring or other type of spring-biased member or bracket.

In several exemplary embodiments, instead of, or in addition to sensing the presence of a ground fault, the sensing device 104 may sense or detect one or more other types of faults or errors such as, for example, one or more other types of electrical faults or errors. In several exemplary embodiments, the method 109 may be carried out in accordance with the foregoing except that, in addition to, or instead of sensing a ground fault, the sensing device 104 may sense or detect one or more other types of faults or errors such as, for example, one or more other types of electrical faults or errors. In several exemplary embodiments, instead of, or in addition to the sensing of a ground fault, the device 10 may be placed in its above-described tripped state in response to the sensing or detection of one or more other types of faults or errors such as, for example, one or more other types of electrical faults or errors.

Any spatial references such as, for example, "upper," "lower," "above," "below," "between," "vertical," "horizontal," "angular," "upward," "downward," "side-to-side," "left-to-right," "right-to-left," "top-to-bottom," "bottom-to-top," "left," "right," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An arc-fault circuit interrupter device comprising:
a sensing device adapted to sense an arc fault; and
a switch electrically coupled to a light emitting diode (LED), wherein the switch comprises:
a stationary contact;
a member comprising a distal end portion biased towards the stationary contact; and
a cam rotatable in place:
wherein the cam is adapted to rotate in a first direction in response to the sensing device sensing the arc fault, the rotation of the cam removes a force being applied on at least a portion of the member and allows the distal end portion to electrically couple to the stationary contact, thereby closing the switch and emitting light from the LED to provide visual notification of the arc fault; and
wherein the cam is adapted to rotate in a second direction different from the first direction to electrically decouple the distal end portion from the stationary contact thereby opening the switch by applying a force on at least a portion of the member and ceasing the emission of the light that provides visual notification of the arc fault.

2. The apparatus of claim 1, further comprising:
a second switch, comprising:
a second stationary contact; and
a second member comprising a second distal end portion biased towards the second stationary contact;
wherein the rotation of the cam in the second direction electrically couples the second distal end portion to the second stationary contact and closes the second switch; and
wherein the rotation of the cam in the first direction electrically decouples the second distal end portion to the second stationary contact and opens the second switch.

3. The apparatus of claim 1, wherein the sensing device comprises a transformer assembly operably coupled to the stationary contact.

4. The apparatus of claim 3, wherein the transformer assembly is physically coupled to the stationary contact.

5. The device of claim 1, wherein the LED emits light in response to the first distal end portion electrically coupling to the first stationary contact.

6. The device of claim 5, wherein the LED stops emitting light in response to the first distal end portion electrically decoupling from the first stationary contact.

7. The apparatus of claim 1, wherein the cam further comprises a protrusion that engages the first distal end portion when the cam rotates in the second direction.

8. A system for operating an arc-fault circuit interrupter device comprising a first switch, a second switch, and a cam, the device further comprising:

means for rotating the cam in a first direction and a second direction, the second direction being opposite the first direction;

means for electrically coupling a load to the device;

means for supplying electrical power to the load via the device means for sensing whether an arc fault is present or absent using the device;

means for emitting light in response to a closing of the switch in response to sensing the arc fault to provide visual notification of the arc fault; and means for supplying electrical power to the means for emitting light;

wherein the cam is adapted to rotate in the first direction with the means for rotating the cam in response to the means for sensing whether the arc fault is present or absent sensing the arc fault and causing the means for supplying electrical power to open the second switch, terminating the supply of the electrical power to the load and causing the means for supplying electrical power to the means for emitting light to close the first switch, supplying electrical power to the means for emitting light; and wherein the cam is adapted to rotate in the second direction with the means for rotating the cam causing the means for supplying electrical power to close the second switch, supplying the electrical power to the load and causing the means for supplying electrical power to the means for emitting light to open the first switch, terminating the supply of electrical power to the means for emitting light.

9. The system of claim 8, wherein the cam comprises a protrusion that engages the distal end portion when the cam rotates in the second direction.

10. The system of claim 8, wherein the means for closing the switch further comprises means for electrically decoupling a load to the device.

11. The system of claim 8, further comprising means for after the arc fault is present, opening the switch, comprising means for rotating the cam in a second direction.

12. The system of claim 8, wherein the cam further comprises a protrusion that engages the switch when the cam rotates in the second direction.

13. An arc-fault circuit interrupter device comprising:

a sensing device adapted to sense an arc fault;

a first switch comprising a first stationary contact and a member comprising a first distal end portion that is controllably electrically coupled and decoupled to the first stationary contact; and means for closing the first switch, comprising:

means for rotating a cam in a first direction in response to the sensing device sensing the arc fault; and means for electrically coupling the first distal end portion to the first stationary contact in response to rotating the cam in the first direction;

a second switch comprising a second stationary contact and a member comprising a second distal end portion that is controllably electrically coupled and decoupled to the second stationary contact; and means for closing the second switch, comprising:

means for rotating the cam in a second direction different from the first direction; and means for electrically coupling the second distal end portion to the second stationary contact in response to rotating the cam in the second direction.

14. The system of claim 13, wherein rotation of the cam in the second direction electrically couples the second distal end portion to the second stationary contact and closes the second switch; and wherein the rotation of the cam in the first direction electrically decouples the second distal end portion to the second stationary contact and opens the second switch.

15. The system of claim 13, wherein a light source emits light in response to the first distal end portion electrically coupling to the first stationary contact and the light source stops emitting light in response to the first distal end portion electrically decoupling from the first stationary contact.

16. The system of claim 13, wherein the sensing device comprises a transformer assembly operably coupled to the stationary contact.

17. The system of claim 16, wherein the transformer assembly is physically coupled to the stationary contact.

18. The system of claim 13, wherein the cam comprises a protrusion that engages the first distal end portion when the cam rotates in the second direction.

19. An arc fault circuit interrupter device, comprising:

a switch comprising:

a stationary contact; and a member comprising a distal end portion biased towards the stationary contact; and a cam adapted to rotate in place so that:

the distal end portion is electrically coupled to the stationary contact, and thus the switch is closed, in response to the rotation of the cam in a first direction; and the distal end portion is electrically decoupled from the stationary contact, and thus the switch is open, in response to the rotation of the cam in a second direction;

wherein, in response to the rotation of the cam in the first direction, the bias of the distal end portion is permitted to cause the distal end portion to be electrically coupled to the stationary contact;

wherein, in response to the rotation of the cam in the second direction, the bias of the distal end portion is resisted by the cam;

wherein the member comprises a wire spring comprising one or more bends formed therein, the distal end portion being defined by at least one of the one or more bends;

wherein the cam comprises a protrusion adapted to engage the distal end portion when the cam rotates in the second direction;

wherein the device further comprises a sensing device adapted to sense an arc fault;

wherein the cam is adapted to rotate in first direction in response to the sensing of the arc fault by the sensing device;

wherein the device further comprises an actuator operably coupled to the sensing device;

wherein the actuator is adapted to actuate in response to the sensing of the arc fault by the sensing device;

wherein the cam is adapted to rotate in the first direction in response to the actuation of the actuator in response to the sensing of the arc fault by the sensing device;

wherein the sensing device comprises a transformer assembly operably coupled to the stationary contact;

wherein the actuator comprises a solenoid assembly adapted to be energized in response to the sensing of the arc fault by the sensing device;

wherein the device further comprises a light source electrically coupled to the switch and adapted to emit light when the switch is closed;

wherein the light source comprises one or more light-emitting diodes;

wherein the device further comprises at least one movable arm adapted to be controllably electrically coupled to the stationary contact and arranged so that at least a portion of the at least one movable arm moves, relative to the stationary contact, in response to the rotation of the cam;

wherein the at least one arm is electrically decoupled from the stationary contact in response to the rotation of the cam in the first direction;

wherein the at least one arm is electrically coupled to the stationary contact in response to the rotation of the cam in the second direction; and wherein the at least one movable arm is adapted to be electrically coupled to a load and used to supply electrical power to the load when the at least one arm is electrically coupled to the stationary contact.

20. An arc-fault circuit interrupter device comprising:

a sensing device adapted to sense an arc fault;

a first switch, comprising:

a first stationary contact; and a first member comprising a distal end portion biased towards the stationary contact;

a second switch comprising:

a second stationary contact; and a second member comprising a second distal end portion biased towards the second stationary contact; and a cam rotatable in place wherein the cam rotates in a first direction in response to the sensing device sensing the arc fault, removes a force being applied on at least a portion of the first member and allows the distal end portion to electrically couple to the first stationary contact, thereby closing the switch and electrically decouples the second distal end portion from the second stationary contact and opens the second switch; and wherein the cam rotates in a second direction different from the first direction, electrically decouples the distal end portion from the first stationary contact thereby opening the first switch by applying a force on at least a portion of the first member, and electrically couples the second distal end portion to the second stationary contact and closes the second switch.

* * * * *